US009248849B2

(12) United States Patent
O'Dell

(10) Patent No.: US 9,248,849 B2
(45) Date of Patent: Feb. 2, 2016

(54) APPARATUS FOR BI-DIRECTIONAL DOWNSTREAM ADJACENT CROSSING SIGNALING

(71) Applicant: Siemens Industry, Inc., Alpharetta, GA (US)

(72) Inventor: Randy O'Dell, Blue Springs, MO (US)

(73) Assignee: Siemens Industry, Inc., Alpharetta, GA (US)

( * ) Notice: Subject to any disclaimer, the term of this patent is extended or adjusted under 35 U.S.C. 154(b) by 306 days.

(21) Appl. No.: 13/958,987

(22) Filed: Aug. 5, 2013

(65) Prior Publication Data

US 2013/0313373 A1 Nov. 28, 2013

Related U.S. Application Data

(62) Division of application No. 12/911,092, filed on Oct. 25, 2010, now Pat. No. 8,500,071.

(60) Provisional application No. 61/272,726, filed on Oct. 27, 2009.

(51) Int. Cl.
*B61L 29/28* (2006.01)
*B61L 29/32* (2006.01)

(52) U.S. Cl.
CPC *B61L 29/28* (2013.01); *B61L 29/32* (2013.01)

(58) Field of Classification Search
CPC ..... B61L 23/06; B61L 29/32; B61L 1/181; B61L 29/24; B61L 29/282; B61L 29/284; B61L 1/164
USPC ..... 246/125, 111, 126, 122 R, 167 A, 122 A, 246/34 R, 118, 120, 121, 220, 246, 255, 246/293, 292, 473.1
See application file for complete search history.

(56) References Cited

U.S. PATENT DOCUMENTS 2,106,682 A 1/1938 Field et al.
2,719,218 A 9/1955 Miller
(Continued)

FOREIGN PATENT DOCUMENTS

CA 1149918 7/1983
CN 1491846 4/2004
(Continued)

OTHER PUBLICATIONS

GE Transportation ElectroLogIXS XP4: For Crossing Prediction.
(Continued)

*Primary Examiner* — Mark Le

(57) ABSTRACT

First and second crossing predictors communicate with each other, and each predictor transmits signals to instruct downstream adjacent predictors to activate their warning devices at a constant warning time (referred to as DAXing) by using train detection information from the other predictor. The communications between the predictors may be rail based, wireless or wired using conductors other than rails. Multiple predictors may be present between the first and second crossing predictors, and each such predictor may be DAXed by one of the outer predictors based on the train's direction. The predictor also transmits a signal to inform the other predictor of the presence of the train so that the other predictor may determine whether to suppress DAXing. Detecting an incoming train direction at a predictor by utilizing a second receiver attached to the track rails at a location offset from the first receiver.

13 Claims, 58 Drawing Sheets

(56) References Cited

U.S. PATENT DOCUMENTS

| | | | | |
|---|---|---|---|---|
| 3,268,723 | A | 8/1966 | Failor et al. | |
| 3,610,920 | A | 10/1971 | Frielinghaus | |
| 3,966,149 | A | 6/1976 | Matty et al. | |
| 4,015,082 | A | 3/1977 | Matty et al. | |
| 4,065,081 | A | 12/1977 | Huffman et al. | |
| 4,172,576 | A | 10/1979 | Svet, Jr. et al. | |
| 4,324,376 | A | 4/1982 | Kuhn | |
| 4,498,650 | A | 2/1985 | Smith et al. | |
| 4,582,279 | A | 4/1986 | Pontier | |
| 4,723,739 | A | 2/1988 | Franke | |
| 4,737,968 | A | 4/1988 | Norton et al. | |
| 4,752,742 | A | 6/1988 | Akaiwa | |
| 4,855,737 | A | 8/1989 | Poole | |
| 4,868,864 | A | 9/1989 | Tjahjadi | |
| 5,029,780 | A | 7/1991 | Peel | |
| 5,309,113 | A | 5/1994 | Mimura | |
| 5,398,894 | A | 3/1995 | Pascoe | |
| 5,453,715 | A | 9/1995 | Lee | |
| 5,469,112 | A | 11/1995 | Lee | |
| 5,553,064 | A | 9/1996 | Paff | |
| 5,554,982 | A | 9/1996 | Shirkey et al. | |
| 5,590,855 | A | 1/1997 | Kato et al. | |
| 5,633,895 | A | 5/1997 | Powell, II et al. | |
| 5,640,428 | A | 6/1997 | Abe | |
| 5,720,454 | A | 2/1998 | Bachetti | |
| 5,739,768 | A | 4/1998 | Lane et al. | |
| 5,864,304 | A | 1/1999 | Gerszberg et al. | |
| 5,890,682 | A | 4/1999 | Welk | |
| 5,954,299 | A | 9/1999 | Pace | |
| 6,011,508 | A | 1/2000 | Perreault et al. | |
| 6,011,816 | A | 1/2000 | Sanielevici et al. | |
| 6,025,789 | A | 2/2000 | Lane et al. | |
| 6,097,768 | A | 8/2000 | Janesch | |
| 6,145,792 | A | 11/2000 | Penza | |
| 6,179,252 | B1 | 1/2001 | Roop et al. | |
| 6,218,961 | B1 | 4/2001 | Gross et al. | |
| 6,220,552 | B1 | 4/2001 | Ireland | |
| 6,386,486 | B1 * | 5/2002 | Speranza | B61L 29/28 246/122 R |
| 6,396,869 | B1 | 5/2002 | Park | |
| 6,572,056 | B2 | 6/2003 | Berry et al. | |
| 6,823,026 | B2 | 11/2004 | Mueller et al. | |
| 6,830,224 | B2 | 12/2004 | Lewin et al. | |
| 7,017,864 | B2 | 3/2006 | McAllister | |
| 7,098,774 | B2 | 8/2006 | Davenport et al. | |
| 7,254,467 | B2 | 8/2007 | Fries et al. | |
| 7,523,893 | B2 | 4/2009 | Francis et al. | |
| 7,575,202 | B2 | 8/2009 | Sharkey et al. | |
| 7,618,010 | B2 | 11/2009 | Fries | |
| 7,733,991 | B2 | 6/2010 | Ryter | |
| 7,832,691 | B2 | 11/2010 | Reibeling et al. | |
| 2004/0181321 | A1 | 9/2004 | Fries et al. | |
| 2007/0084974 | A1 | 4/2007 | Sharkey et al. | |
| 2008/0101481 | A1 | 5/2008 | Al-Eidan | |
| 2008/0169385 | A1 * | 7/2008 | Ashraf | B61L 29/28 246/130 |
| 2012/0138752 | A1 * | 6/2012 | Carlson | B61L 1/164 246/126 |
| 2012/0217351 | A1 * | 8/2012 | Chadwick | B61L 23/06 246/169 R |
| 2013/0015297 | A1 * | 1/2013 | Steffen, II | B61L 29/32 246/125 |
| 2013/0248659 | A1 * | 9/2013 | Lingvall | B61L 29/28 246/126 |
| 2014/0191090 | A1 * | 7/2014 | Busse | B61L 29/284 246/126 |

FOREIGN PATENT DOCUMENTS

| | | |
|---|---|---|
| DE | 10 2004 057459 | 6/2006 |
| EP | 0 165 048 | 12/1985 |
| EP | 0 878 373 | 11/1998 |
| EP | 1338492 | 8/2003 |
| GB | 1546942 | 5/1979 |
| JP | 11020702 | 1/1999 |
| JP | 2006168382 | 6/2006 |
| JP | 2006327290 | 12/2006 |
| JP | 2008-137400 | 6/2008 |
| KR | 10-2003-0011127 | 2/2003 |
| KR | 10-2004-0060261 | 7/2004 |
| KR | 10-2004-0106864 | 12/2004 |
| KR | 10-2009-0104379 | 10/2009 |
| WO | WO 91/11356 | 8/1991 |
| WO | WO 2004/071839 | 8/2004 |

OTHER PUBLICATIONS

Engelbrecht, Roelof J., "The Effect of Variation in Railroad Warning Time on Traffic Signal Preemption," Texas Transportation Institute, pp. 1-17.

Victrack Access, "Low Cost Level Cross Warning Device," pp. 1-14, First Release, Jun. 6, 2008.

C3 Trans Systems LLC, "New Crossing Technology, Model HRI 2000: Improved Grade Crossing Warning System," 2 pages, 2004.

Russel, Michael, "High-Speed Rail Program: Integrated Quad Gate Crossing Control System," IDEA, Transportation Research Board, National Research Council, pp. 1-28, Dec. 2001.

Li, Meng et al., "Analysis Toward Mitigation of Congestion and Conflicts at Light Rail Grade Crossings and Intersections," California PATH Research Report, UCB-ITS-PRR-2009-9, Final Report for Task Order 5407, pp. 1-55, Jan. 2009.

http://www.southbaysignal.com/crossing.htm, South Bay Signal LLC, Grade Crossing Warning Systems, printed Apr. 20, 2010.

English language abstract of TW 455553, published Sep. 21, 2001.

English language abstract of CN 1491846, published Apr. 28, 2004.

English language abstract of JP 11-020702, published Jan. 26, 1999.

English language abstract of JP 2006-327290, published Dec. 7, 2006.

Machine English language translation of JP 2006-327290, published Dec. 7, 2006.

English language abstract of JP 2006-168382, published Jun. 29, 2006.

Machine English language translation of JP 2006-168382, published Jun. 29, 2006.

English language abstract of SU 1592204, published Sep. 15, 1990.

"How Railroad Crossing Signals Work", http://matt.zont.org/signals/crossing/xngworks/xngworks/html, last revised Jan. 10, 2007, 28 pages.

English language abstract of JP 2008-137400, published Jun. 19, 2008.

Machine English language translation of JP 2008-137400, published Jun. 19, 2008.

International Search Report issued in International Application No. PCT/US2010/054135, mailed Jun. 28, 2011.

Written Opinion issued in International Application No. PCT/US2010/054135, mailed Jun. 28, 2011.

English language abstract of KR 10-2009-0104379, published Oct. 6, 2009.

English language abstract of KR 10-2004-0106864, published Dec. 18, 2004.

English language abstract of KR 10-2003-0011127, published Feb. 6, 2003.

English language abstract of KR 10-2004-0060261, published Jul. 6, 2004.

English language abstract of DE 10 2004 057459, Published Jun. 1, 2006.

Machine English language translation of DE 10 2004 057459, Published Jun. 1, 2006.

Crawford E. Staples, AFO Can Solve Highway Crossing Problems, Railway Signaling and Communications, vol. 52, pp. 20-26 (Sep. 1964).

* cited by examiner

APPARATUS FOR BI-DIRECTIONAL DOWNSTREAM ADJACENT CROSSING SIGNALING

This application is a Divisional of U.S. patent application Ser. No. 12/911,092, filed Oct. 25, 2010, which claims priority to U.S. Provisional Application Ser. No. 61/272,726, filed on Oct. 27, 2009 and entitled "Method and Apparatus for Bi-Directional Downstream Adjacent Crossing Signaling" the entireties of which are hereby incorporated by reference herein.

This application is also related to U.S. Provisional Application Ser. No. 61/226,416, filed on Jul. 17, 2009 and entitled "Track Circuit Communications," the entirety of which is hereby incorporated by reference herein.

BACKGROUND

A crossing predictor (often referred to as a grade crossing predictor in the U.S. or a level crossing predictor in the U.K.) is an electronic device which is connected to the rails of a railroad track and is configured to detect the presence of an approaching train and determine its speed and distance from a crossing (i.e., a location at which train tracks cross a road, sidewalk or other surface used by moving objects), and use this information to generate a constant warning time signal for control of a crossing warning device. A crossing warning device is a device which warns of the approach of a train at a crossing, such as crossing gate arms (e.g., the familiar black and white striped wooden arms often found at highway grade crossings to warn motorists of an approaching train), crossing lights (such as the two red flashing lights often found at highway grade crossings in conjunction with the crossing gate arms discussed above), and/or crossing bells or other audio alarm devices. Crossing predictors are often (but not always) configured to activate the crossing warning device at a fixed time (e.g. 30 seconds) prior to an approaching train arriving at a crossing.

Typical crossing predictors include a transmitter that transmits a signal over a circuit formed by the rails of the track and one or more shunts positioned at desired approach distances from the transmitter, a receiver that detects one or more resulting signal characteristics, and a logic circuit such as a microprocessor or hardwired logic that detects the presence of a train and determines its speed and distance from the crossing. The approach distance depends on the maximum allowable speed of a train, the desired warning time, and a safety factor. Preferred embodiments of crossing predictors transmit generate a constant current AC signal, and the crossing predictor detects a train and determines its distance and speed by measuring impedance changes due to the train's wheels and axle acting as a shunt across the rails and thereby effectively shortening the length (and hence the impedance) of the rails in the circuit. Those of skill in the art will recognize that other configurations of crossing predictors are possible.

It should be understood that trains are sometimes expected to move in both directions along a track. In such situations, a shunt may be placed at the desired approach distance on both sides of a crossing. Crossing predictors typically detect a train on either side of the crossing and activate a warning device when a train approaches from either direction, but do not have the ability to determine the direction of travel of a train along the track or distinguish a train on one side of the crossing from a train on the other side of the crossing (in other words, the crossing predictor can determine that a train is moving toward or away from it, but cannot determine from which side of the crossing the train is approaching). Such crossing predictors are sometimes referred to as bidirectional crossing predictors.

In certain locations, two or more crossings may be located within a desired approach distance of each other. In order to prevent the signals transmitted by one crossing predictor from interfering with another crossing predictor in such situations, the crossing predictors are often configured to transmit on different frequencies. This technique works well when the number of adjacent crossings is small. However, when the number of adjacent crossings gets larger, a problem can occur. A certain amount of separation between transmitted frequencies is necessary in order to ensure that a crossing predictor can reliably discriminate between its frequency and an adjacent frequency, and the maximum distance at which a train may be reliably detected is inversely proportional to the transmission frequency. Thus, only a certain number of unique frequencies at which the crossing predictors may transmit are available. Indeed, in some areas (particularly urban areas), not enough unique frequencies may be available to accommodate a number of crossings in close proximity with desired approach distances.

In order to address such situations, techniques for using a crossing predictor to detect and predict the arrival of a train at a downstream crossing and transmit a constant warning time signal to a device at the downstream crossing accordingly (i.e., generate and transmit a signal to activate the warning device at the downstream location when the speed and distance of a train are such that the train will reach the downstream crossing within a desired constant warning time). A term commonly used in the railroad industry for such prediction and signaling is "DAXing." "DAX" is an acronym for "downstream adjacent crossing." Further background information regarding DAXing can be found in U.S. Pat. No. 7,575,202, the contents of which are hereby incorporated herein by reference. It should be understood that the DAX signal may be transmitted by any means, including by radio or over a buried lines or above-ground wires.

Those of skill in the art will recognize that, for tracks on which trains may move in either direction, DAXing may be desired when a train moves in one direction but not in the other direction. For example, on a track running from east to west, it is desirable for a crossing predictor at a first crossing to DAX a second device at a nearby second crossing located to the east of the first crossing if a train is approaching the first crossing from the west. However, having the crossing predictor at the first crossing DAX the device at the second crossing may not be desirable in the event that the train were approaching the first crossing from the east.

In situations in which three (or more) crossings are closely located and a sufficient number of unique transmission frequencies are not available, it has been known to configure outer crossing predictors to DAX the inner crossing predictors (and, sometimes, to also DAX the downstream outer predictor). Because bidirectional crossing predictors cannot determine from which side of a crossing a train is approaching, and because it is desirable for an outer crossing predictor to DAX an inner crossing predictor only when the inner crossing predictor is downstream with respect to the direction in which a train is traveling, the outer predictors are made to act as unidirectional predictors by placing an insulated track joint at the location of the outer predictor. The insulated track joint only allows the transmitted signal to propagate in one direction along the track. The crossing predictor will employ two circuits, one on each side of the insulated joint, with each circuit therefore detecting trains on only one side of the crossing. The crossing predictor is equipped with logic that can determine whether the train in one circuit has previously been seen by the other circuit and therefore can DAX in only the desired direction. In other variations, insulated joints have been used in other ways to allow reuse of frequencies in dense areas.

The use of insulated track joints to accommodate crossing predictors as discussed above is costly, both in terms of the cost of initial installation and maintenance of the insulated track joints themselves, and in the need for additional changes to the installed signaling system, such as the need for coded track repeater units and filters.

DETAILED DESCRIPTION

The present invention will be discussed with reference to preferred embodiments of crossing predictors. Specific details, such as transmission frequencies and types of track circuits, are set forth in order to provide a thorough understanding of the present invention. The preferred embodiments discussed herein are considered in all respects to be illustrative and should not be understood to limit the invention. Furthermore, for ease of understanding, certain method steps are delineated as separate steps; however, these steps should not be construed as necessarily distinct nor order dependent in their performance.

Figure 1:
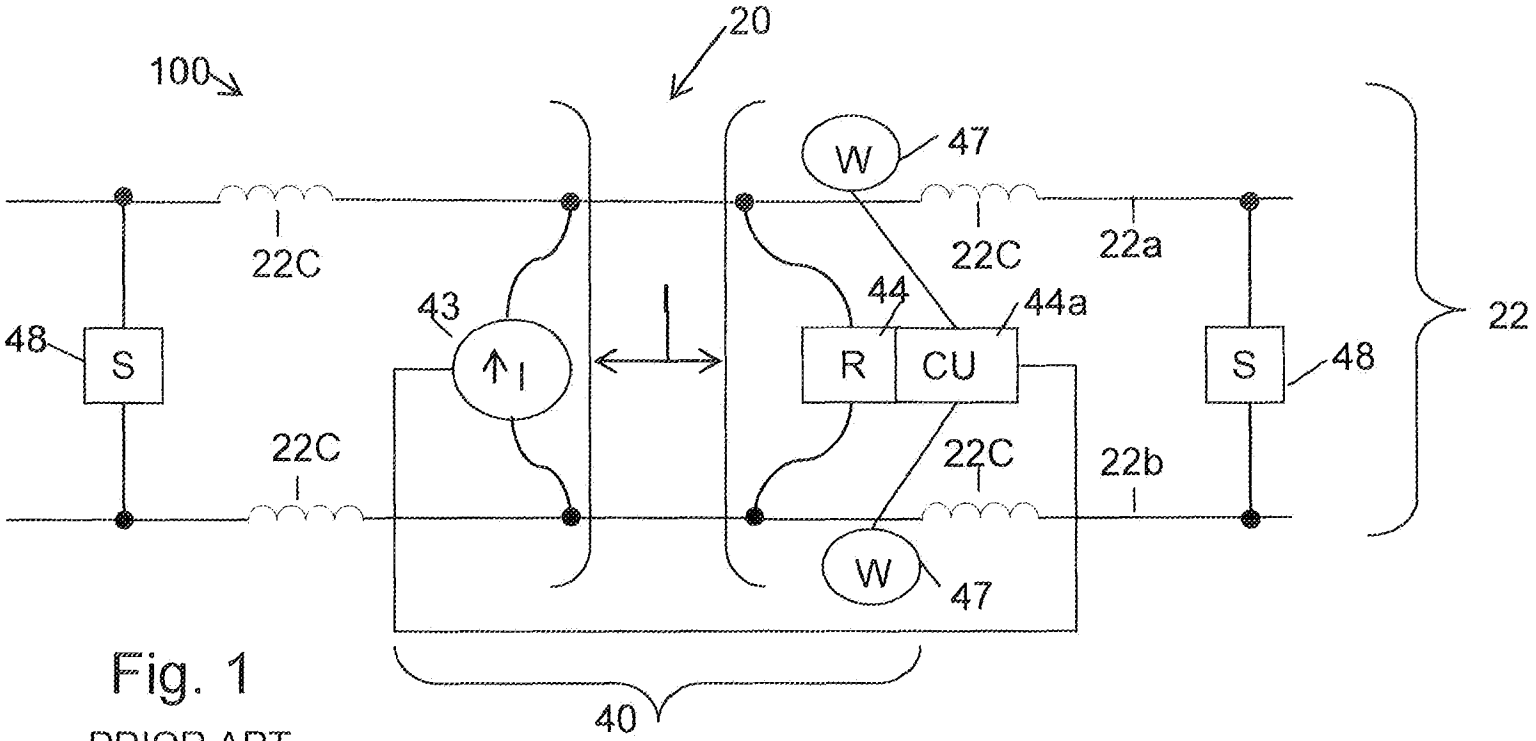
Fig. 1 PRIOR ART
FIG. 1 is a circuit diagram of a known crossing predictor.

FIG. 1 illustrates a typical prior art crossing predictor circuit 100 at a location in which a road 20 crosses train track 22. The train track 22 includes two rails 22*a*, 22*b* and a plurality of ties (not shown in FIG. 1) that support the rails. The rails 22*a,b* are shown as including inductors 22*c*. The inductors 22*c* are not separate physical devices but rather are shown to illustrate the inherent distributed inductance of the rails 22*a,b*. This inductance is typically taken to be 0.5 mH per 1000 ft of rail. A crossing predictor 40 comprises a transmitter 43 connected across the rails 22*a,b* on one side of the road 20 and a receiver 44 connected across the rails 22*a,b* on the other side of the road 20. Although the transmitter 43 and receiver 44 are connected on opposite sides of the road 20, those of skill in the art will recognize that the components of the transmitter 43 and receiver 44 other than the physical conductors that connect to the track are often co-located in an enclosure located on one side of the road 20. The transmitter 43 and receiver 44 are also connected to a control unit 44*a*, which is also often located in the aforementioned enclosure. The control unit 44*a* is connected to and includes logic for controlling warning devices 47 at the crossing 20. The control unit 44*a* also includes logic (which may be implemented in hardware, software, or a combination thereof) for calculating train speed and constant warning time signals for its own crossing and for DAX signals for other predictors at downstream crossings, and further includes logic, timers and input ports that are described in further detail below. Also shown in FIG. 1 are a pair of shunts 48, one on each side of the road 20 at a desired approach distance. The shunts 48 may be simple conductors, but are typically tuned circuit AC circuits configured to shunt the particular frequency being transmitted by the transmitter 43. A frequency selectable shunt is disclosed in U.S. Pat. No. 5,029,780, the entire contents of which are hereby incorporated herein by reference. The transmitter 43 is configured to transmit constant current AC signal at a particular frequency, typically in the audio frequency range, such as 50 Hz-1000 Hz. The receiver 44 measures the voltage across the rails 22*a,b*, which (because the transmitter 43 generates a constant current) is indicative of the impedance and hence the inductance of the circuit formed by the rails 22 *a,b* and shunts 48.

If a train heading toward the road 20 crosses one of the shunts 48, the train's wheels and axles act as shunts which essentially shorten the length of the rails 22*a,b*, thereby lowering the inductance and hence the impedance and voltage. Measuring the change in the impedance indicates the distance of the train, and measuring the rate of change of the impedance (or integrating the impedance over time) allows the speed of the train to be determined. As a train moves toward the road 20 from either direction, the impedance of the circuit will decrease, whereas the impedance will increase as the train moves away from the receiver 44/transmitter 43 toward the shunts 48. Thus, the predictor is able to determine whether the train is inbound or outbound with respect to the road 20, but cannot determine on which side of the road 20 the train is located.

The predictor 40 outputs a signal, sometimes referred to as the EZ level, that is dependent upon the aforementioned change in impedance. The EZ level is a normalized value that is based on an integration of multiple track parameters (e.g., amplitude, phase, etc.,) to represent the position of a train on the approach. An EZ level of 100 is the nominal full strength signal when no train is in the approach (i.e., between the receiver 44 and either shunt). As a train approaches the receiver 44 from either direction, the EZ level decreases nearly proportionally to the distance of the train from the receiver 44. Thus, the EZ level when a train has traveled approximately half of the approach distance will be approximately 50. In practice, an EZ level above 80 is sometimes used as a threshold to declare that a train is inside or outside the approach, whereas an EZ level below 10 or 20 is sometimes used as a threshold to indicate a train in close proximity.

Those of skill in the art will recognize that more sophisticated crossing predictor circuits are configured to compensate for leakage currents across the rails 22*a,b* (such as caused by water and/or road salt), which are typically resistive rather than inductive, by, e.g., measuring phase shifts in addition to amplitude. All such variations are within the scope of the invention.

As discussed above, the transmitter 43 and receiver 44 are typically located on opposite sides of the road 20. Those of skill in the art will recognize that this is not necessary for the crossing predictor circuit, and that it is possible for the transmitter 43 and receiver 44 to be located at the same points on the rails 22*a,b* (indeed, this is often the case for unidirectional crossing predictors). The transmitter 43 and receiver 44 are placed on opposite sides of the road 20 in order to form part of what is known in the art as an "island" circuit. An island circuit is a track occupancy circuit that detects the presence of a train between the receiver and transmitter. It is called an island circuit because the width W of the road 20 that intersects the track 22 is typically referred to in the industry as an island, likely because such areas are typically raised in relation to adjacent areas and resemble an island in the event that the lower lying adjacent areas become flooded. Island circuits are desirable so that a crossing warning device (e.g., the crossing gates) can be deactivated to allow traffic to use the road 20 to cross the track 22 as soon as the train has cleared the section of track 22 that crosses the road 20. Those of skill in the art will recognize that a crossing predictor circuit is not suitable for detecting the presence of a train in the island because, once any part of the train is near or over the receiver 44, the impedance does not change or changes only very little due to the presence of multiple pairs of wheels and axles on the train (in other words, once one axle of the train reaches the receiver 44, the impedance remains constant or nearly constant until the entire train has passed the receiver 44, and the length of trains may vary widely).

Island circuits work by transmitting a signal (typically but not necessarily an AC signal) between the transmitter and receiver and determining the presence of a train by detecting the absence or severe attenuation of the transmitted signal at the receiver caused by the wheels and axle of a train creating a short between the rails 22*a,b* and hence preventing the transmitted signal from reaching the receiver (thus, those of skill in the art sometimes use the term "deenergizing the island circuit" to refer to the absence of a signal at the receiver). The transmitted signal for the island circuit is typically at a different frequency than the crossing predictor circuit. By locating the physical connections of the transmitter 43 and receiver 44 to the rails 22*a,b* on opposite sides of the road 20, the island track circuit can share the same physical connections (e.g., by using a mixer to combine the signals transmitted by the transmitter 43 of the crossing predictor 40 and the signal transmitted by the island circuit transmitter, and using filters tuned to those respective frequencies at the receiver 44 for the crossing predictor 40 and the receiver for the island circuit), thereby reducing both installation and maintenance costs.

Figure 2:
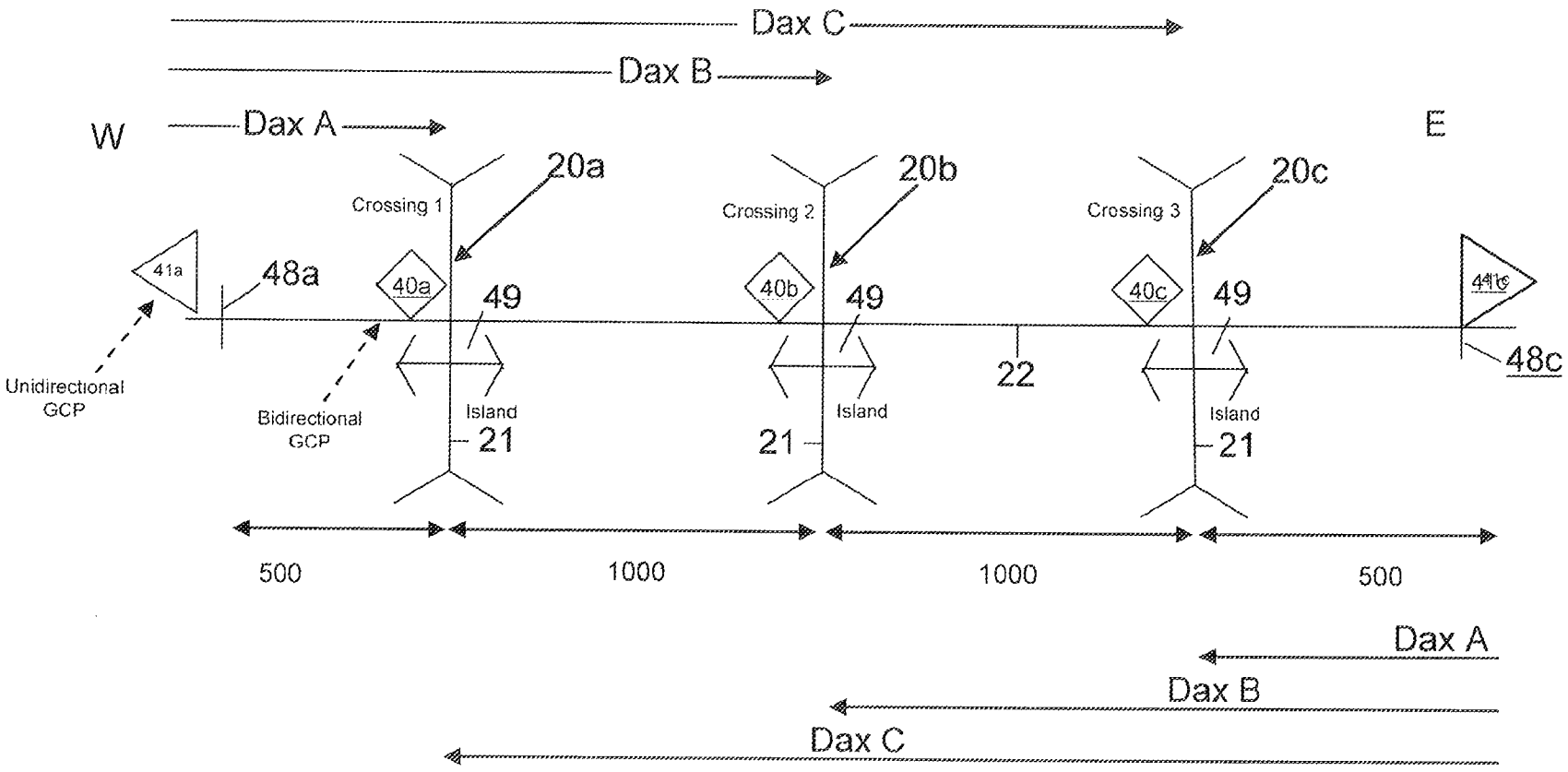
FIG. 2 is a schematic diagram showing a first DAXing installation employing insulated track joints.

FIG. 2 illustrates a conventional installation illustrating the use of insulated track joints 48 for a plurality of crossings 20*a-c* in which a road 211*a-c* crosses a track 22*a-c*. A crossing predictor 40 is placed at each of the crossings 20. Each crossing predictor 40 is configured to control a respective warning device (not shown in FIG. 2) at each of the crossings 20. Each crossing predictor 40 includes a transmitter connected to the rails of the track 22, and a pair of shunts (not shown in FIG. 2) are installed along the track on either side of the crossing 20 at approach distances that overlap shunts from neighboring crossing predictors 40. Each crossing predictor 40 also has associated therewith a respective island circuit 49 of the type discussed above in connection with FIG. 1.

Each of the crossing predictors 40 at the crossings 20 are bidirectional crossing predictors that transmit a signal outward along the track 22 in both directions. As discussed above, these bidirectional crossing predictors 40 are not capable of determining the direction of travel of a detected train. Also shown in FIG. 2 are two unidirectional crossing predictors 41, each of which is located on a side of an insulated joint 48 opposite a nearest bidirectional crossing predictor 40. The unidirectional predictors 41 are unidirectional in the sense that the insulated joints 48 block transmission directed toward the neighboring bidirectional crossing predictors 40; thus, the unidirectional predictors 41 can only detect trains on one side of the insulated joints 48 (as discussed above, the transmitter and receiver for such crossing predictors may be connected to the rails of the track 22 at or near the same location adjacent the insulated track joint 48). The unidirectional crossing predictor 41*a* is configured to DAX bidirectional crossing predictors 40*a-c* for trains west of crossing 20*a*, and the unidirectional predictor 41*c* is configured to DAX bidirectional predictors 40*a-c* for trains east of crossing 20*c*.

Those of skill in the art will understand that the unidirectional predictors 41*a,c* will be programmed with information regarding the distance between the unidirectional predictors 41*a,c* and the downstream bidirectional predictors 40*a,c* to provide for a constant warning time (i.e., the unidirectional predictor 41*a* will DAX bidirectional predictor 40*b* prior to DAXing bidirectional predictor 40*c* because a train traveling eastbound on the track 22 will necessarily reach crossing 20*a* before it reaches crossing 20*b*).

Those of skill in the art will further understand that each crossing predictor is provided with an input, sometimes referred to as a UAX (Upstream Adjacent Crossing) input, which will accept a DAX signal from an upstream adjacent crossing and, upon receipt of the signal, activate its associated warning device. Failsafe principles dictate that the absence of the DAX signal on the UAX input be interpreted as an indication to sound the warning device. In some embodiments, the UAX input is used as a control signal for a relay configured to activate the warning device when no signal is present on the UAX input. Accordingly, those of skill in the art sometimes refer to "deenergizing the UAX input" to indicate activation of the warning device.

It should be further understood that each predictor 40 will also be provided, in addition to the UAX input, with a second input for accepting a signal from another crossing predictor that indicates that the other crossing predictor has detected the presence of a train. This second input is used by the control unit 44*a* to determine when to suppress the transmission of DAX signals from the crossing predictor, such as when the train is traveling in the 'wrong' direction (i.e., the train is heading in an upstream rather than downstream). In some embodiments, the transmission of DAX signals is controlled by what is known in the art as a stick relay or stick logic. When the stick relay is set (or energized), the transmission of DAX signals from the predictor is suppressed (thus, the signal from the other predictor must be present at the input so that the relay is energized and DAXing is suppressed).

Referring now back to FIG. 2, and assuming that the desired approach distances are such that each of the crossings 20*a-c* overlap each other (i.e., the approach distance for crossing 20*a* extends beyond crossing 20*c* and vice versa), normally three distinct frequencies capable of achieving the desired approach distances would be required. Exemplary frequencies and approach lengths are set forth in Table 1 below. For the purposes of this example, it is assumed that the frequencies in Table 1 are the only available frequencies.

TABLE 1

| Operating Frequency | Bidirectional approach length (feet) 4 Ohms/1000 feet Min | Max |
|---|---|---|
| 86 Hz | 1000 | 7950 |
| 211 Hz | 600 | 5550 |
| 525 Hz | 400 | 3150 |
| 970 Hz | 400 | 2175 |

Referring now to Table 1, if the desired approach length (which again is a function of desired warning time and maximum allowed train speed) is 4500 feet and the crossings 20*a-c* in FIG. 2 are each separated by 1,000 feet, there is a problem because only two unique frequencies in Table 1 are capable of supporting the desired approach length but three bidirectional crossing predictors 40*a-c* are within 2000 feet of each other (and thus would interfere with each other if transmitting the same frequencies). However, using the insulated track joints 48 and the remote unidirectional predictors 41*a* and *c* solves this problem. If the track joints 48*a,c* are placed 500 feet from crossings 20*a,c*, respectively, then there is no shortage of unique frequencies. For example, both of the unidirectional crossing predictors 41*a,c* may be configured to transmit at 86 Hz (there is no possibility of any interference with each other due to the presence of insulated track joints 48), bidirectional crossing predictor 40*a* may be configured to transmit at 525 Hz (the 3150 maximum range is long enough sense trains to the west between crossing 20*a* and insulated joint 48*a*, and is long enough to sense trains to the east between the crossing 20*a* and the insulated joint 48*c*), the crossing predictor 40*b* may be configured to transmit at 970 Hz (the 2175 maximum range is long enough to sense trains between either side of the crossing 20*b* and the insulated track joints 48*a* and 48*c*), and the crossing predictor 40*c* may be configured to transmit at 211 Hz (which provides a maximum length sufficient to sense trains between crossing 20*c* and insulated joints 48*a* and 48*c*).

A fuller range of typical frequencies is illustrated in Table 2 below:

TABLE 2

| 4000 GCP Operating Frequency | Bidirectional Approach 2 Ohms/ 1,000 Feet Distributed Ballast | | 4 Ohms/ 1,000 Feet Distributed Ballast | | 6 Ohms/ 1,000 Feet Distributed Ballast | |
|---|---|---|---|---|---|---|
| (Hz) | Min. | Max. | Min. | Max. | Min. | Max. |
| 86 | 1,000 | 5,350 | 1,000 | 7,950 | 1,000 | 9,280 |
| 114 | 750 | 4,525 | 750 | 6,450 | 750 | 7,448 |
| 156 | 600 | 3,925 | 600 | 5,550 | 600 | 6,349 |
| 211 | 475 | 3,350 | 475 | 4,800 | 475 | 5,494 |
| 285 | 400 | 2,950 | 400 | 4,225 | 400 | 4,762 |
| 348 | 400 | 2,625 | 400 | 3,675 | 400 | 4,151 |
| 430 | 400 | 2,300 | 400 | 3,350 | 400 | 3,785 |
| 525 | 400 | 2,150 | 400 | 3,150 | 400 | 3,641 |
| 645 | 400 | 1,950 | 400 | 2,800 | 400 | 3,175 |
| 790 | 400 | 1,725 | 400 | 2,475 | 400 | 2,808 |
| 970 | 400 | 1,550 | 400 | 2,175 | 400 | 2,472 |

In Table 2, frequencies of 970 Hz or less are typically used for crossing predictor circuits, whereas all of the frequencies in Table 2 are commonly used for PSO circuits (discussed in further detail below).

Figure 3:
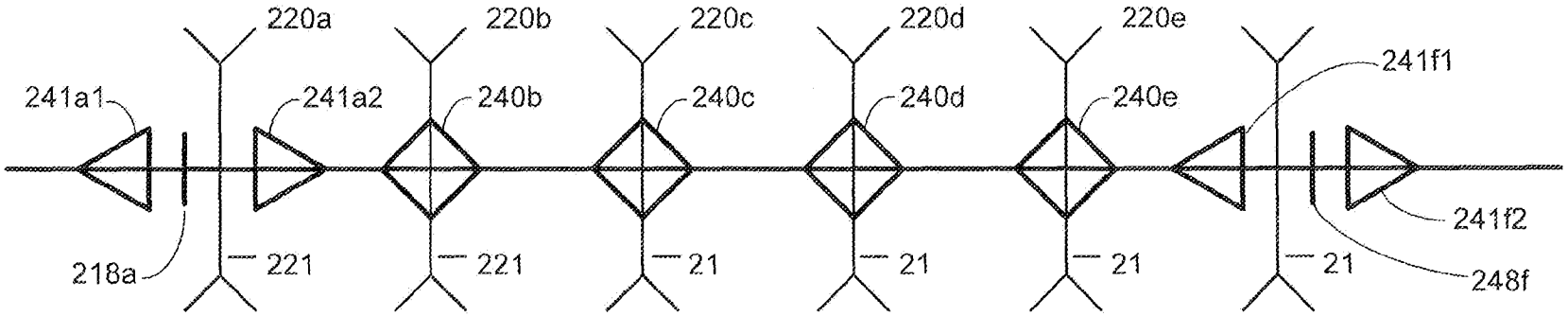
FIG. 3 is a schematic diagram showing a second DAXing installation employing insulated track joints.

A second conventional installation employing insulated track joints is illustrated in FIG. 3. In this installation, the insulated track joints are placed at the outside crossings 220*a* and *f* rather than being placed apart from the crossings as in FIG. 2. The configuration of FIG. 3 might be found in a dense urban area in which many crossings are located in close proximity to each other. In this configuration, a unidirectional crossing predictor 241*a*1, 241*f*2 is placed outside each of the insulated track joints 248*a*, 248*f*. Distinct frequencies are chosen for each of the interior unidirectional crossing predictors 241*a*2 and 241*f*1 and interior bidirectional crossing predictors 240*b-e*. The outer unidirectional predictors 241*a*1 and 241*f*2 are configured to DAX each of the crossing predictors 241*b-e* in the downstream direction.

As discussed above, a drawback of each of the configurations in FIGS. 2 and 3 is the use of insulated track joints to provide unidirectional crossing predictors. As discussed above, the use of these joints increases installation and maintenance costs. Accordingly, discussed below are methods and devices that provide for DAXing without the need for insulated track joints.

Figure 4:
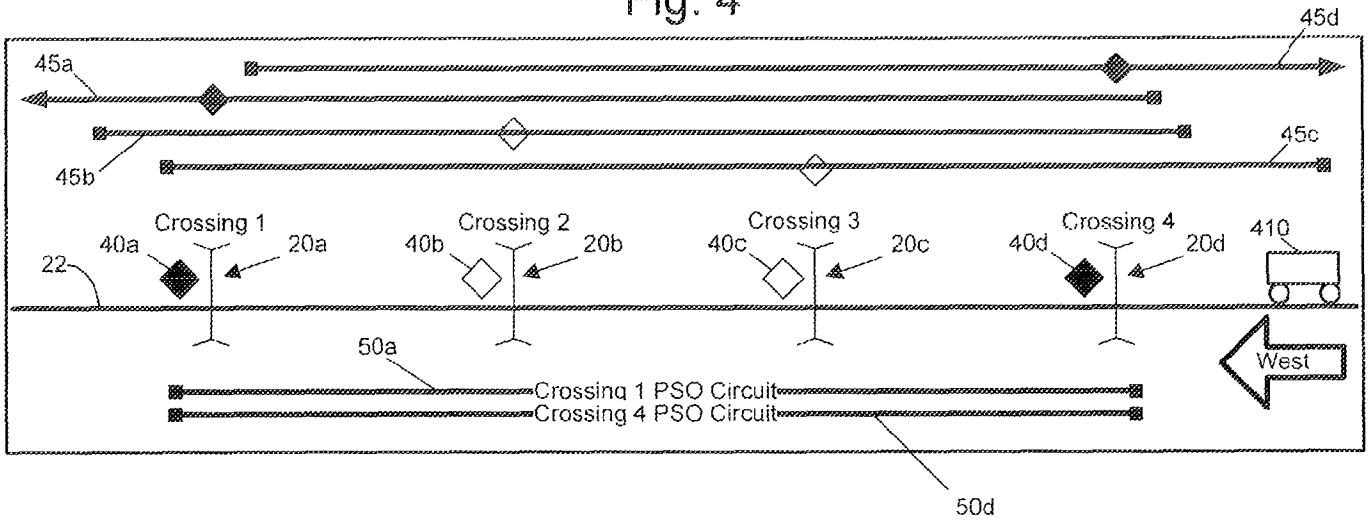
FIG. 4 is a schematic diagram showing a DAXing installation employing rail based communications and bidirectional crossing predictors without the use of insulated track joints, and a train at an approach position.

FIG. 4 illustrates a configuration in which outer bidirectional crossing predictors DAX inner downstream predictors and in which communications between the outer predictors are utilized to allow the outer predictors to communicate with each other. These communications may be via a vital radio link, via a separate wired connection (e.g., a buried line wire connection) or via the rails themselves. Because the approaches of the outer bidirectional crossing predictors overlap in the particular example shown in FIG. 4, a first outer crossing predictor can determine on which side of the first predictor an approaching train is located by communicating with a second outer predictor to determine whether or not the second outer predictor has detected an approaching (with respect to the first outer predictor) train. If the second outer predictor has not detected the train, the first outer predictor determines that the train is on the side opposite the second outer predictor and DAXes downstream predictors accordingly. If, on the other hand, the second outer predictor has seen the oncoming train, the first outer predictor determines that the train is approaching on the same side of the crossing as the second outer predictor and refrains from DAXing other predictors.

FIG. 4 illustrates a track 22 with four crossings 20*a-d*. A bidirectional crossing predictor 40*a-d* of the type illustrated in FIG. 1 is installed at each respective crossing 20*a-d*. In the embodiment of FIG. 4, the paired outer crossing predictors 40*a* and 40*d* (which are referred to as paired because they are in communication with each other as will be described in further detail below) are configured to DAX predictors 40*b* and 40*c*. In addition to including the functionality discussed in connection with FIG. 1 above, each of the outer predictors 40*a* and 40*d* also include the UAX input and the second input for accepting a signal from adjacent crossing predictor indicating that the adjacent crossing predictor has detected a train as discussed above. Moreover, outer crossing predictors 40*a* and 40*d* each also include two timers: an approach clear timer and a stick release timer. Both of these timers are used to clear the stick relay at one crossing predictor to reenable the transmission of DAX signals to other crossing predictors.

The approach clear timer becomes active, but does not start to run, when the control unit (44*a* in FIG. 1) has detected an EZ level below the EZ approach clear level (signifying that a train is in the approach) and has set the stick relay. The control unit 44*a* will start the approach clear timer when an EZ level equal to or greater than the EZ approach clear level is detected and no train motion is being detected. The EZ approach clear level is set at 80 unless the approach for the predictor extends through the island of the other paired crossing predictor, in which case the EZ approach clear level will be set to a level corresponding to the EZ level that would be seen for a train located at the position of the furthest track wires (the wires connecting the receiver or transmitter to the track). The approach clear timer is typically programmed to time out at a time equal to the time required for a train traveling at the maximum posted track speed to travel from the approach clear EZ point (i.e., the point in the approach at which a train is expected to result in the EZ approach clear level) to the far side of the island of the other crossing predictor associated with the pair). Thus, under normal conditions with a train traveling at posted track speed, the approach clear timer will start to count down when the train has become clear of the crossing predictor's approach and will time out when train crosses the island of the other crossing predictor in the pair. If the train is traveling slowly or stops prior to reaching the other island, the approach clear timer will time out earlier, thereby reenabling DAXing from the crossing predictor. The approach clear timer will be deactivated if the stick release timer times out.

The stick release timer is a fallback safety measure that clears the stick at a predictor when a maximum allowable time (typically 10-15 minutes) has passed so as to prevent the suppression of DAXing signals for extended periods of time due to an unexpected train movement or an equipment failure. The control unit is configured to start the stick release timer when stick relay is set and when no train motion is predicted. The control unit will freeze the stick release timer if a train is occupying the island and whenever train motion is detected, and will deactivate the stick release timer if the approach clear timer times out.

An island circuit (not shown in FIG. 4) is also installed at each of the crossings 20*a-d*. Shown above each of the crossings 20*a-d* are schematic lines 45*a-d* illustrating the approach lengths of respective bidirectional predictors 40*a-d*. The diamond symbol on each approach line 45*a-d* indicates the position of the crossing predictor 40*a-d* to which it pertains, and an arrow at the end of one of the schematic lines 45*a-d* indicates that the approach extends past the arrow so that the approach has a length approximately equal to the length of the corresponding approach on the other side of the same crossing predictor.

Also shown in FIG. 4 below the crossings 20*a-d* are a pair of PSO circuits 50*a*, 50*d*. PSO circuits 50*a*, 50*d* are a type of track occupancy circuit that is similar in some respects to the island circuits discussed above in connection with FIG. 1. Although the ends (i.e., the physical connections of the receiver and transmitter to the rails of the track) of the PSO circuits 50*a*, 50*d* are shown on the outside edges of crossings 20*a* and 20*d*, they may (preferably) be located at the inside edges of crossings 20*a* and 20*d*. PSO circuits include a transmitter at one end of a section of track and a receiver at an opposite end of the section of track. The PSO circuit may be used for monitoring occupancy of the track section. However, as disclosed in U.S. Prov. Pat. App. No. 61/226,416, entitled "Track Circuit Communications" (the entire content of which is hereby incorporated by reference herein), these circuits transmit an AC signal with a code and may be used to convey information, which is the type used in FIG. 4. In FIG. 4, the transmitter for a first PSO circuit 50*a* is connect to predictor 40*a* and the receiver for the first PSO circuit 50*a* is connected to predictor 40*d*, whereas the transmitter for the second PSO circuit 50*d* is connected to predictor 50*d* and the receiver for the second PSO circuit 50*d* is connected to predictor 50*a*. By controlling the codes transmitted by the PSO transmitter to which it is connected, one crossing predictor can alert the other of a detected train.

The processing performed by the various predictors 40*a-d* will be discussed in connection with FIGS. 4-8, which illustrate a train 410 as it moves westward past each of the crossings 20*a-d*. Prior to the arrival of the train 410 in the approach 45*d* to crossing 20*d*, both PSO circuits 50*a, d* are controlled by their respective predictors 40*a, d* to transmit a code A, which is used in this example to signify that no train has been detected. When train 410 enters the approach 45*d* for predictor 40*d*, predictor 40*d* determines that the train is inbound and checks the code being transmitted on PSO circuit 50*a* under the control of predictor 40*a*. Because this code is A, predictor 40*d* determines that predictor 40*a* has not yet detected the train 410 and therefore the train 410 must be to the east of crossing 20*d*.

Crossing predictor 40*d* controls the transmitter for PSO circuit 50*d* to transmit code C when the train is at a location close to the beginning of the approach 45*a* for crossing predictor 40*a*. The approach (i.e., the shunt) for crossing predictor 40*a* is located just to the outside of the crossing 20*d*. Code C on PSO circuit 50*d* is an indication to predictor 40*a* that predictor 40*d* has detected a train in its outer approach and that predictor 40*a* should not generate and send DAX signals for this train to predictors 40*b* and 40*c*. When crossing predictor 40*a* senses the code C on PSO circuit 50*d*, crossing predictor 40*a* sets its internal stick relay to disable the generation of DAXing signals.

Independently and in addition to generation of the code C signal to prevent crossing predictor 40*a* from generating DAXing signals, crossing predictor 40*d* also calculates constant warning time predictions for its own adjacent warning device at crossing 20*d* and for DAXing crossing predictors 20*c* and 20*b* if necessary based on the speed of the train 410. The DAXing signals may be communicated to the crossing predictors 20*b* and 20*c* using separate wire conductors or radio links, or may be communicated using additional PSO circuits (not shown in FIG. 4) transmitting on different frequencies.

Figure 5:
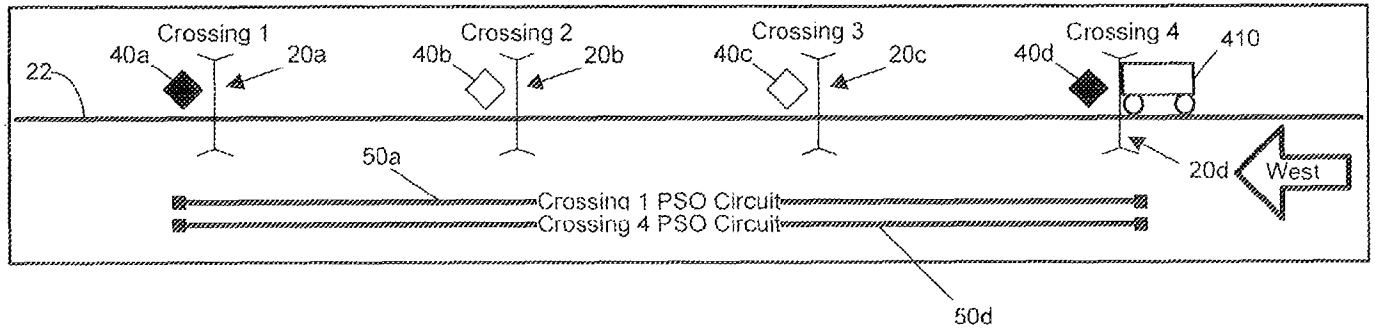
FIG. 5 shows the DAXing installation of FIG. 4 with the train at a second position.

As shown in FIG. 5, when the train 410 reaches the island circuit at crossing 20*d*, the island circuit deenergizes (as discussed above, this is due to the train's wheels and axles creating a short across the rails between the receiver and transmitter of the island circuit). Next, the head of the train moves past the island and causes the two PSO circuits 50*a*, 50*d* to deenergize. When crossing predictor 40*a* detects deenergization of the PSO circuit 50*d*, it sets its stick and starts its stick release timer. When the crossing predictor 40*d* detects deenergization of the PSO circuit 50*a*, it sets its own stick relay to prevent DAXing of crossing predictors 40*c*, 40*b* and 40*a* in the event that the train 410 were to subsequently reverse direction and head back toward crossing 20*d* (it should be noted that setting the stick at this point only prevents crossing predictor 40*d* from DAXing with respect to new inbound train moves and does not prevent crossing predictor 20*d* from generating DAXing signals for predictors 40*b* and 40*c* as the train passes the crossing 20*d* even if the speed of the train is such that it does not reach the point at which the DAX signal must be transmitted until after it is past the crossing 20*d*). Crossing predictor 40*d* controls PSO circuit 50*d* to transmit code A and also starts its stick release timer upon detecting deenergization of PSO circuit 20*a*.

Figure 6:
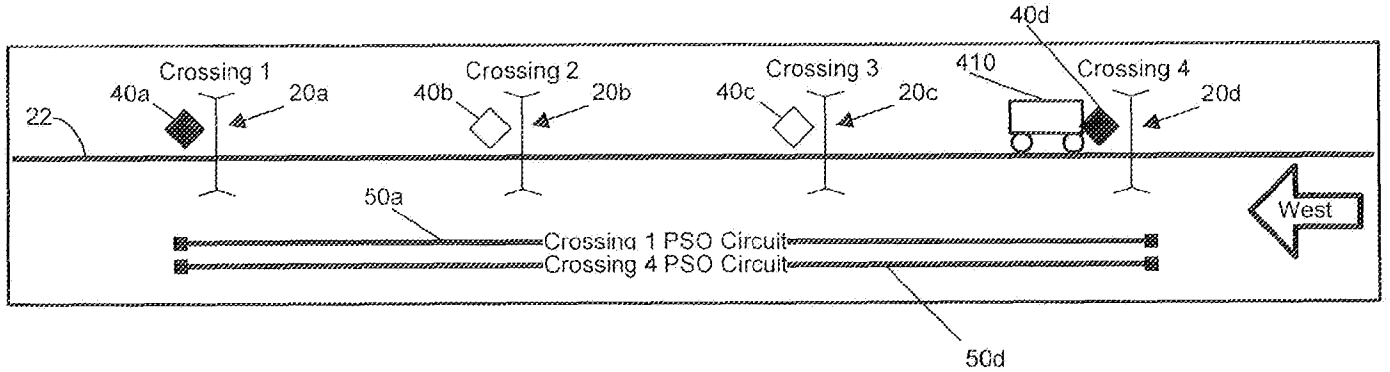
FIG. 6 shows the DAXing installation of FIG. 4 with the train at a third position.

FIG. 6 illustrates the train 410 between crossings 20*d* and 20*a*. During this period of time, both PSO circuits 50*a*, 50*d* transmit code A but remain deenergized due to the presence of trains wheels and axles between their respective transmitters and receivers. Because the train 410 continues to move, neither of the stick release timers will expire. This effectively prevents crossing predictor 40*a* from transmitting DAXing signals to crossing predictors 40*b*, 40*c* or 40*d* while the train 410 is located between crossing predictors 40*a* and 40*b* and moving toward crossing predictor 40*a*.

Figure 7:
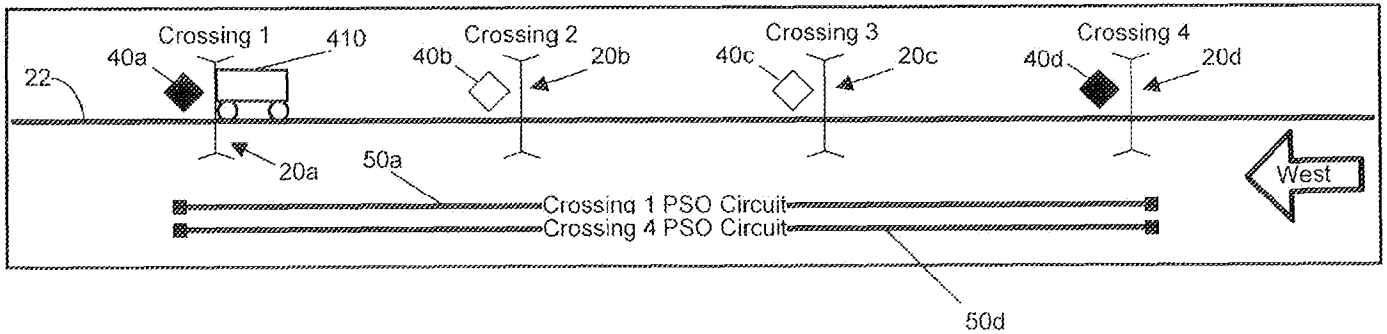
FIG. 7 shows the DAXing installation of FIG. 4 with the train at a fourth position.

Referring now to FIG. 7, the train 410 arrives at the island circuit for predictor 40*a*, at which time this island circuit deenergizes. Predictors 40*a* and 40*d* continue to control PSO circuits 50*a*, 50*d* to transmit code A. Also, because train motion is still detected, neither stick release timer or approach clear timer expires.

Figure 8:
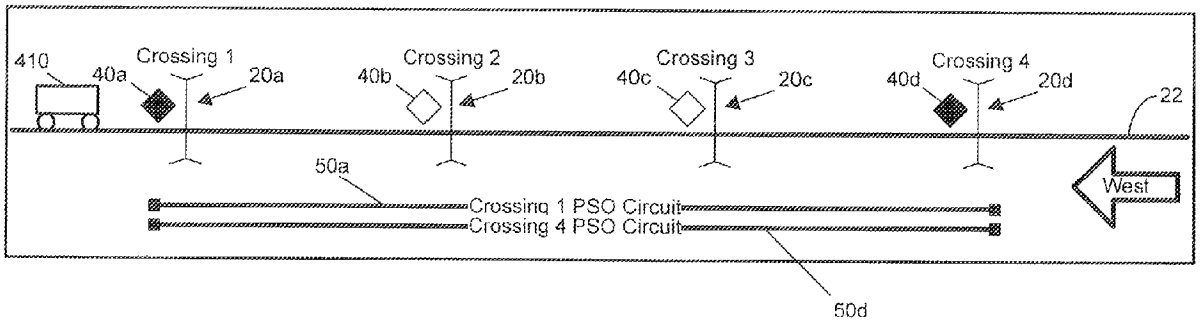
FIG. 8 shows the DAXing installation of FIG. 4 with the train at a fifth position.

Referring now to FIG. 8, train 410 is shown past the island circuit associated with crossing predictor 20*a* and continuing west. Crossing predictors 40*a* and 40*d* will clear their sticks to reenable the transmission of DAX signals when either a) their respective stick release timer or approach clear timers expire, b) when the island circuit at crossing 20*a* energizes, the crossing predictor 40*a*, 40*d* does not detect the presence of a train (the crossing predictor circuit determines that the observed impedance or voltage differs from a baseline impedance or voltage established during a calibration procedure by less than 20%), and the crossing predictor does not observe any train motion; or when the island circuit energizes, no inbound motion is detected, and the crossing predictor is receiving a valid code A from the other predictor via the PSO circuit 50 (which signifies that the train is no longer located between the predictors 40*a*, 40*d*). It should be noted that crossing predictor 40*a* will not generate any DAX signals even though train 410 is in its approach because the train's motion is outbound and therefore does not require any DAXing.

As discussed above, it is not necessary to employ PSO circuits for rail based communications between upstream and downstream crossing predictors. Rather, vital I/O links between the predictors may be employed instead. The vital I/O links may take the form of wireless links (e.g., radio, optical, etc.) or wired connections.

Figure 9:
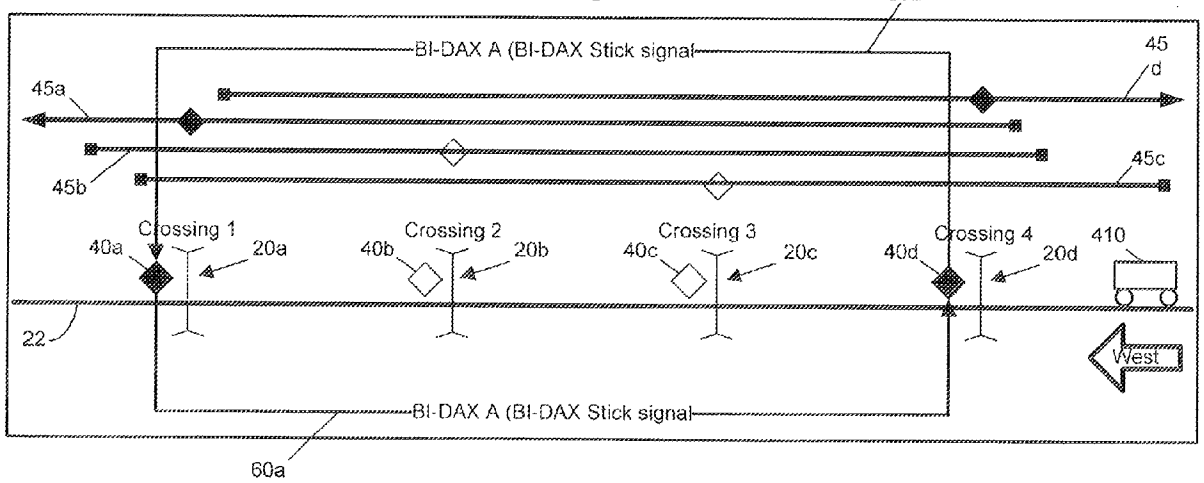
FIG. 9 shows a DAXing installation employing a pair of vital I/O links between bidirectional crossing predictors without the use of insulated track joints.

An exemplary installation using such vital I/O links is illustrated in FIG. 9. FIG. 9 is similar to FIG. 4, except that a vital I/O link 60*a* from crossing predictor 40*a* to crossing predictor 40*b* is present instead of PSO circuit 50*a*, and vital I/O link 60*d* between crossing predictor 40*d* and crossing predictor 40*a* is present instead of PSO circuit 50*d*. The vital I/O link 60*d* allows crossing predictor 40*d* to set the stick relay on crossing predictor 40*a*, thereby suppressing the transmission of DAXing signals from crossing predictor 40*a* to predictors 40*b*, 40*c* and 40*d*. The opposite is true for vital I/O link 60*a*. In embodiments in which the vital I/O links 60*a*, 60*d* are single wired conductors, the stick relay may be set simply by transmitting a positive voltage. Thus, when the train 410 is detected in the approach to crossing 20*d* by predictor 40*d*, predictor 40*d* energizes vital I/O link 60*d* (using failsafe principles, the absence of a voltage on, or denergization of, link 60*d* should be interpreted as not disabling DAXing since the absence of a signal is the failure and not disabling DAXing is the safe condition) and the stick relay at crossing predictor 40*a* is set, thereby preventing predictor 40*a* from DAXing predictors 40*b*, 40*c* and 40*d*.

Those of skill in the art will recognize that the approach arrangements shown in FIG. 9 are but two possible examples and many other configurations are possible. For example, in FIGS. 4 and 9, the approaches for predictors 40*a* and 40*d* overlap each other in at least some of the area between crossings 20*a* and 20*d*. However, installations are possible in which this may not be the case and there exists a gap between the approaches for predictors 40*a* and 40*d*. In such a scenario, the use of PSO circuits as shown in FIG. 4 allows each of the predictors to determine whether the train is present between crossings 20*a* and 20*d*. However, the use of vital I/O communications as shown in FIG. 9 would result in ambiguity in some situations in which a gap existed between the approaches for crossing predictors 40*a* and 40*d*. For example, if a train heading toward crossing 20*a* stops in such a gap and reversed course toward crossing 20*d*, the predictor 20*d* would have no way of determining from which direction such a train was approaching and therefore would incorrectly DAX predictors 40*c*, 40*b* and 40*a*.

Figure 10:
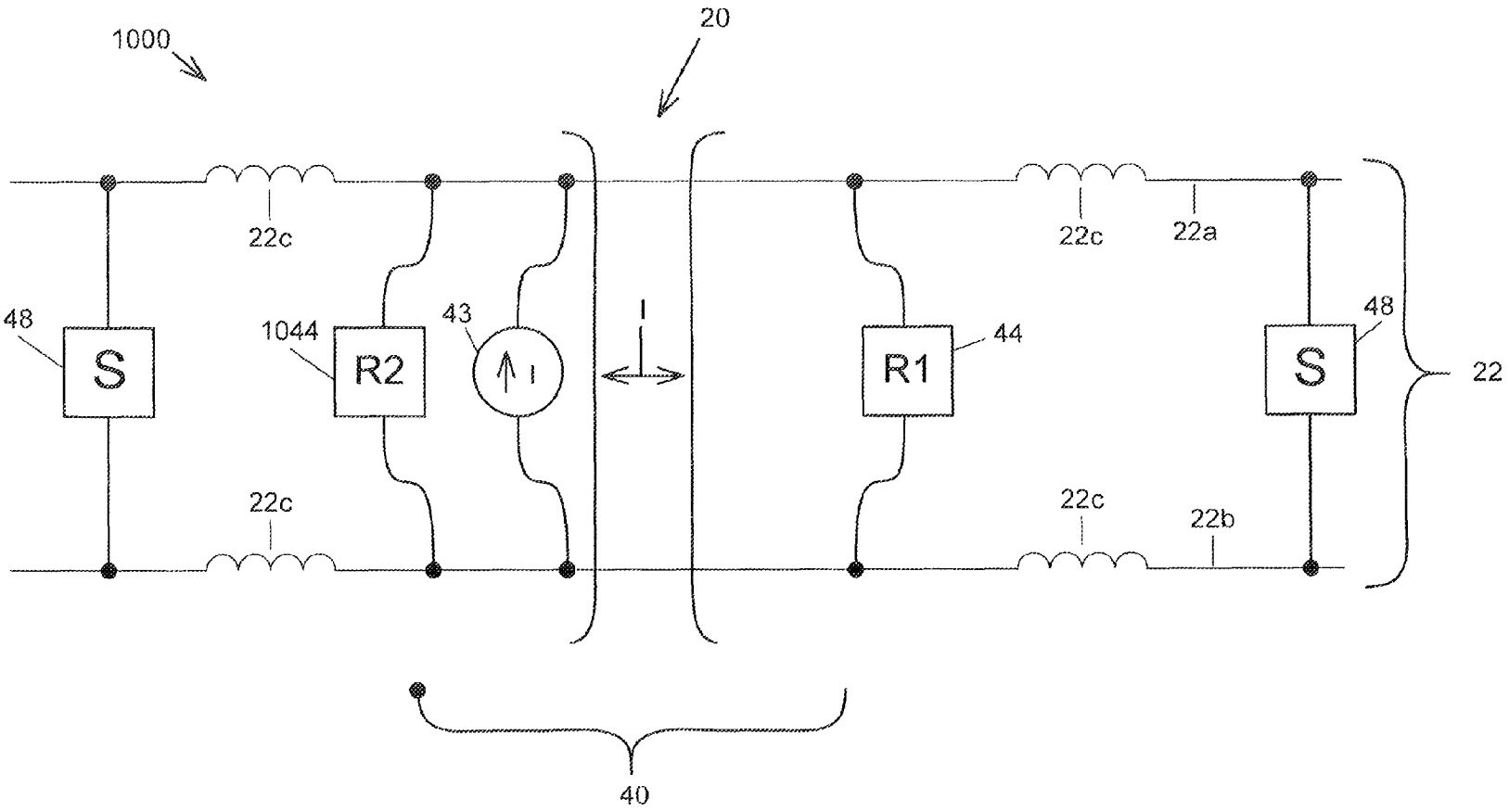
FIG. 10 is a circuit diagram of a crossing predictor circuit including a direction detection component.

Some embodiments address this situation by providing a mechanism for determining the direction of the train. An example of such a mechanism is illustrated in FIG. 10. The circuit 1000 of FIG. 10 is similar in many respects to that of FIG. 1. However, the circuit 1000 includes a second receiver 1044. The second receiver 1044 is tuned to the same frequency as the first receiver 44. However, the second receiver 1044 is connected to the rails 22*a*, 22*b* on a side of the transmitter 43 opposite the first receiver 44, and is spaced from the transmitter 43 at a distance sufficient to ensure that an inbound train traveling at a maximum speed will be detected before such a train reaches the island (in some embodiments, this distance is 100 feet). This difference in location between the first and second receivers 44, 1044 results in a difference in the EZ levels seen by the first and second receiver 44, 1044 when the train is located between the transmitter 43 and one of the receivers 44, 1044 (the EZ levels for both receivers are low, but the receiver with the train between it and the transmitter 43 has the lower EZ level). Thus, once the train reaches one of the two receivers, the crossing predictor 40 can determine on which side of the crossing 20 the train is located, thereby allowing a correct determination as to whether to DAX adjacent crossings.

In order to provide a more comprehensive understanding of the invention, operation of predictor circuits in various configurations is discussed in further detail below in connection with FIGS. 11-37.

Figure 11:
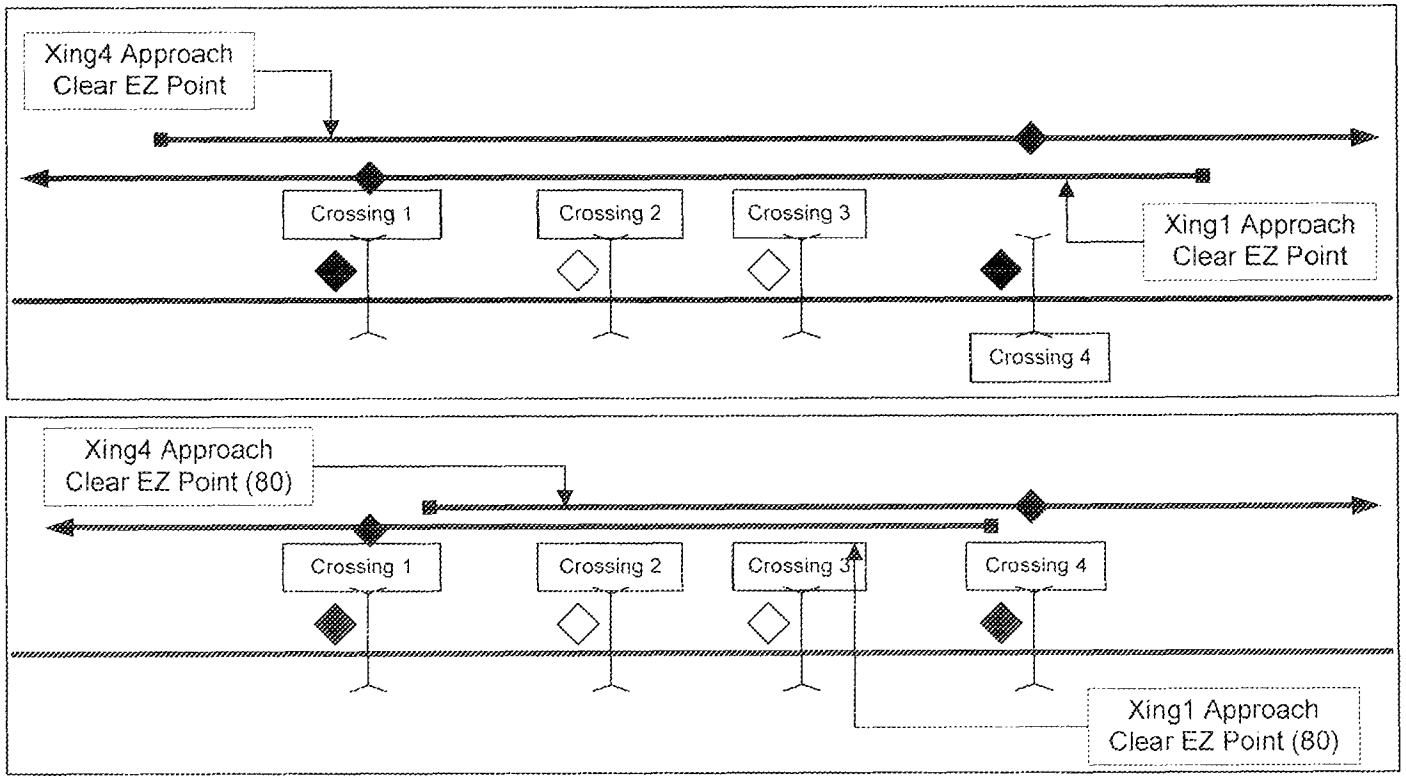
FIGS. 11-13 are schematic diagrams showing the set up of various thresholds and timers in a DAXing installation.
Figure 12:
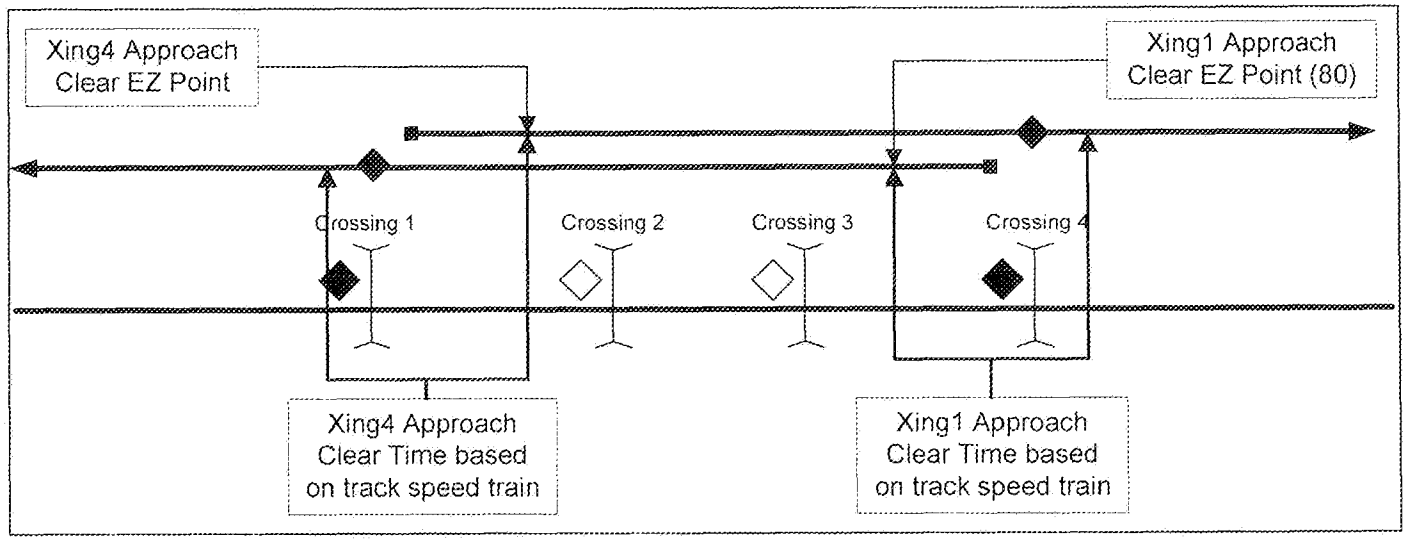
Figure 13:
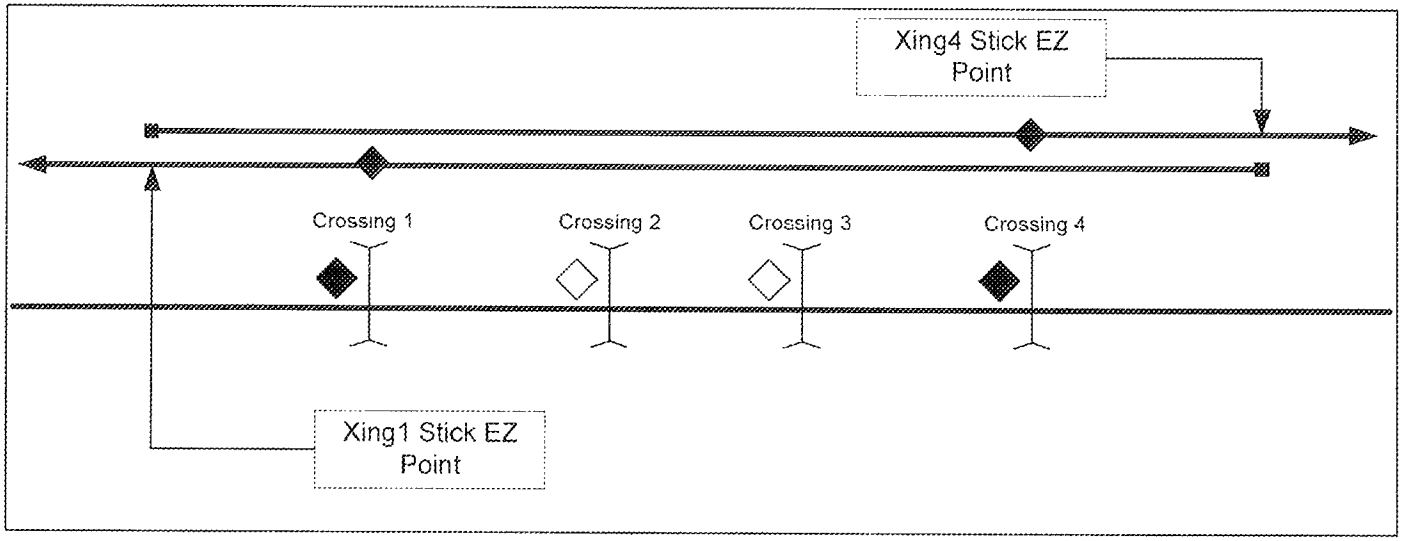
Figure 14:
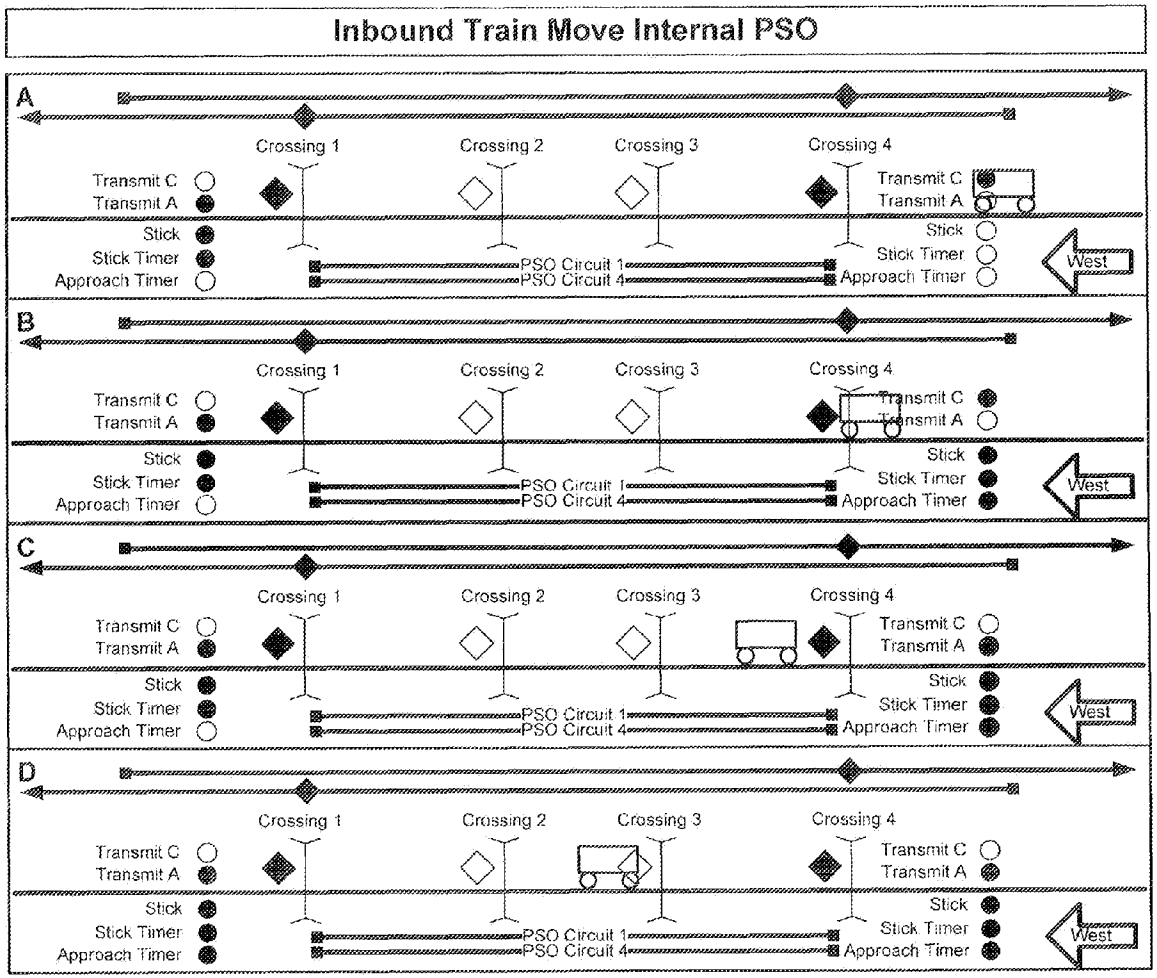
FIGS. 14-37 are sequence diagrams illustrating operation of DAXing installations under various configurations and operating conditions.
Figure 14:
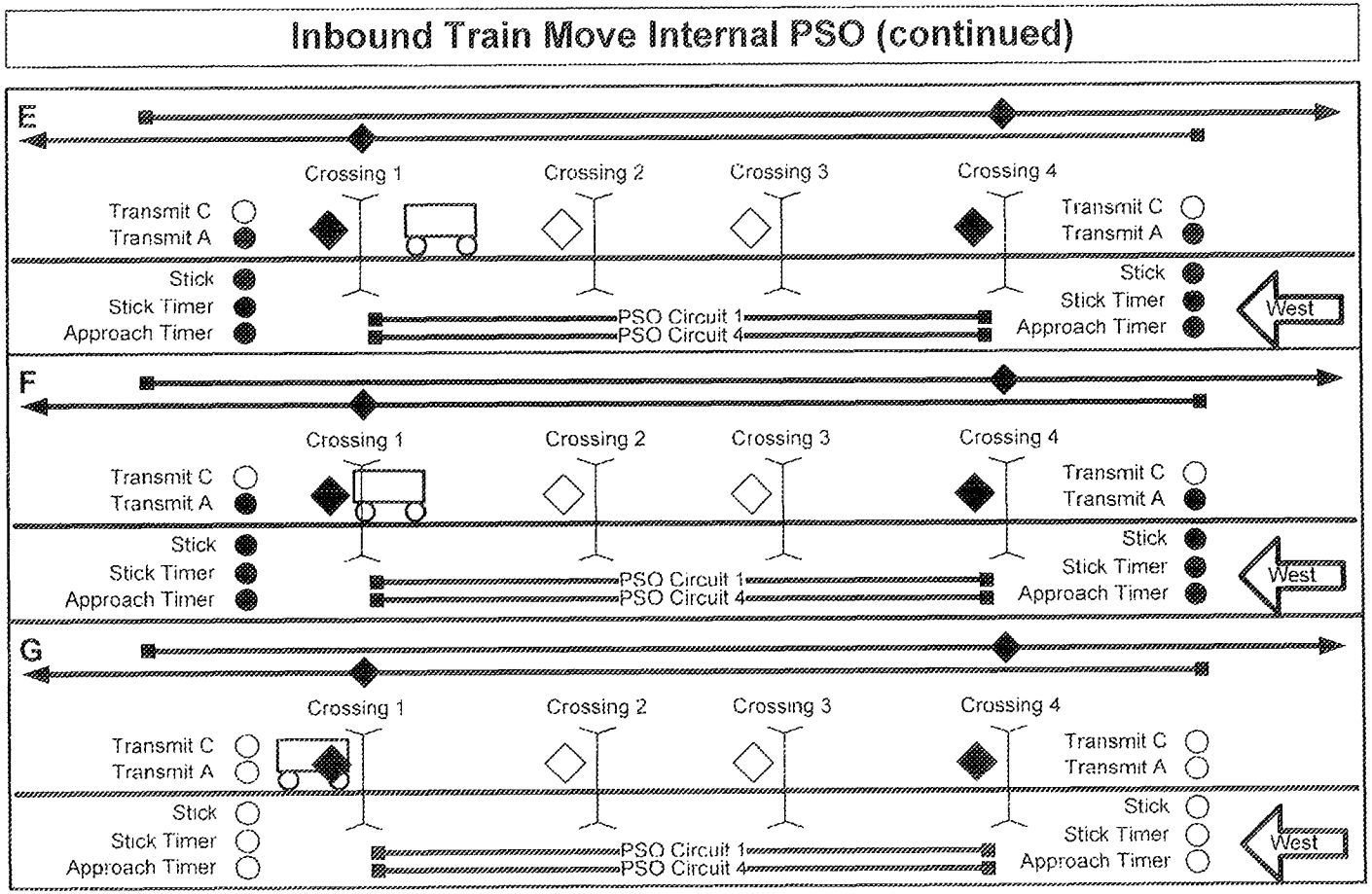
Figure 15:
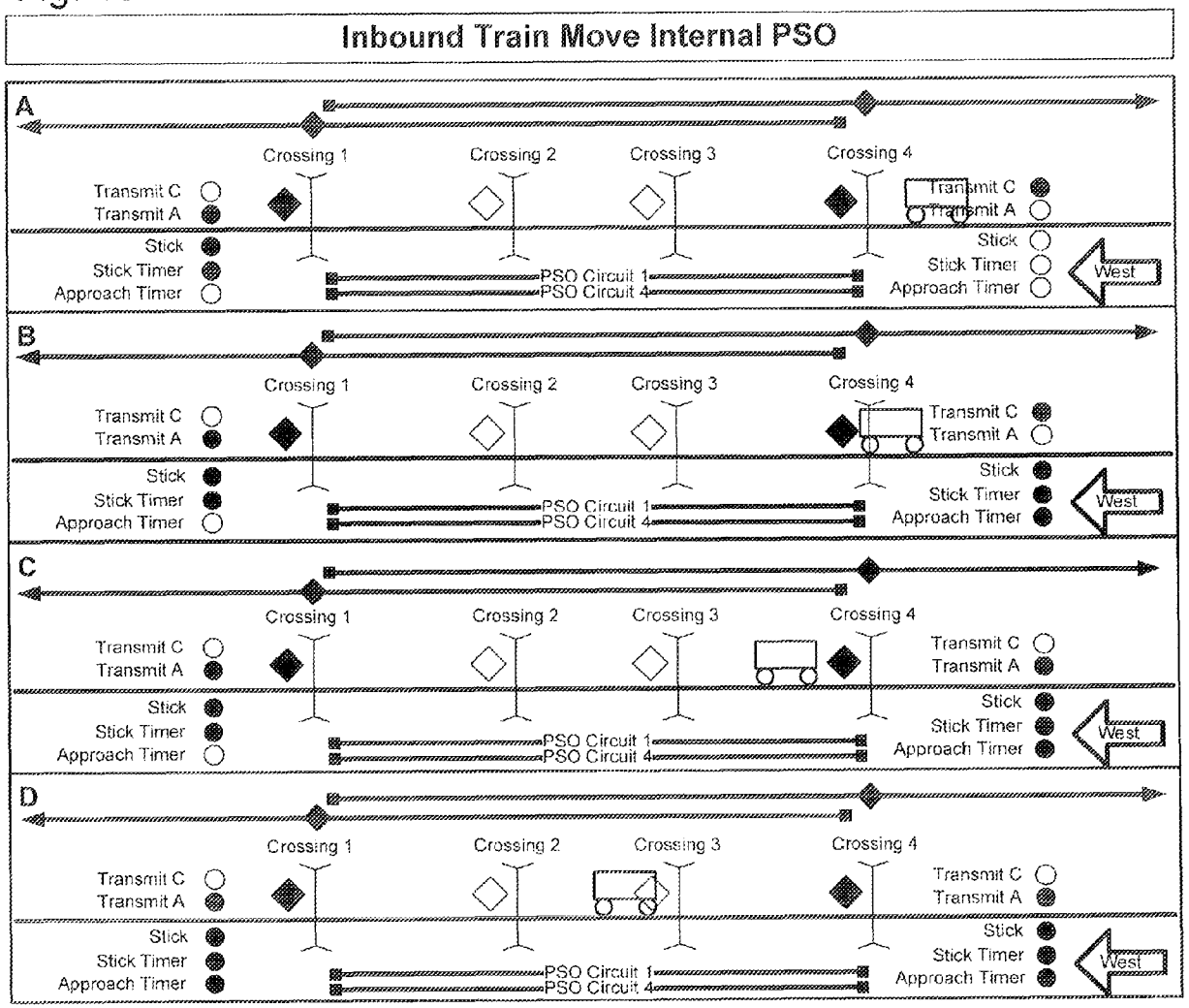
Figure 15:
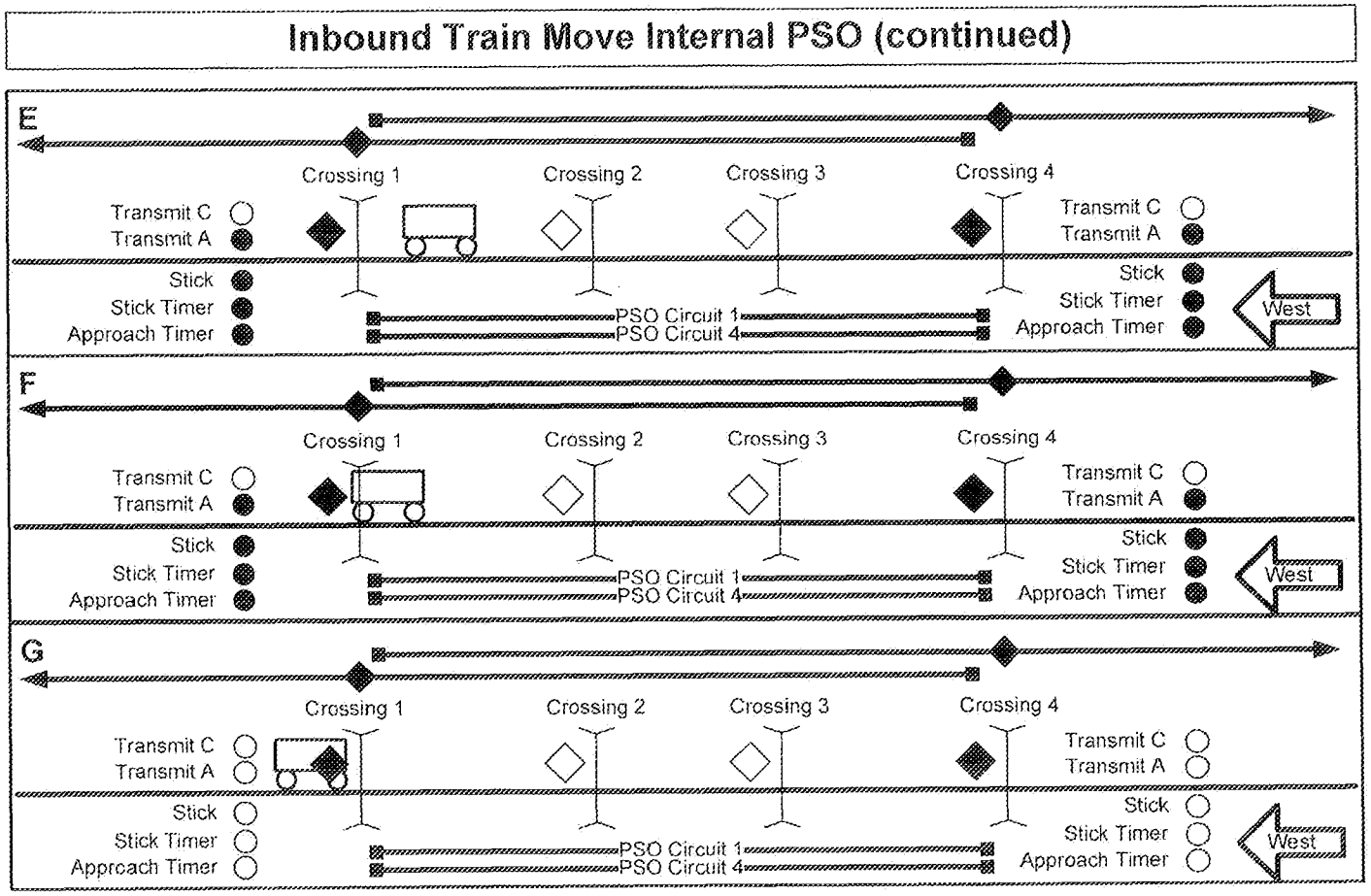
Figure 16:
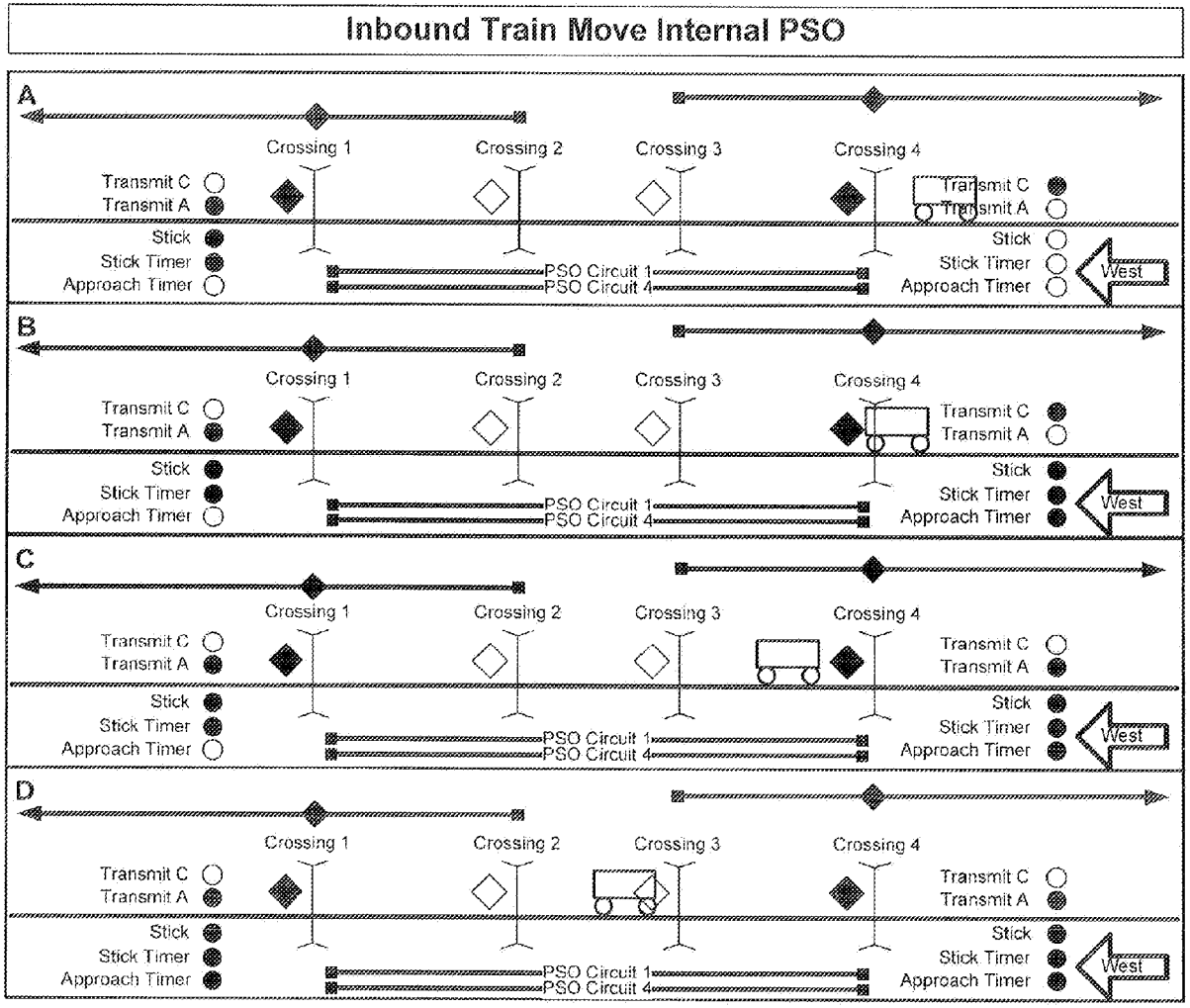
Figure 16:
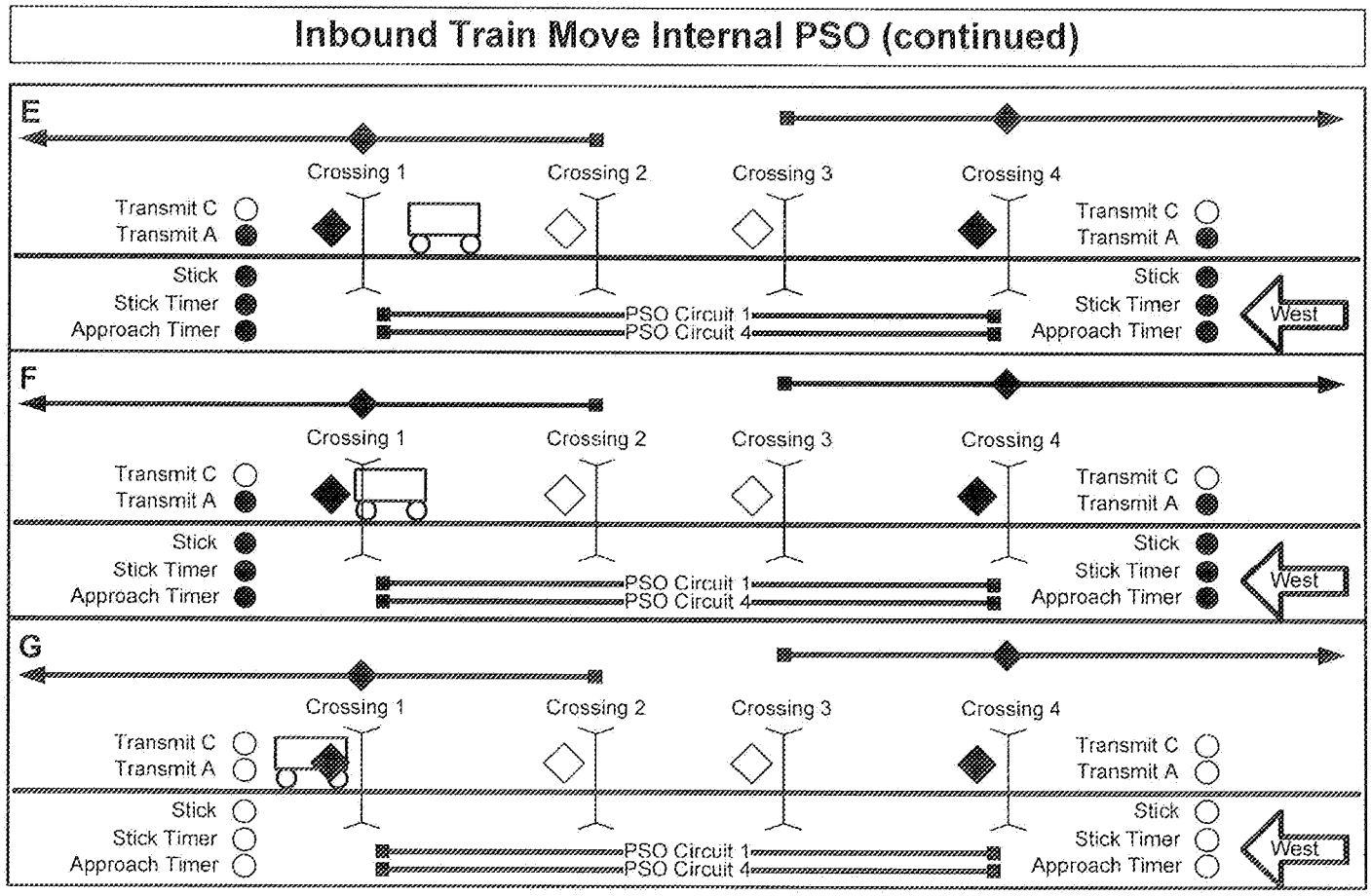
Figure 17:
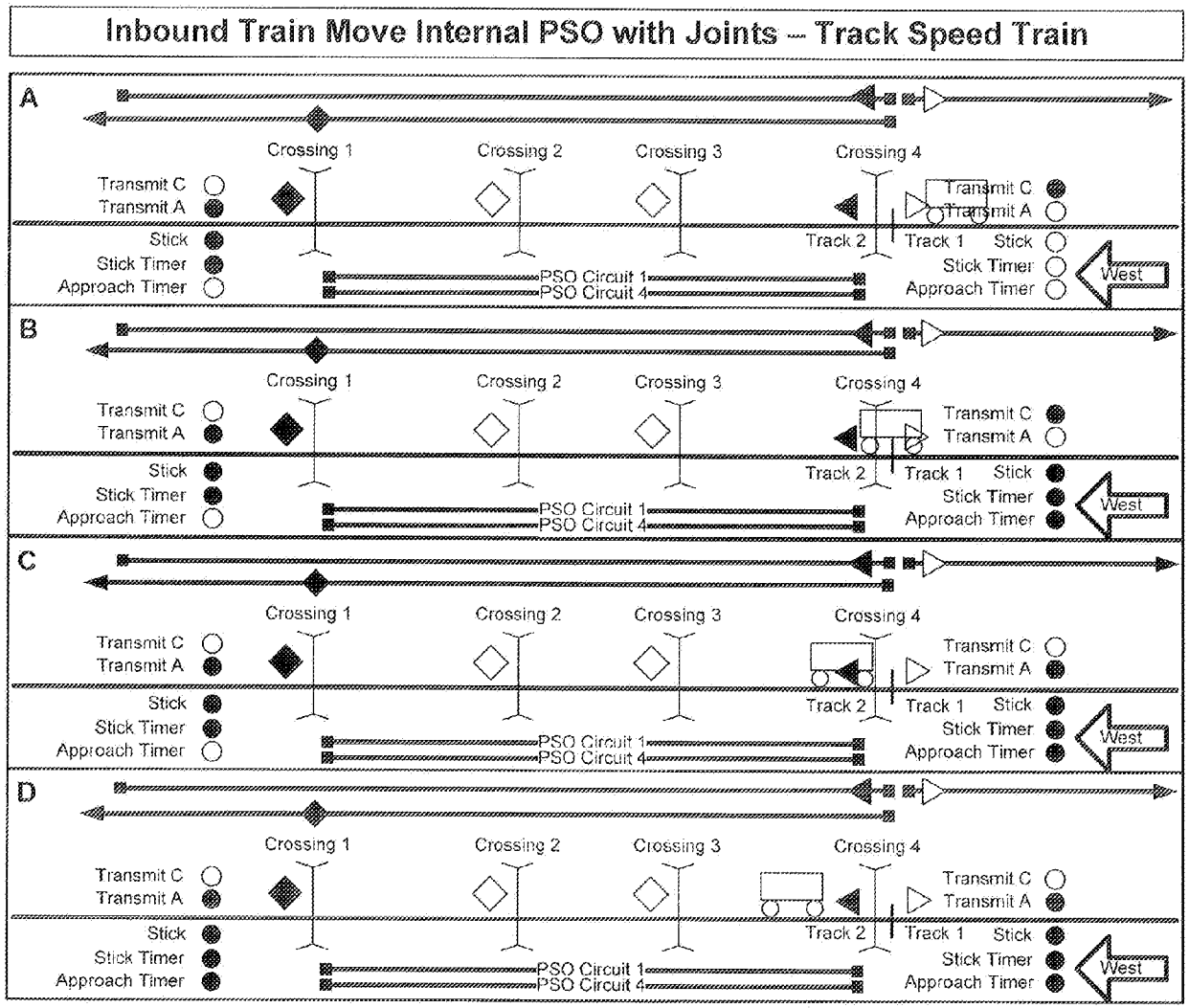
Figure 17:
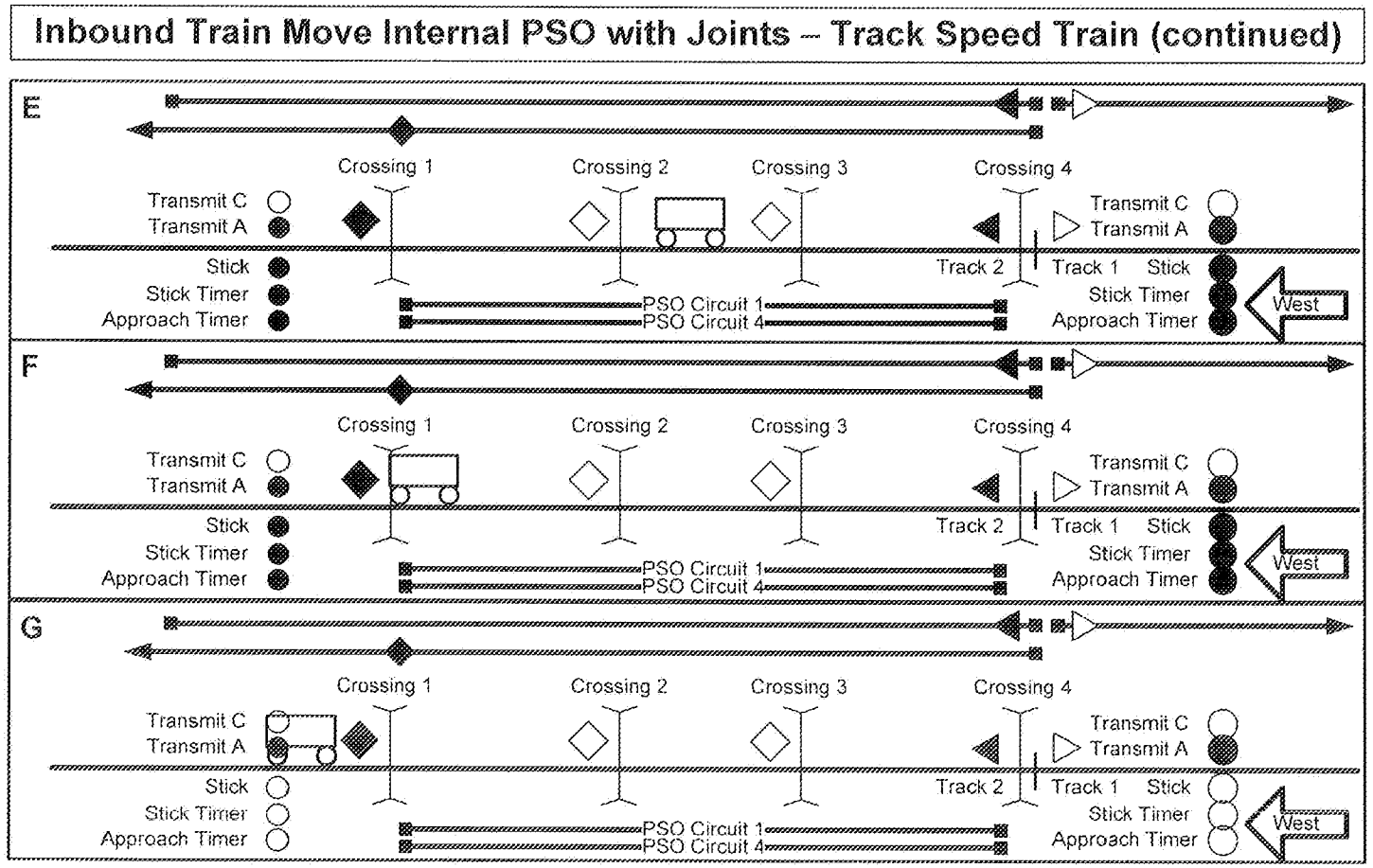
Figure 18:
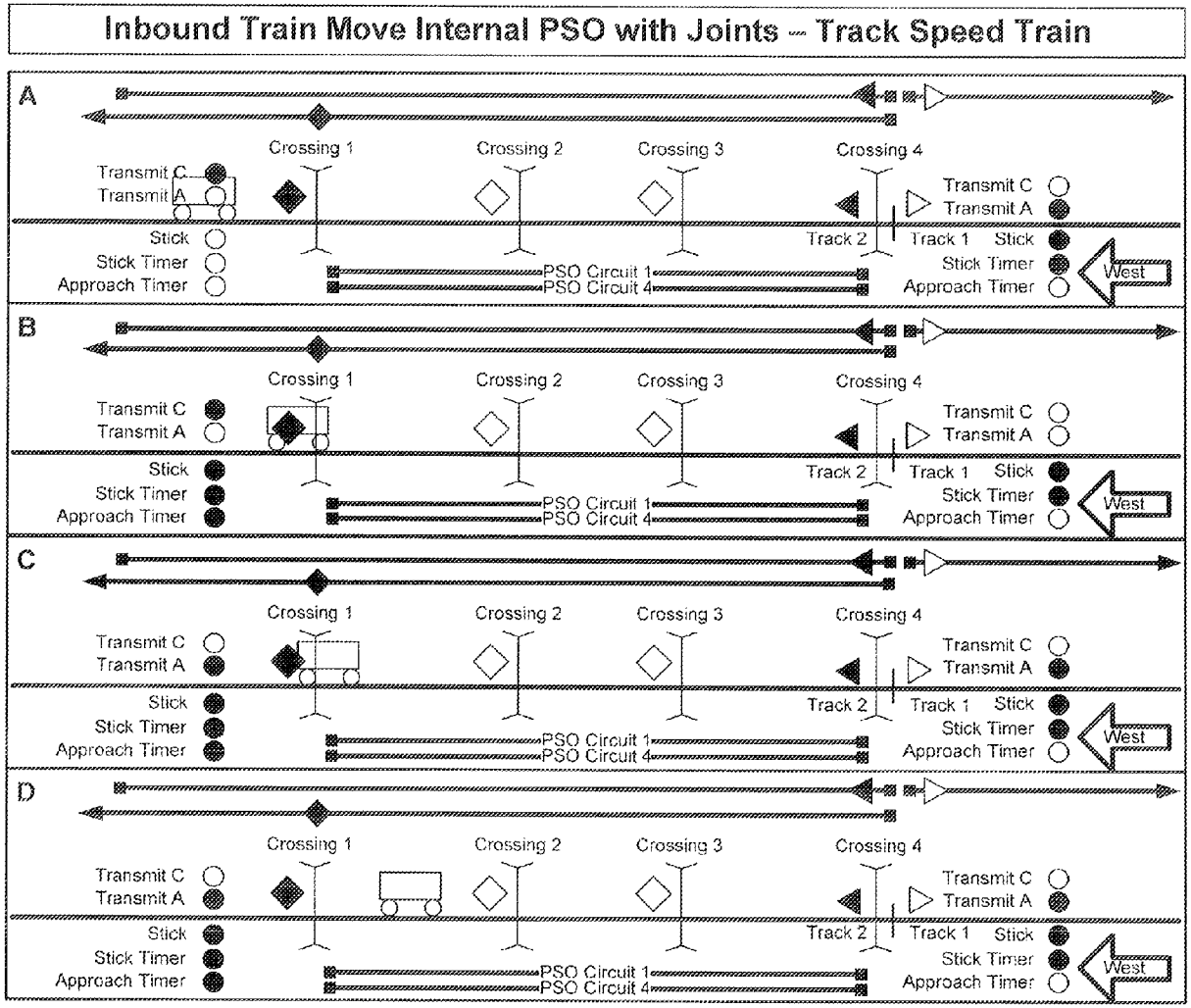
Figure 18:
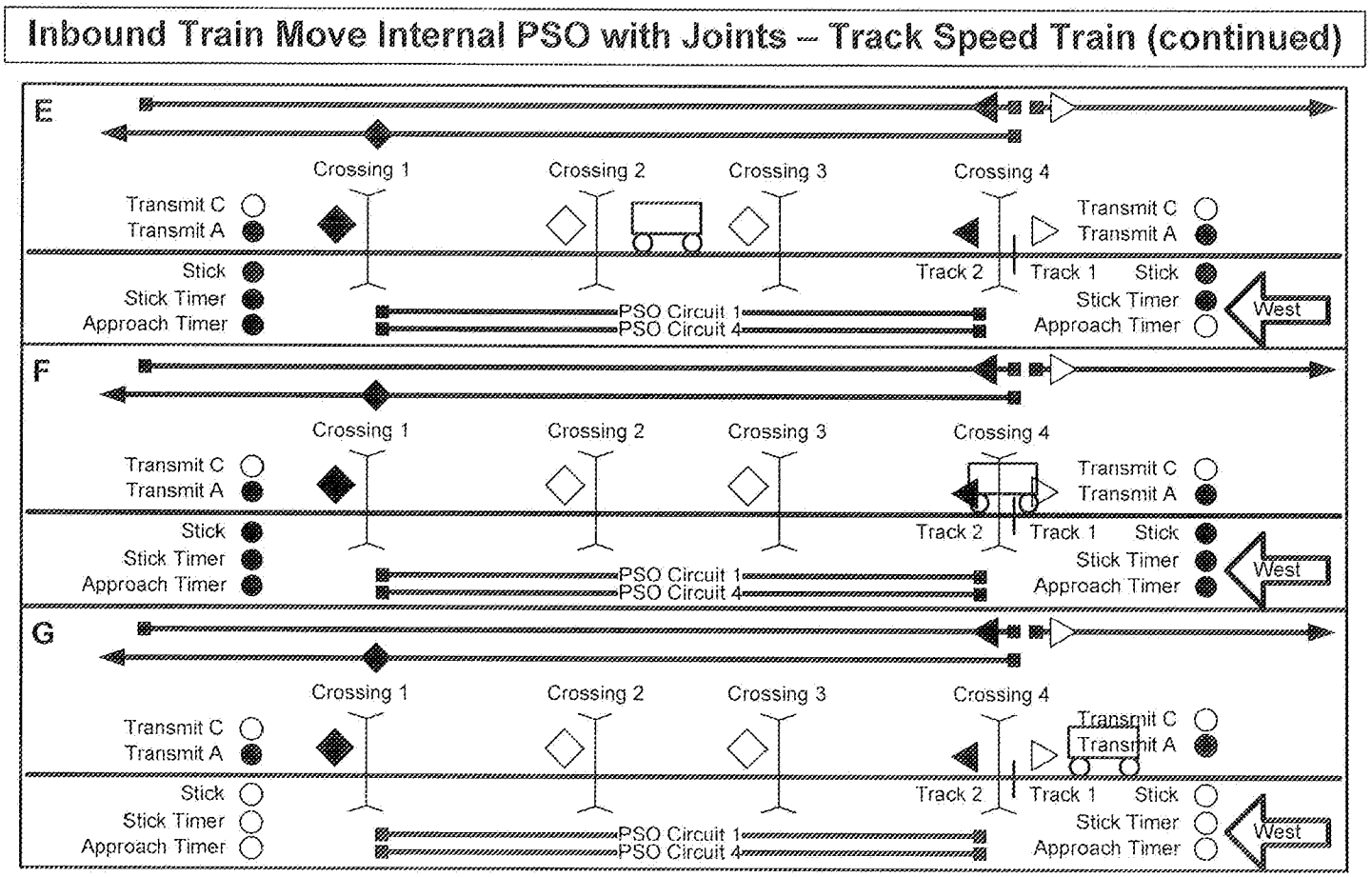
Figure 19:
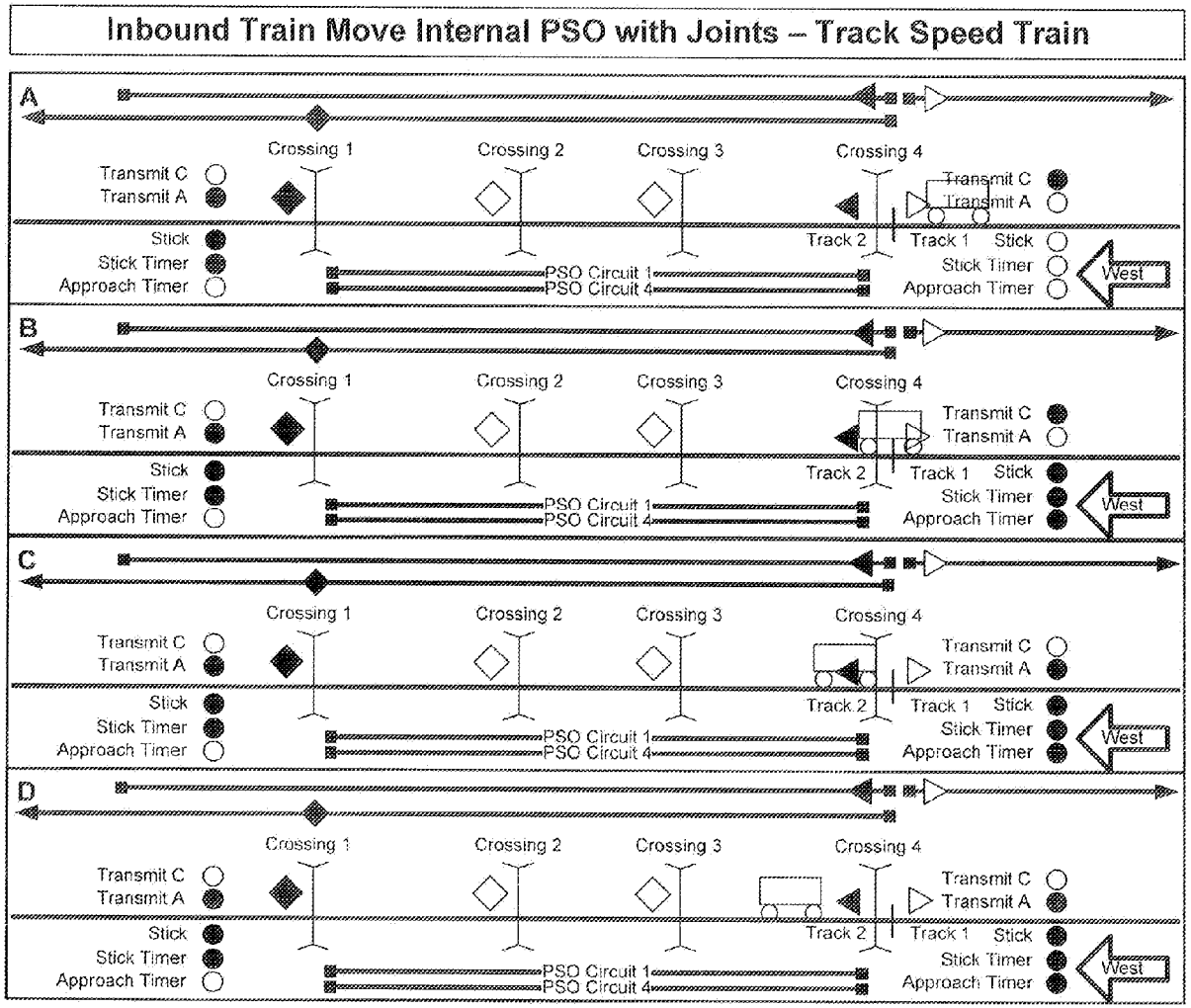
Figure 19:
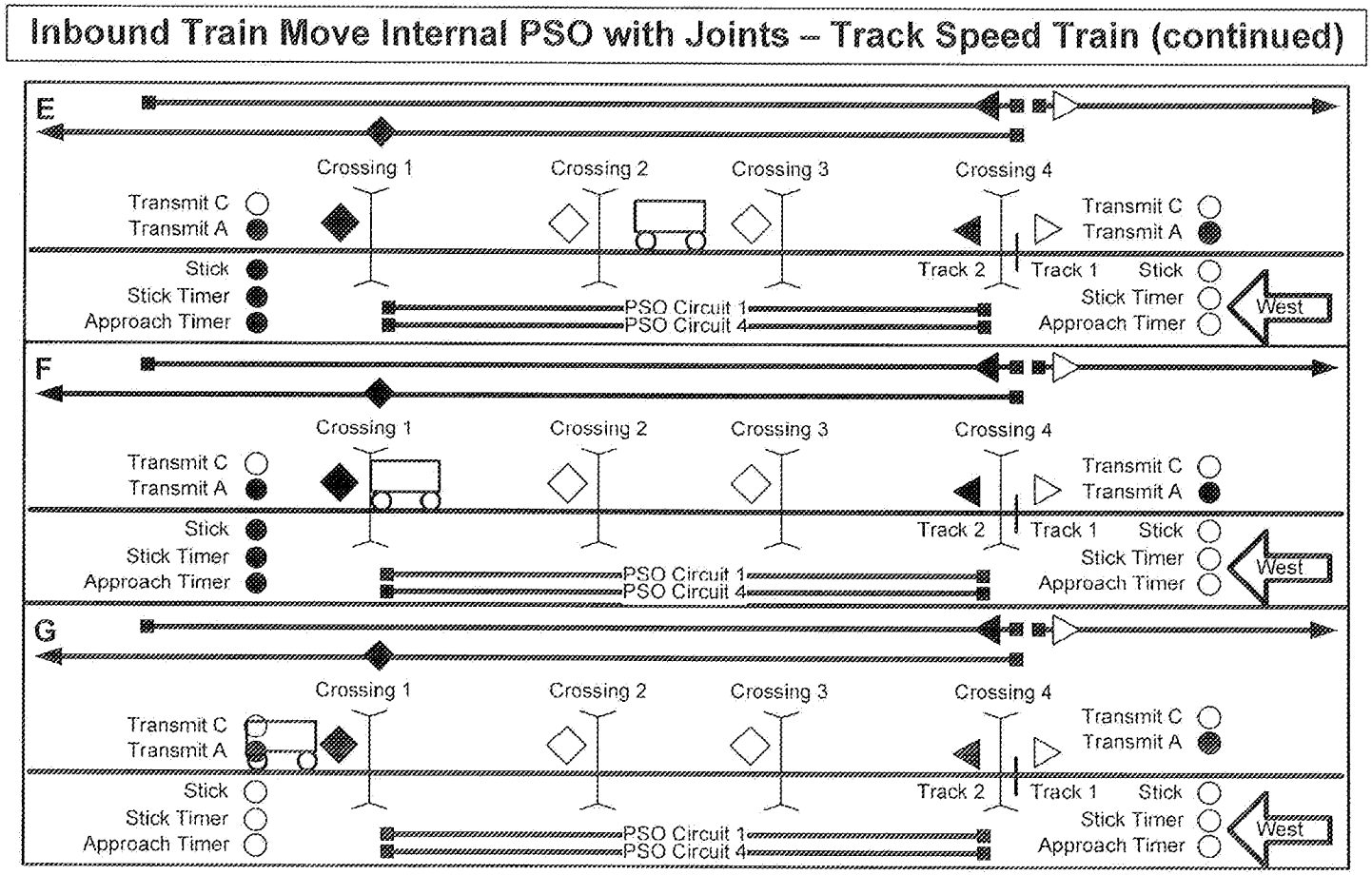
Figure 20:
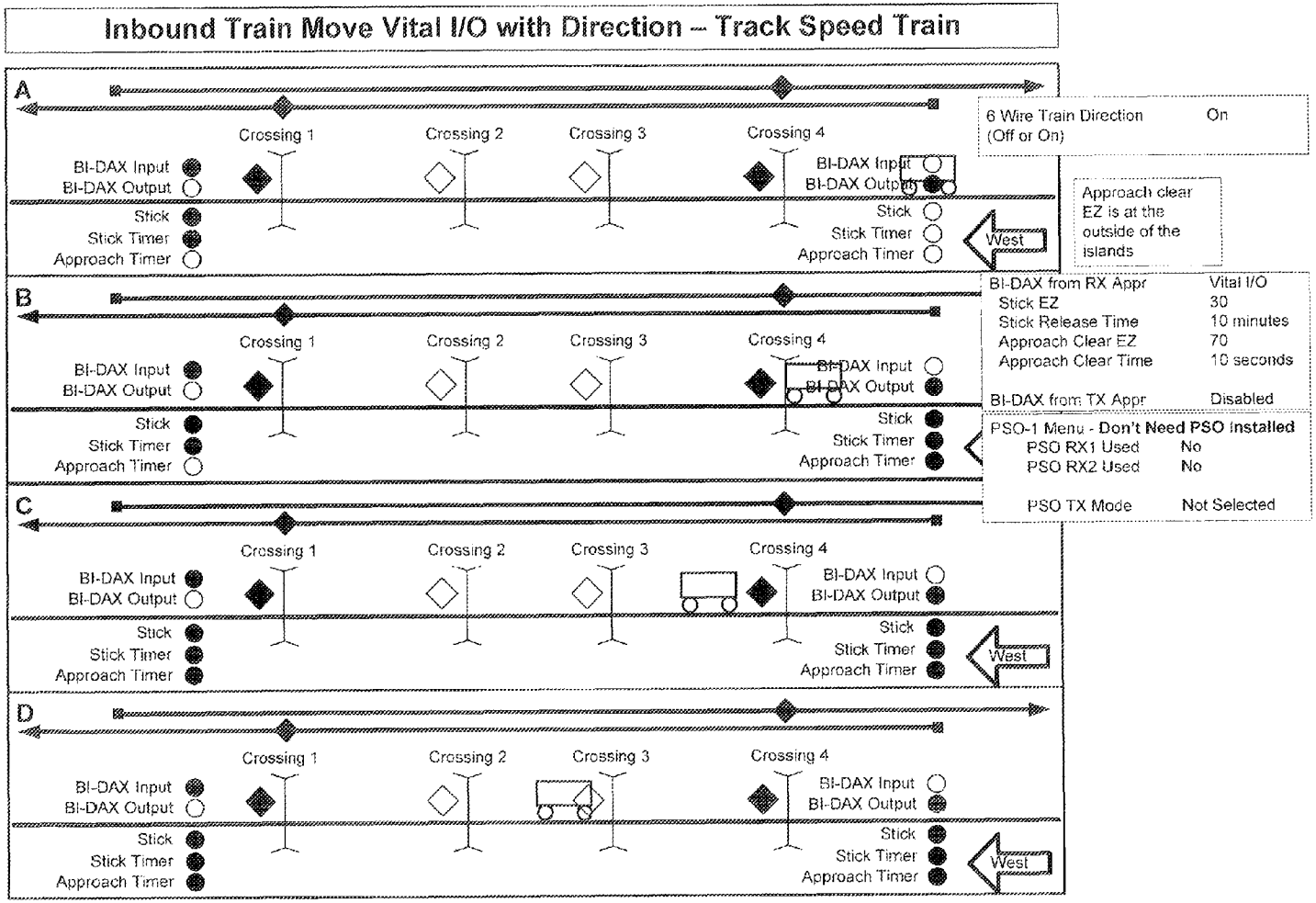
Figure 20:
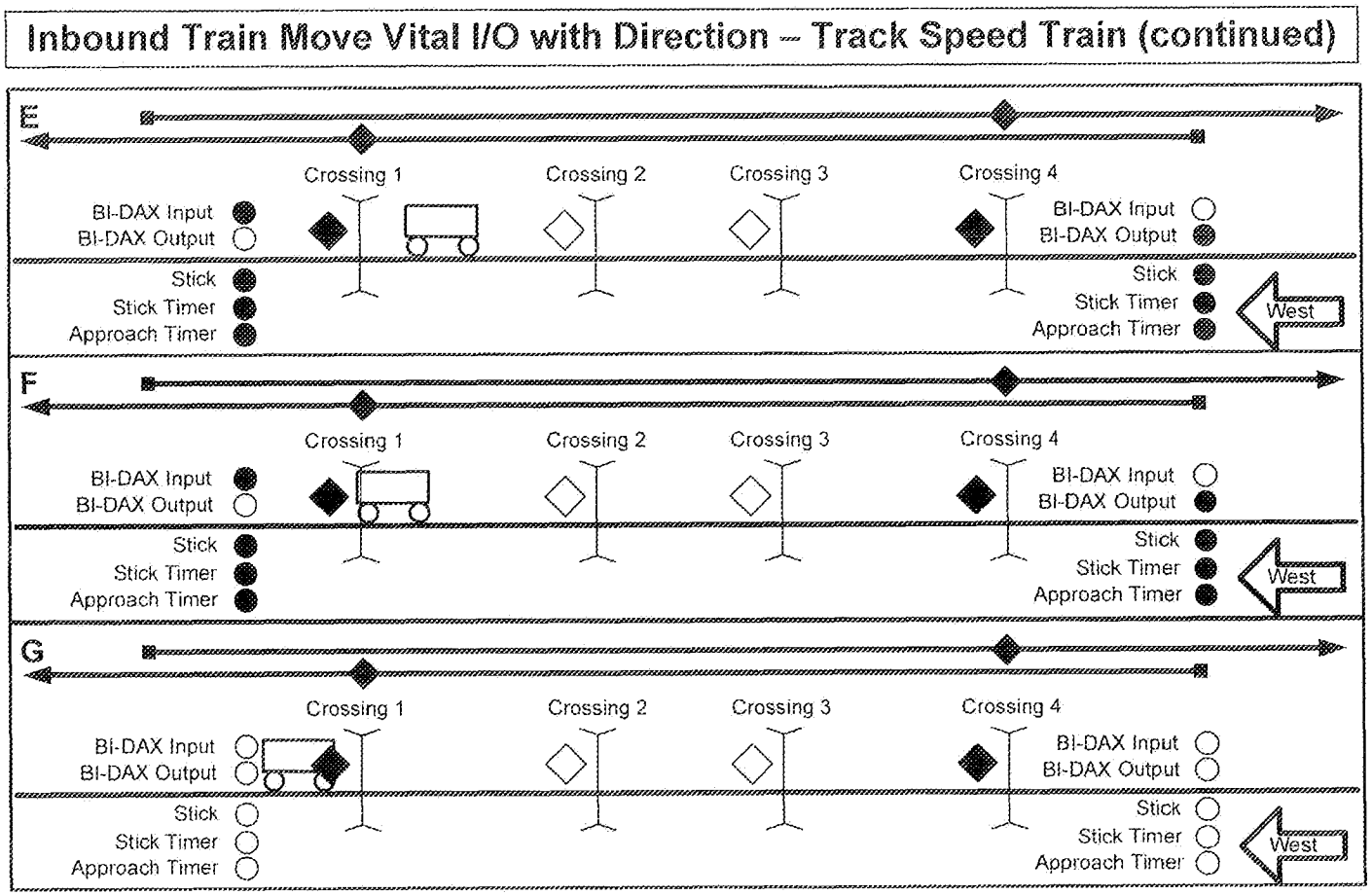
Figure 21:
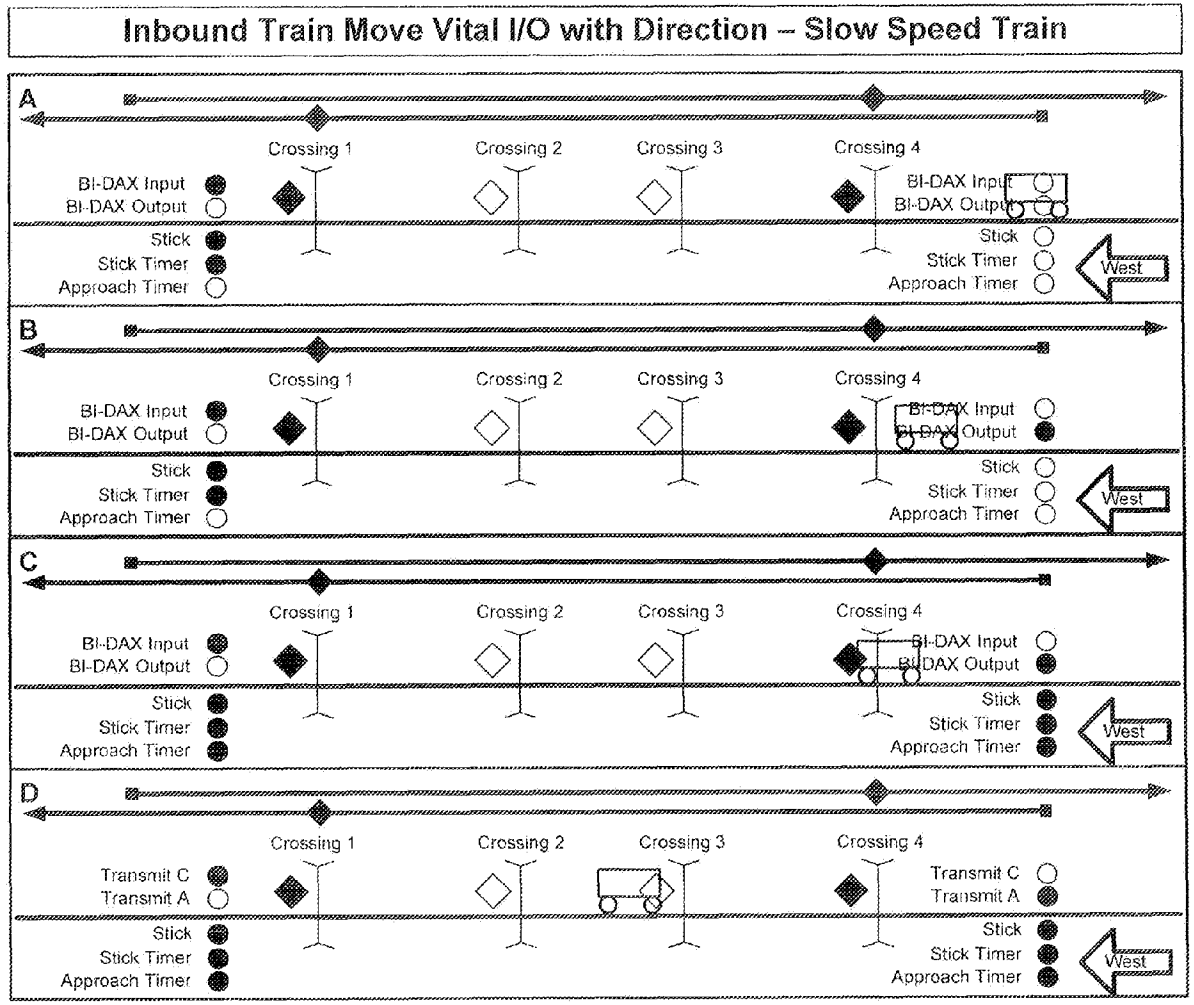
Figure 21:
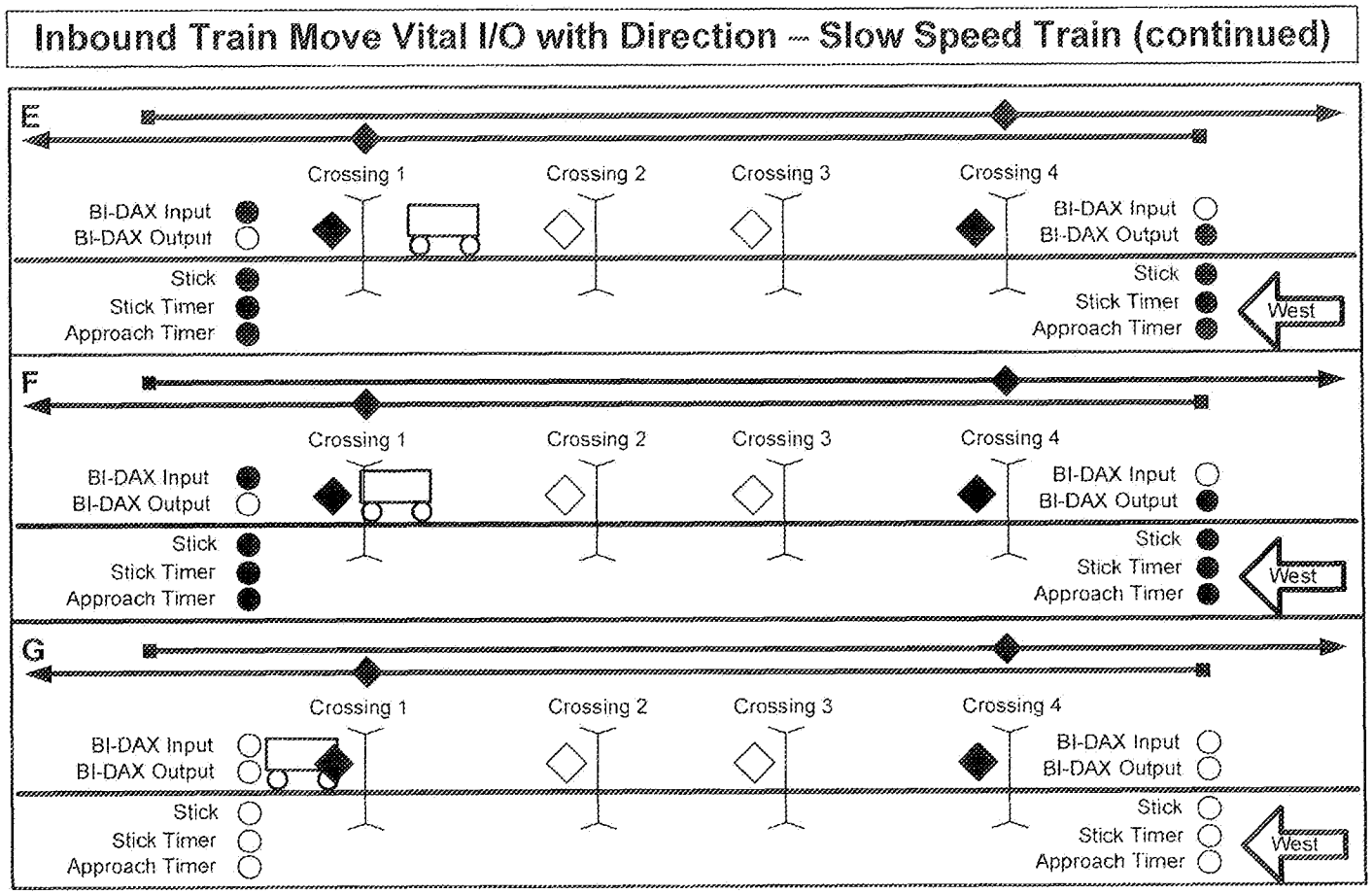

Parameter Set-Up (FIGS. 11-13)

Referring now to FIG. 11, the Approach Clear EZ is set to the EZ value representing a clear approach. Clear EZ is an EZ threshold that, when crossed, will cause a crossing predictor to cease the generation of a signal (or generate a signal) that results in the de-energization of a stick relay (referred to below as simply a "stick") in a downstream paired predictor so that the generation of DAX signals by the downstream paired predictor is enabled. Once a measured EZ value is greater than the Approach Clear EZ value, the system will start running the Approach Clear Timer if no train motion is present. The Approach Clear EZ value will normally be set to 80 except when this crossing approach extends through the adjacent bi-directional DAX system crossing island. When this crossing approach extends through the adjacent bi-directional DAX system crossing island the Approach Clear EZ is determined by placing a shunt on the far side of the adjacent bi-directional DAX system crossing island (at the farthest track leads) and recording the EZ value of this bi-directional DAX system. The Approach Clear EZ value will be set to the recorded EZ value plus 5. Referring now to FIG. 12, the Approach Clear Time should be programmed to the time it takes the train to travel from Approach Clear EZ point on this system's approach to the far side of the island of the adjacent bi-directional DAX system for the track speed train (a track speed train is a train traveling at the maximum allowable speed for the track). Referring now to FIG. 13, Stick EZ (which is a threshold representing the latest point, with respect to an inbound train heading downstream) at which a crossing predictor will generate a signal to set the stick relay logic of a downstream paired crossing predictor to suppress the transmission of DAXing signals to adjacent crossings by the downstream paired crossing predictor) is determined by placing a shunt at the location of the termination shunt for the adjacent crossing within the crossing approach being setup and adding 5 EZ. If the adjacent crossing does not terminate in the outer approach of this crossing then the Stick EZ should be set to minimum. Stick Release Time should be programmed to the amount of time that the stick should remain set if a train were to stop between the bi-directional DAX systems.

Internal PSO with Approaches Extending Through Island (FIGS. 14*a*-g)

Track Speed Train

Referring now to FIGS. 14*a-g*, initially all sticks are clear and both crossings (i.e. the PSO circuits for crossings 1 and 4) are transmitting code A. A train travels inbound towards crossing 4. The Train starts crossing but has not crossed the Stick EZ point so code A is still transmitted by PSO circuit transmitter for crossing 4. Next, the following events occur (with capital letters referring to the corresponding portions of the figures):

A—Train crossed Stick EZ point in approach (coincides with termination shunt of crossing 1) and the PSO transmitter for crossing 4 transmits code C due to crossing ringing (i.e., the crossing warning system has activated) and EZ<Stick EZ.

A—Crossing 1 sets Stick and Stick timer due to receiving a code C.

B—Crossing 4 island de-energizes (when train enters the crossing 4 island).

B—Crossing 4 sets stick, stick release timer, and approach timer.

B—Crossing 4 will transition from transmitting a code C to a code A when the PSO circuit de-energizes (Crossing 4 stops receiving a code A from crossing 1).

B—Crossing 1 keeps stick set due PSO circuit de-energizing and the transition being Code C to no code (PSO Circuit de-energized).

C, D, & E—State remains same while train traverses inner circuit.

C, D, & E—Timers do not run due to inbound or outbound motion.

C, D, & E—Crossing 1 will set Approach clear timer when EZ<Approach Clear EZ.

F—Crossing 1 island de-energizes.

F—States remain unchanged.

G—Crossing 1 & 4 both see PSO circuit up. Both crossings see code A. Crossing 1 island is still down (de-energized).

G—Crossing 1 receives code A from crossing 4. Crossing 1 is ringing and will transmit a code C while the island is down. Crossing 4 will receive the code C and set its stick.

G—Crossing 1 island energizes. Crossing 1 is receiving a code A from Crossing 4. Crossing transitions to sending a code A to crossing 4. Both crossings clear their sticks.

Slow Speed Train

This scenario is the same as the track speed train. As long as crossing 1 and 4 see inbound or outbound motion then the timers will not run to expiration and the sticks will remain set until the train passes through the island and the PSO circuit energizes.

Train Stops on Inner Approach

Figure 22:
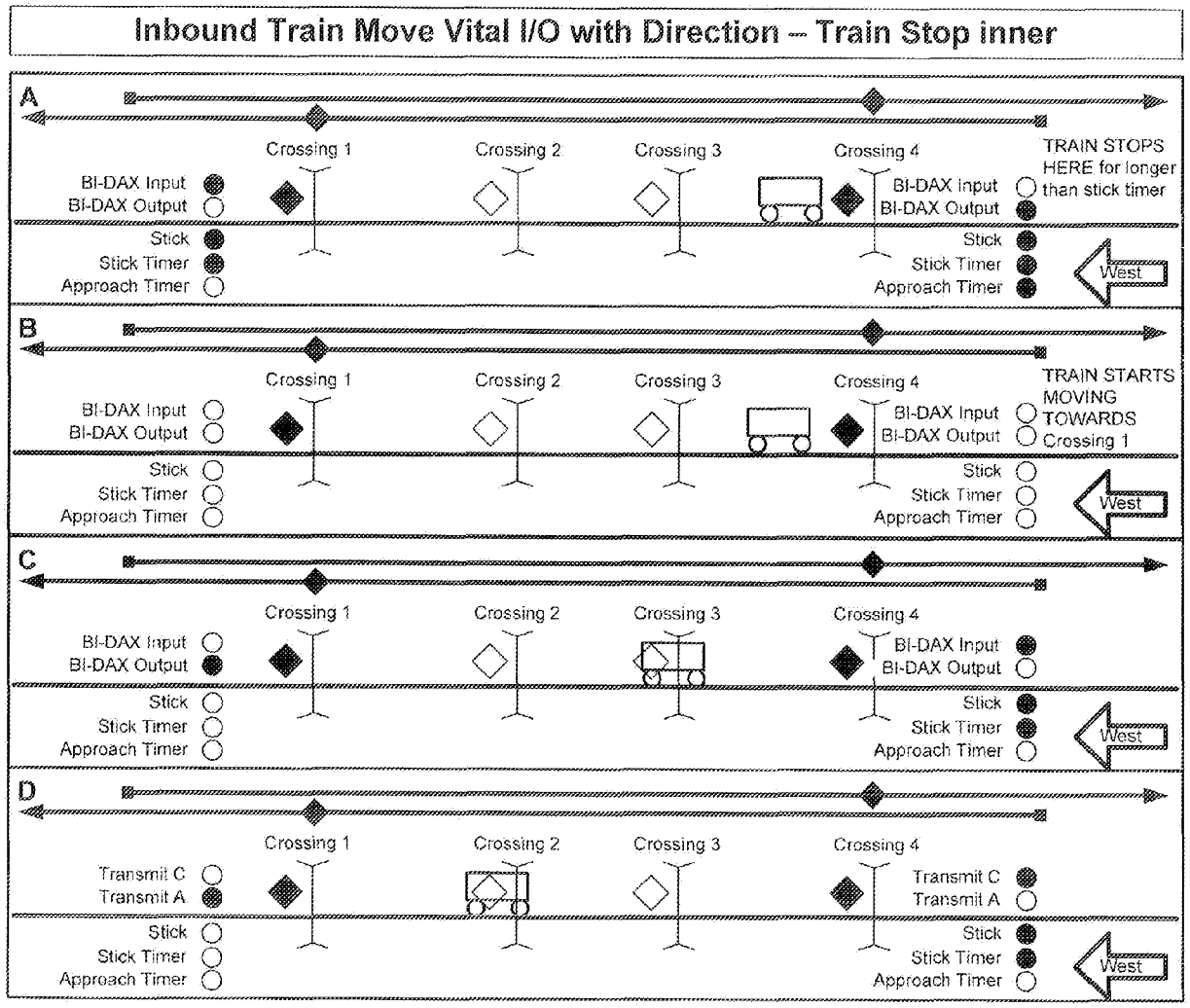
Figure 22:
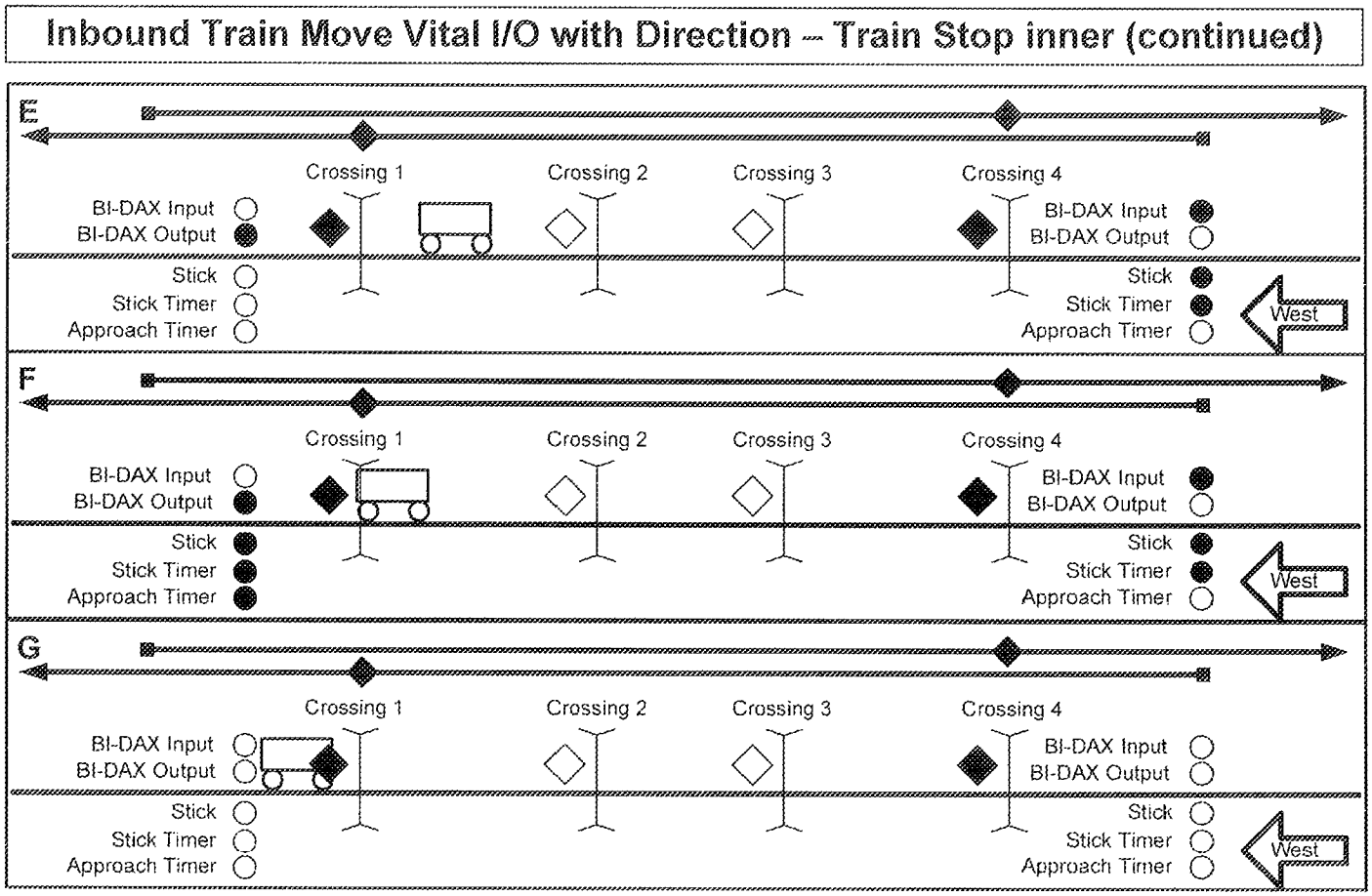
Figure 23:
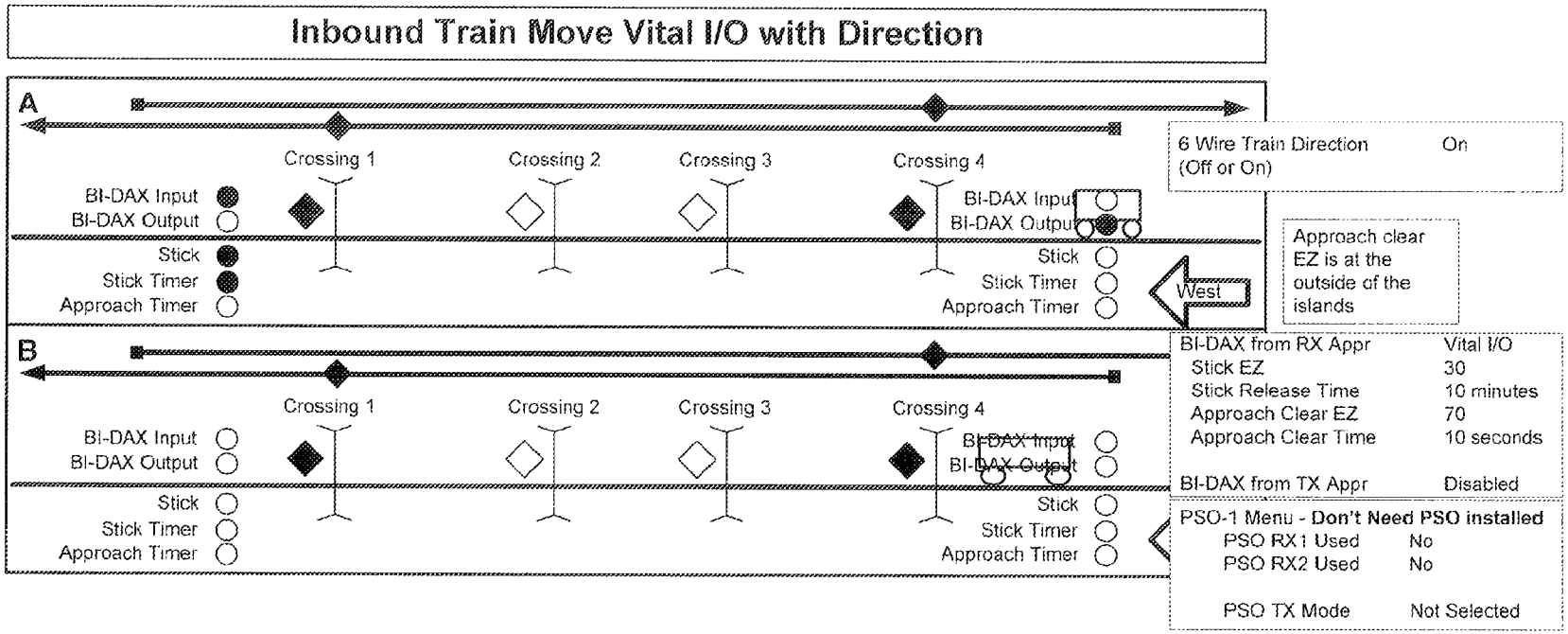
Figure 24:
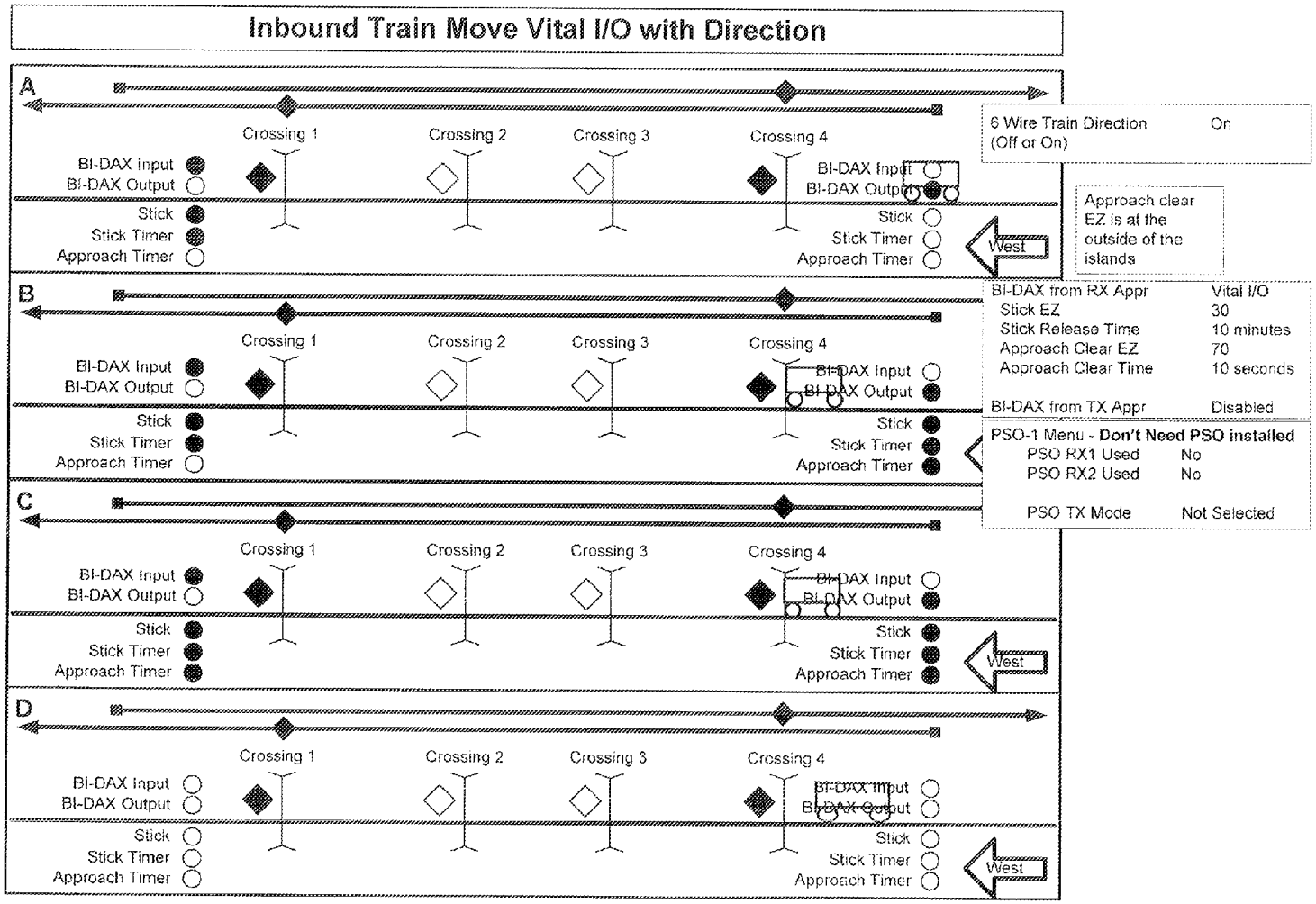
Figure 24:
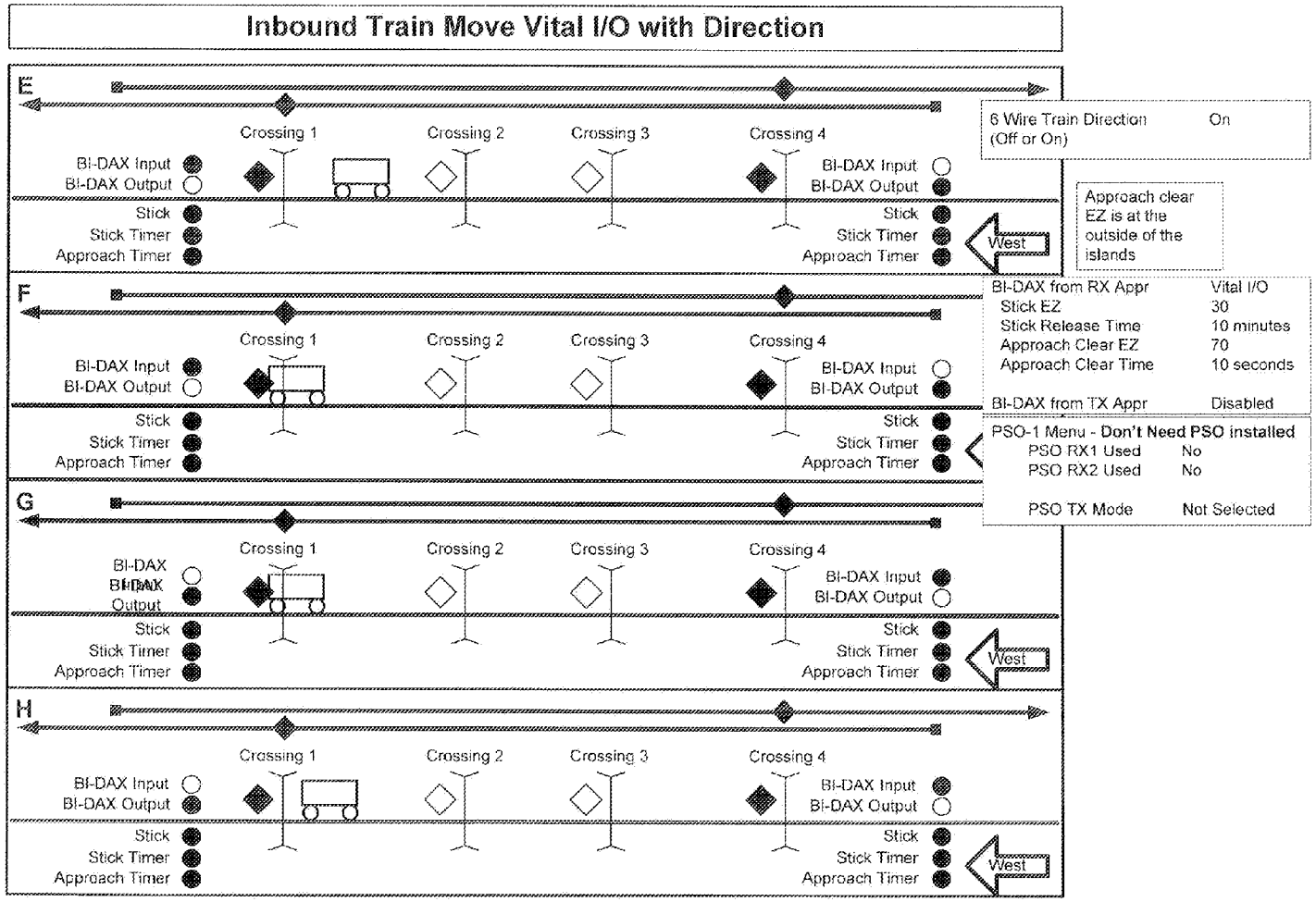
Figure 25:
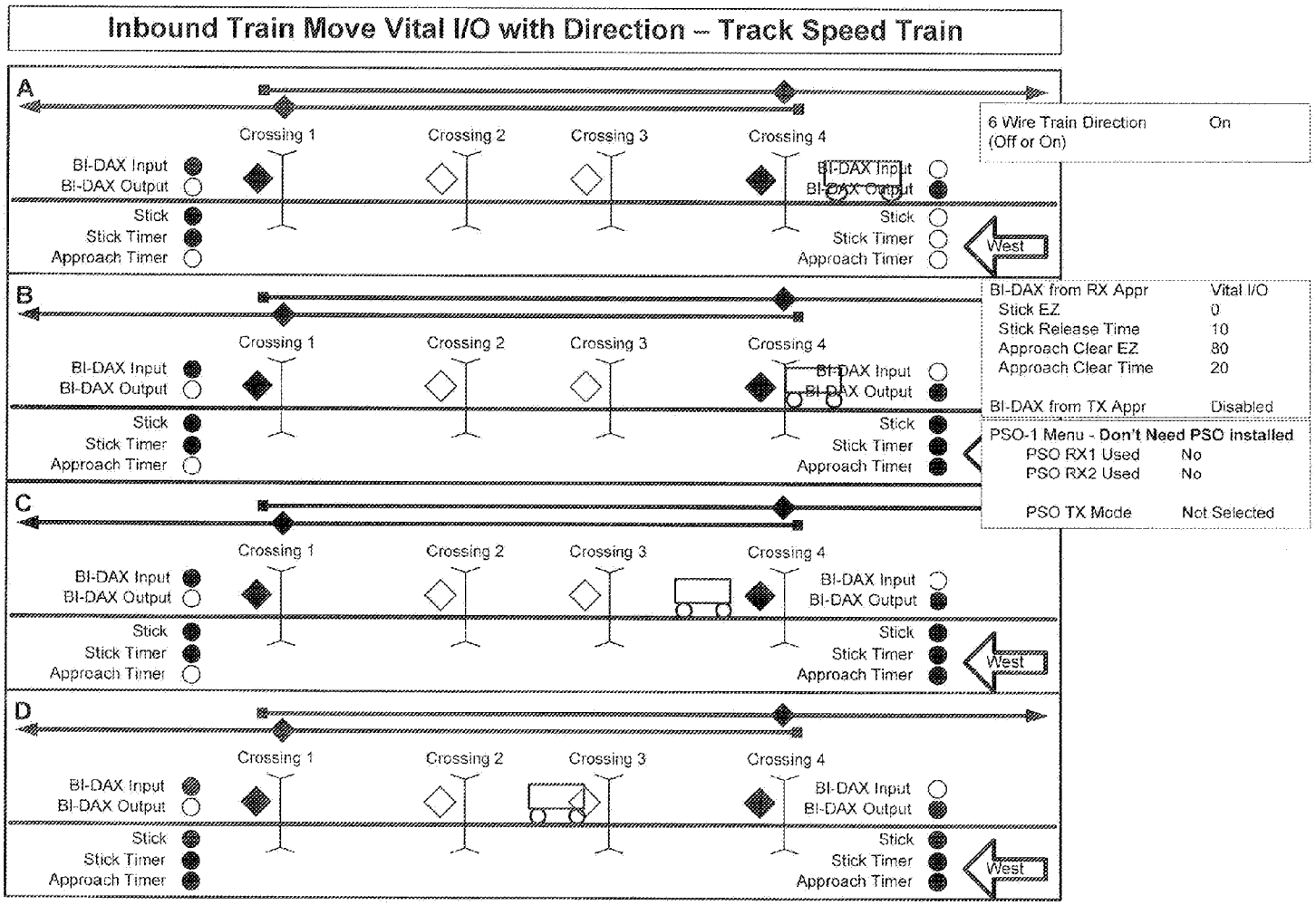
Figure 25:
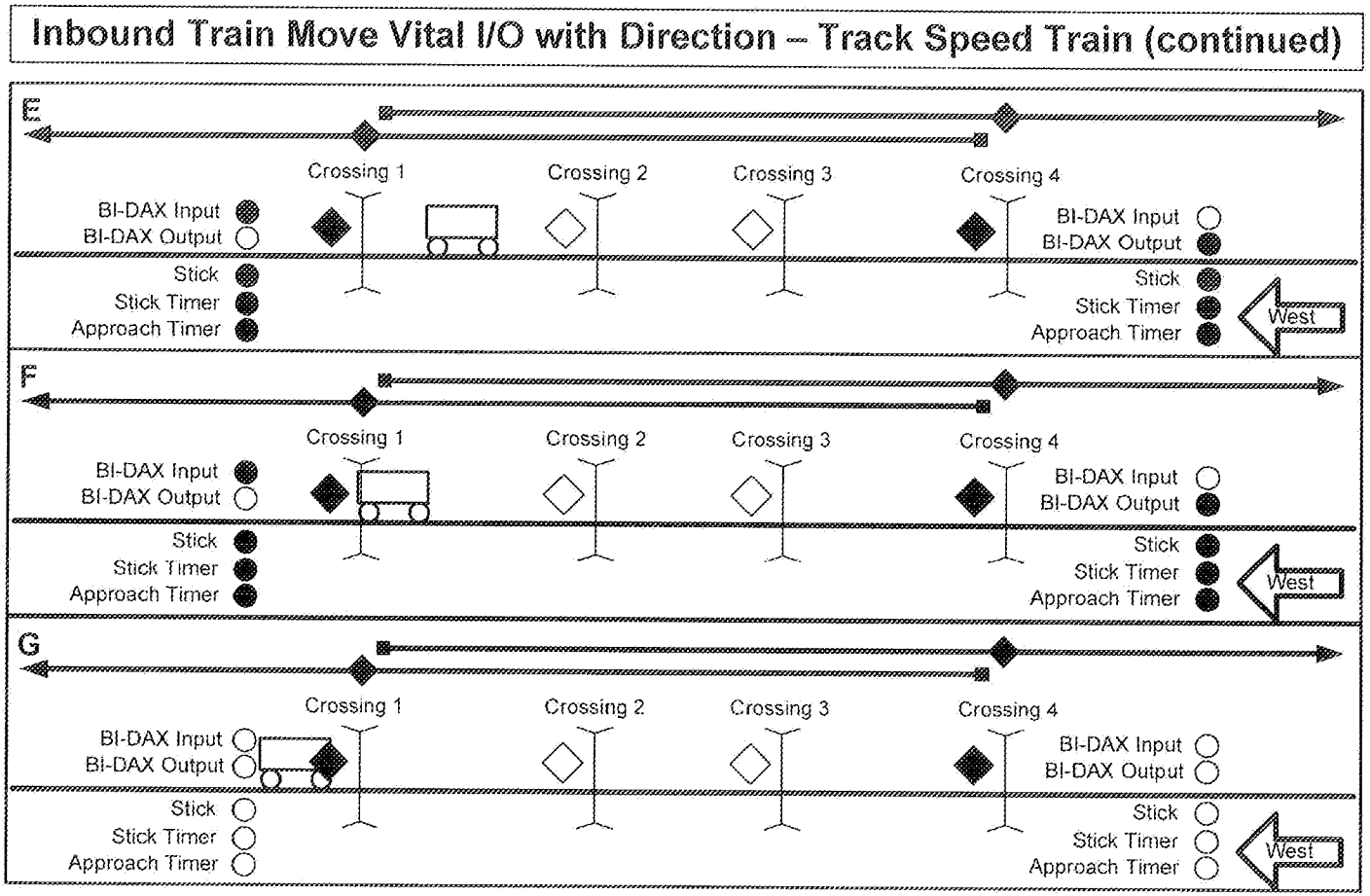
Figure 26:
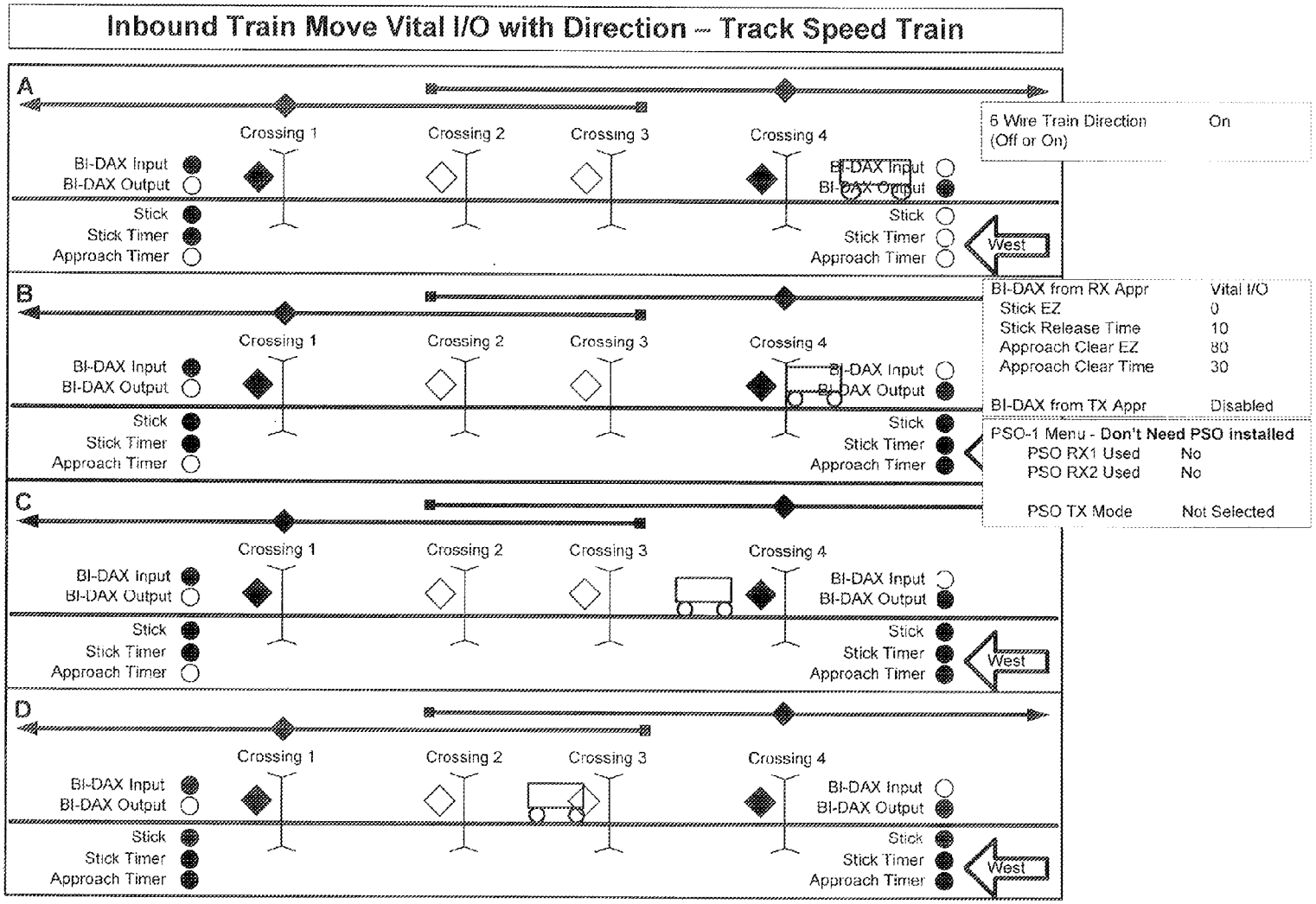
Figure 26:
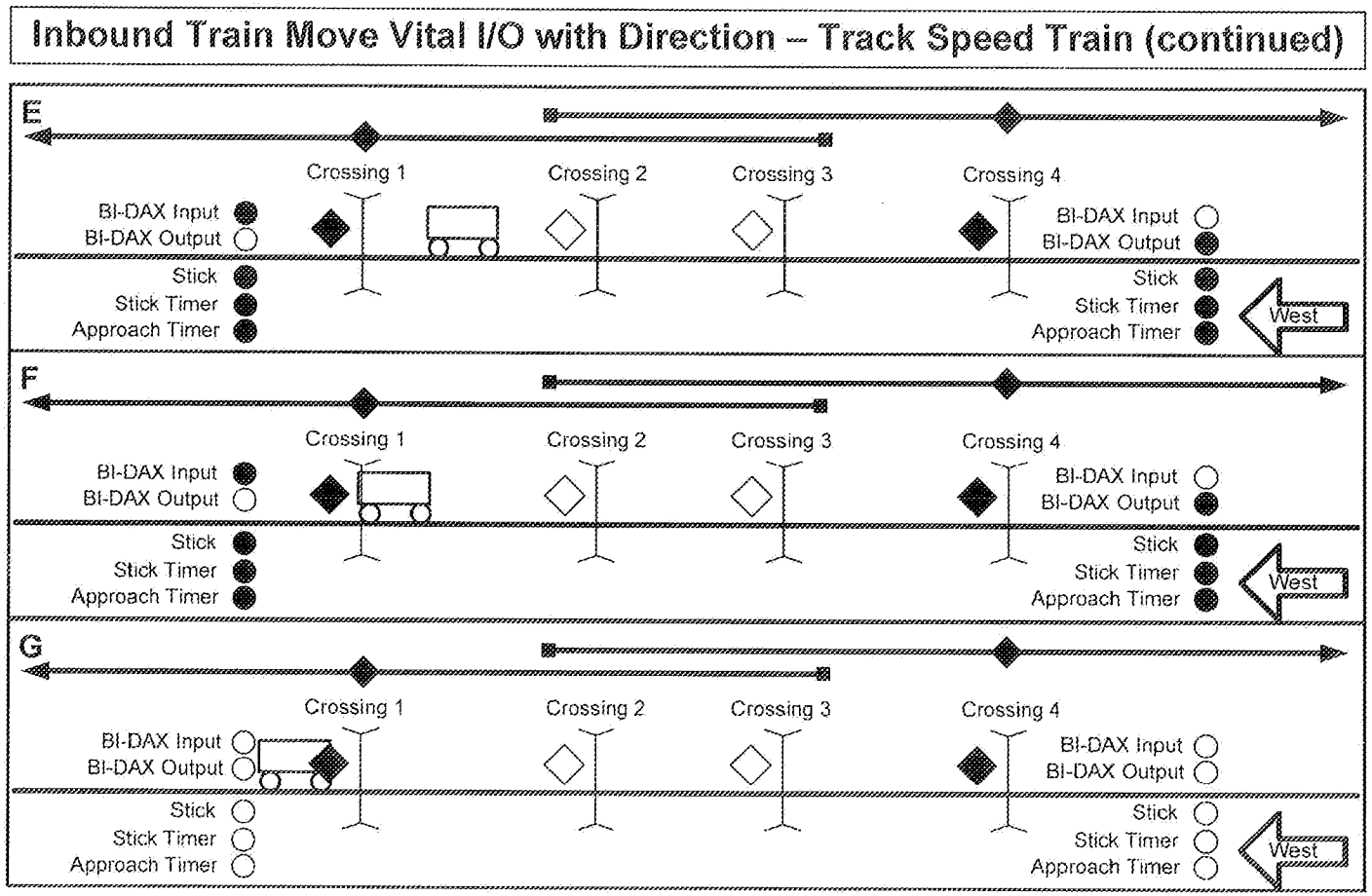
Figure 27:
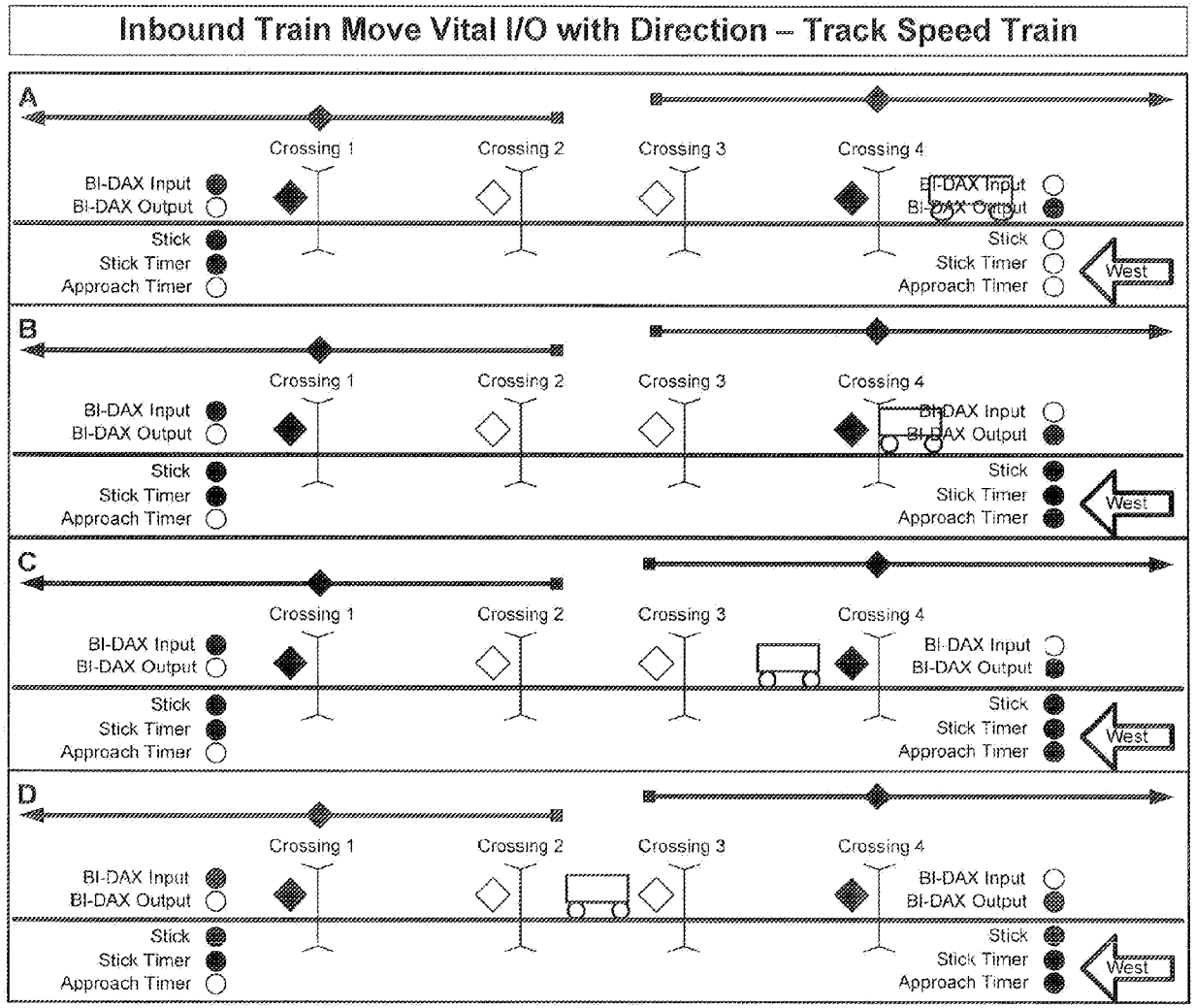
Figure 27:
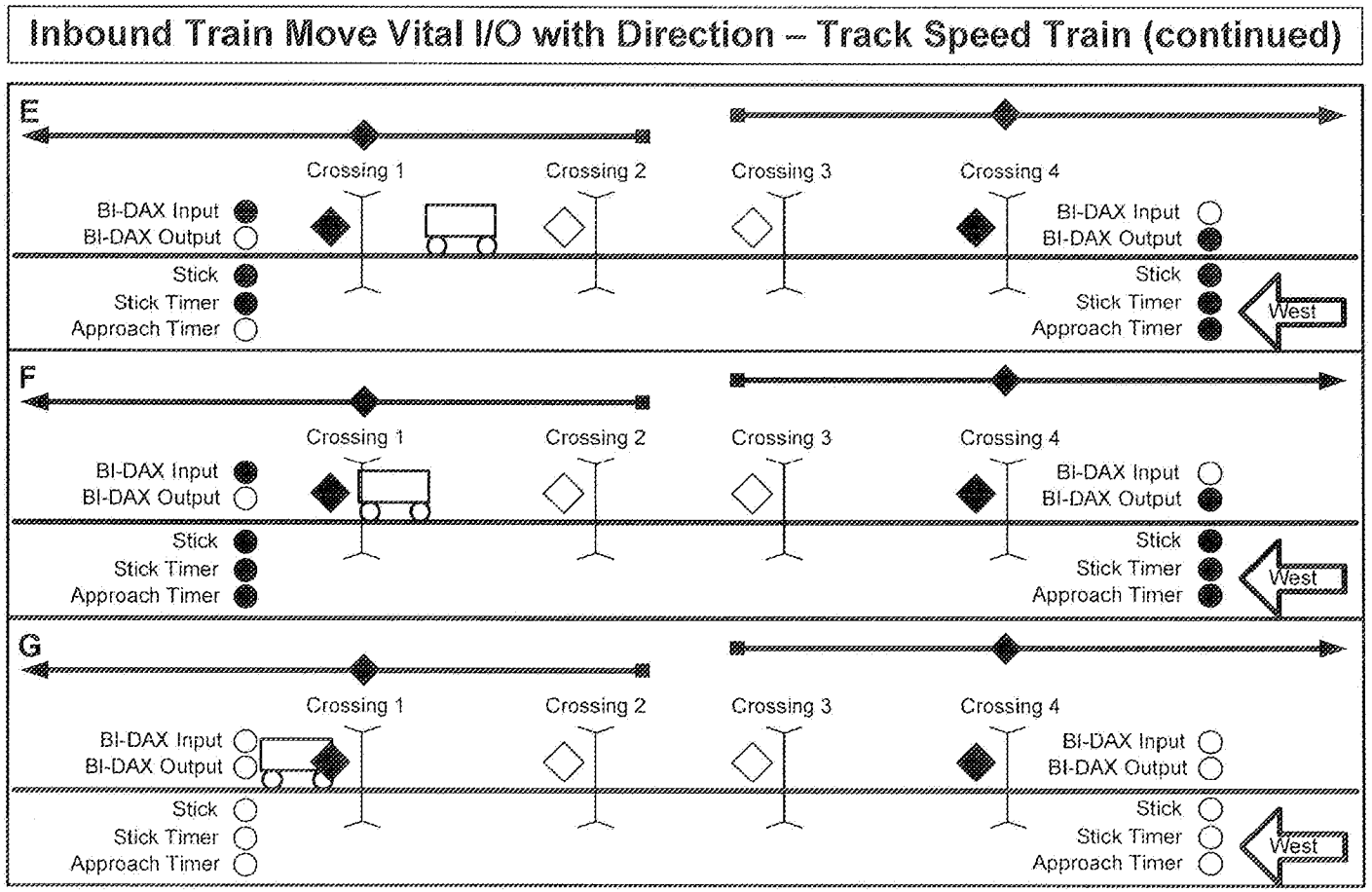
Figure 28:
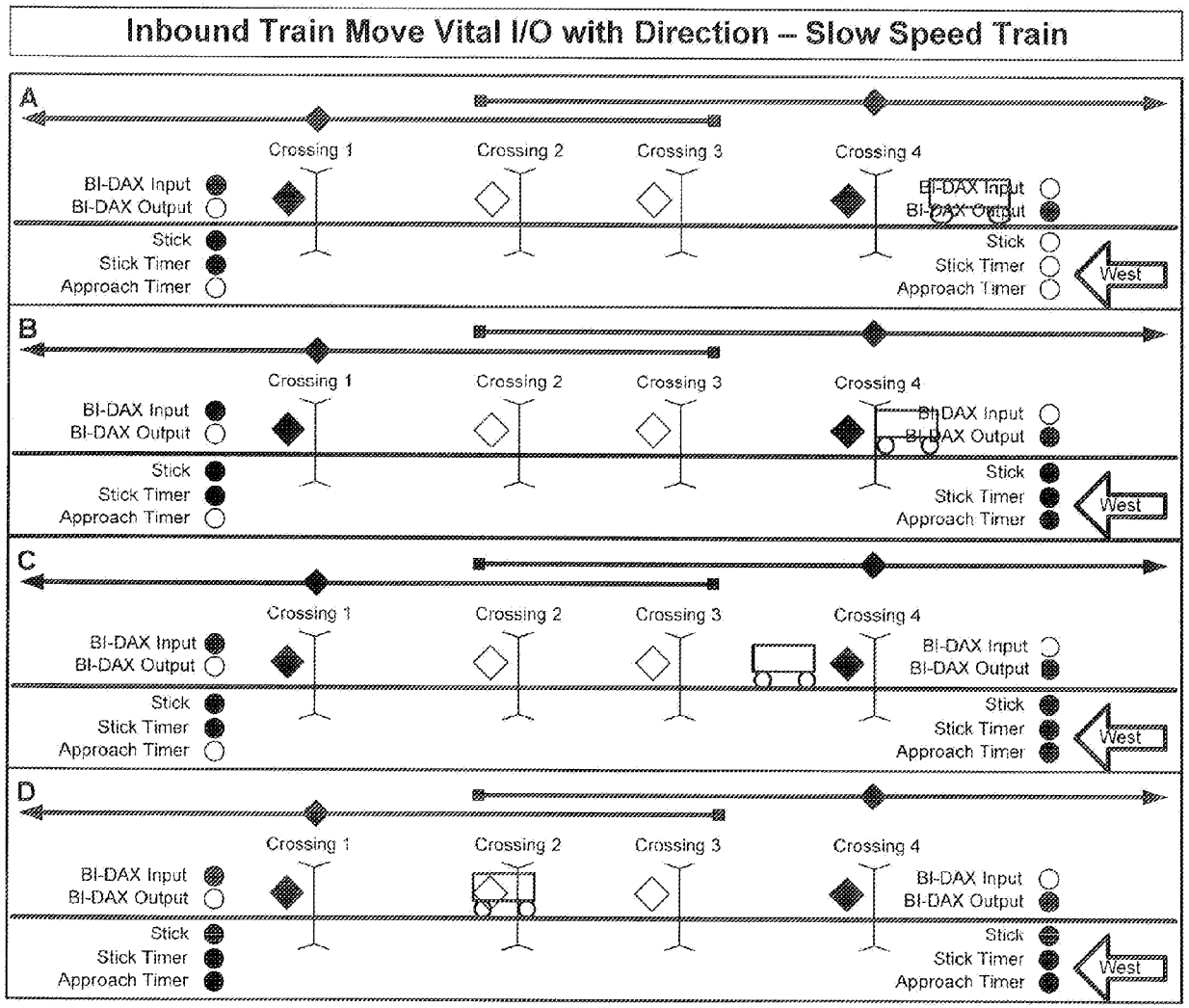
Figure 28:
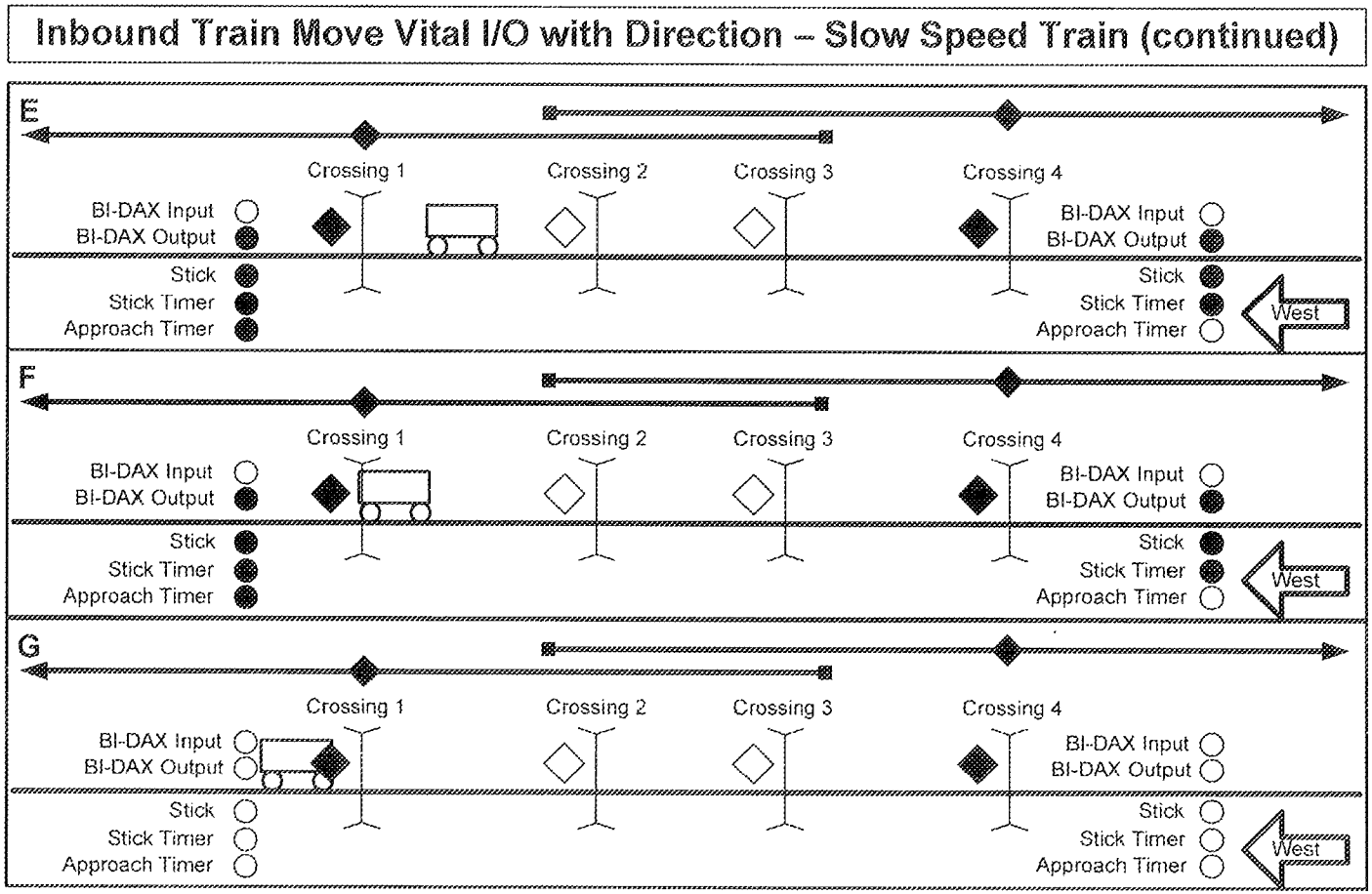
Figure 29:
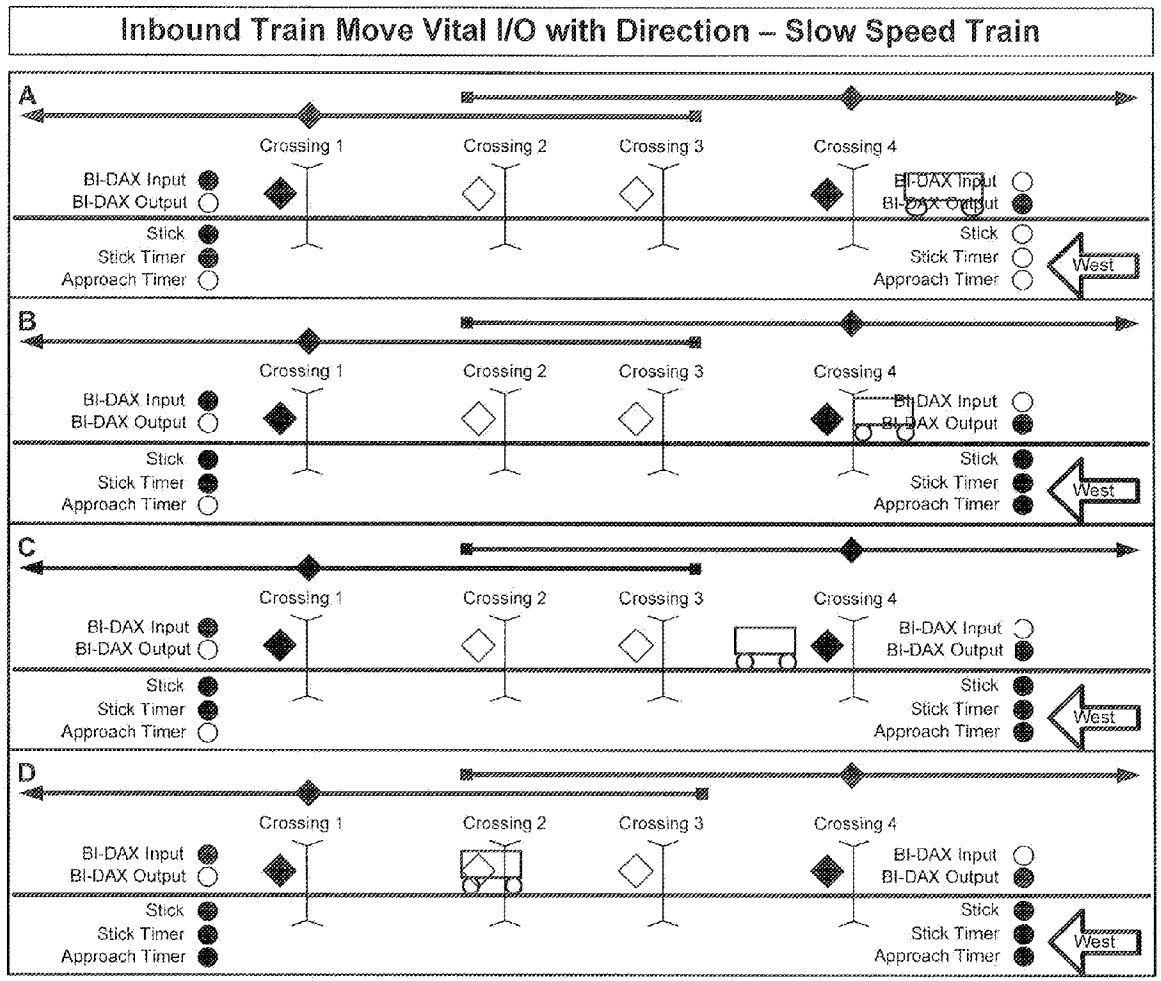
Figure 29:
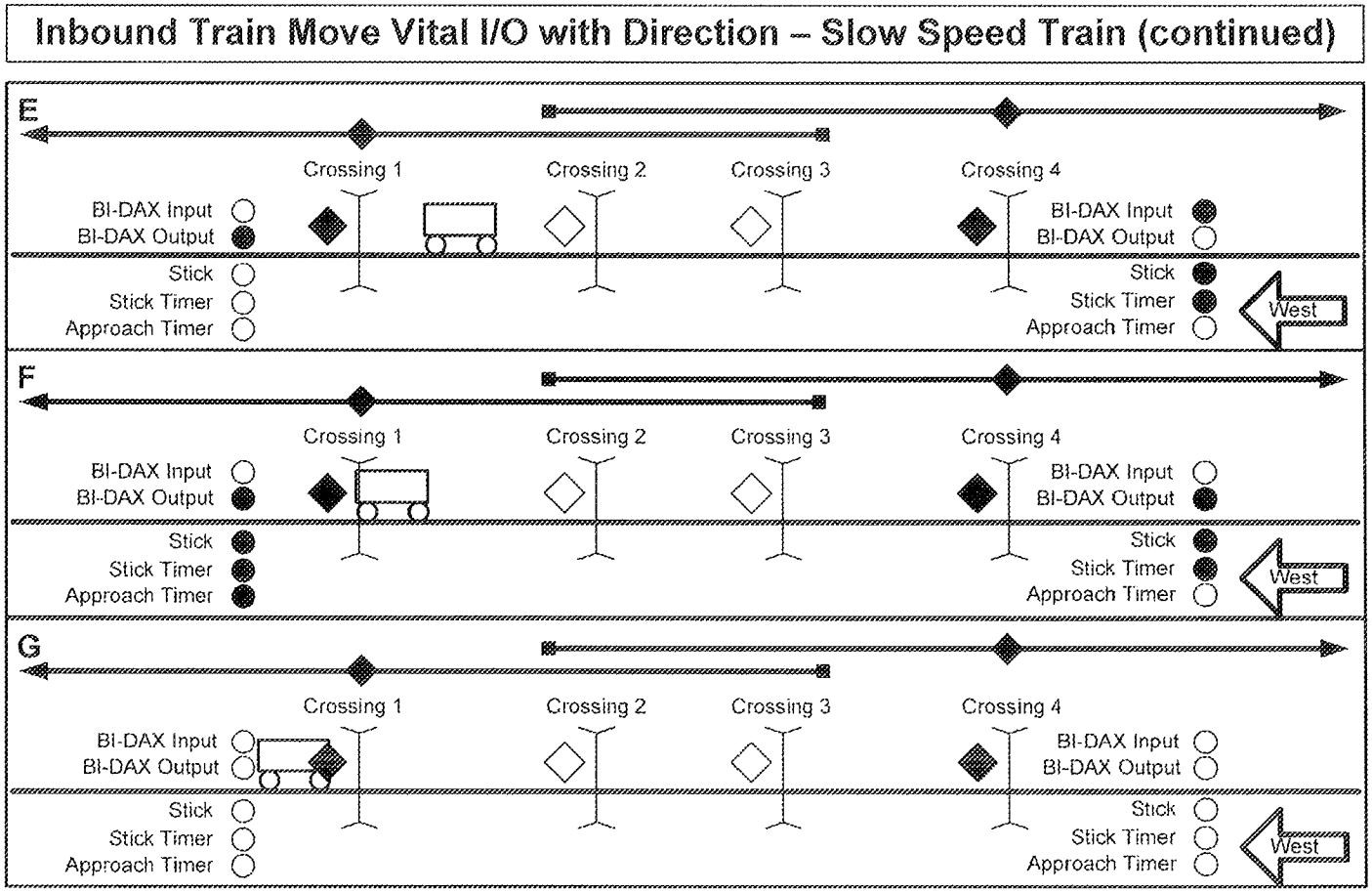
Figure 30:
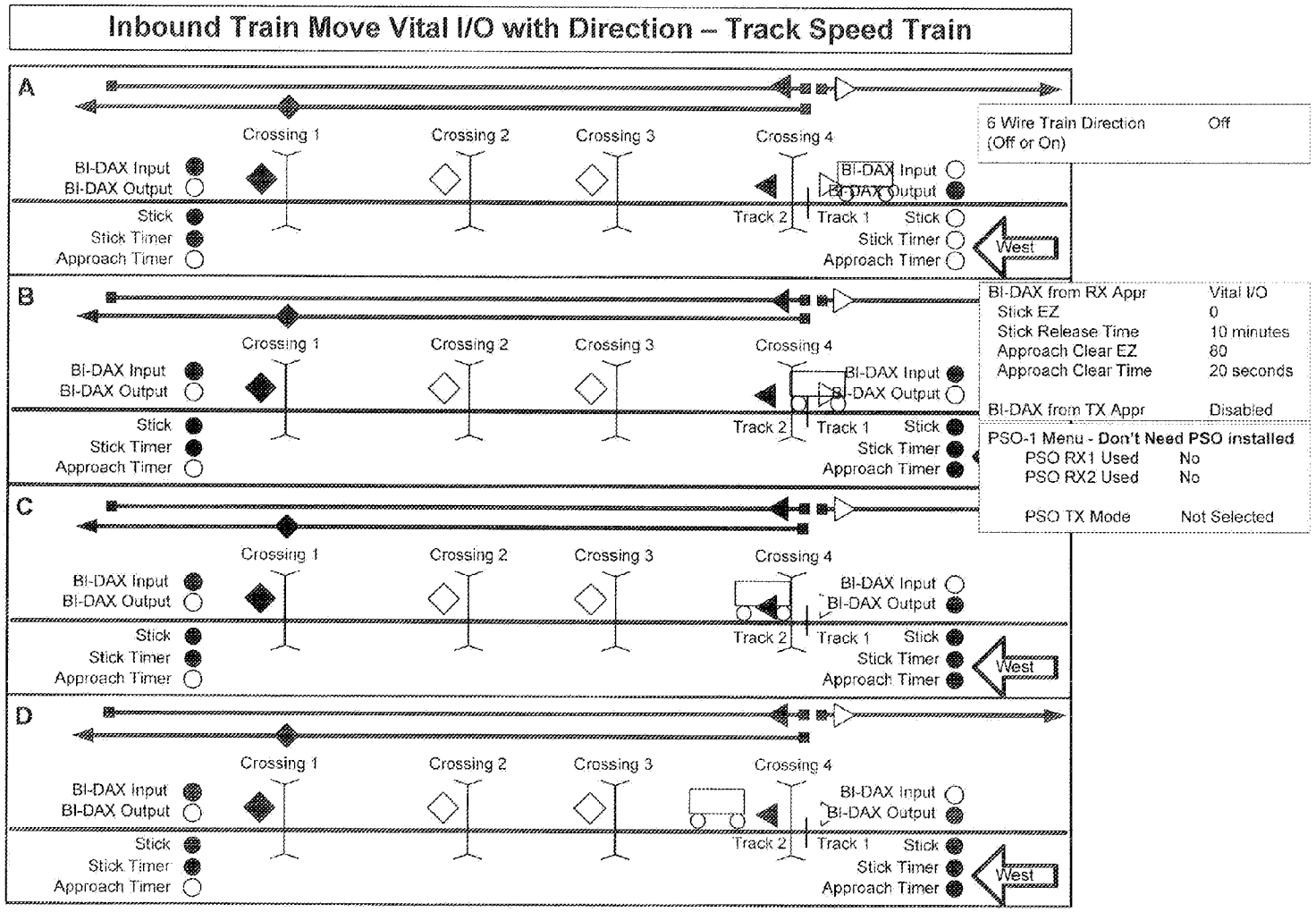
Figure 30:
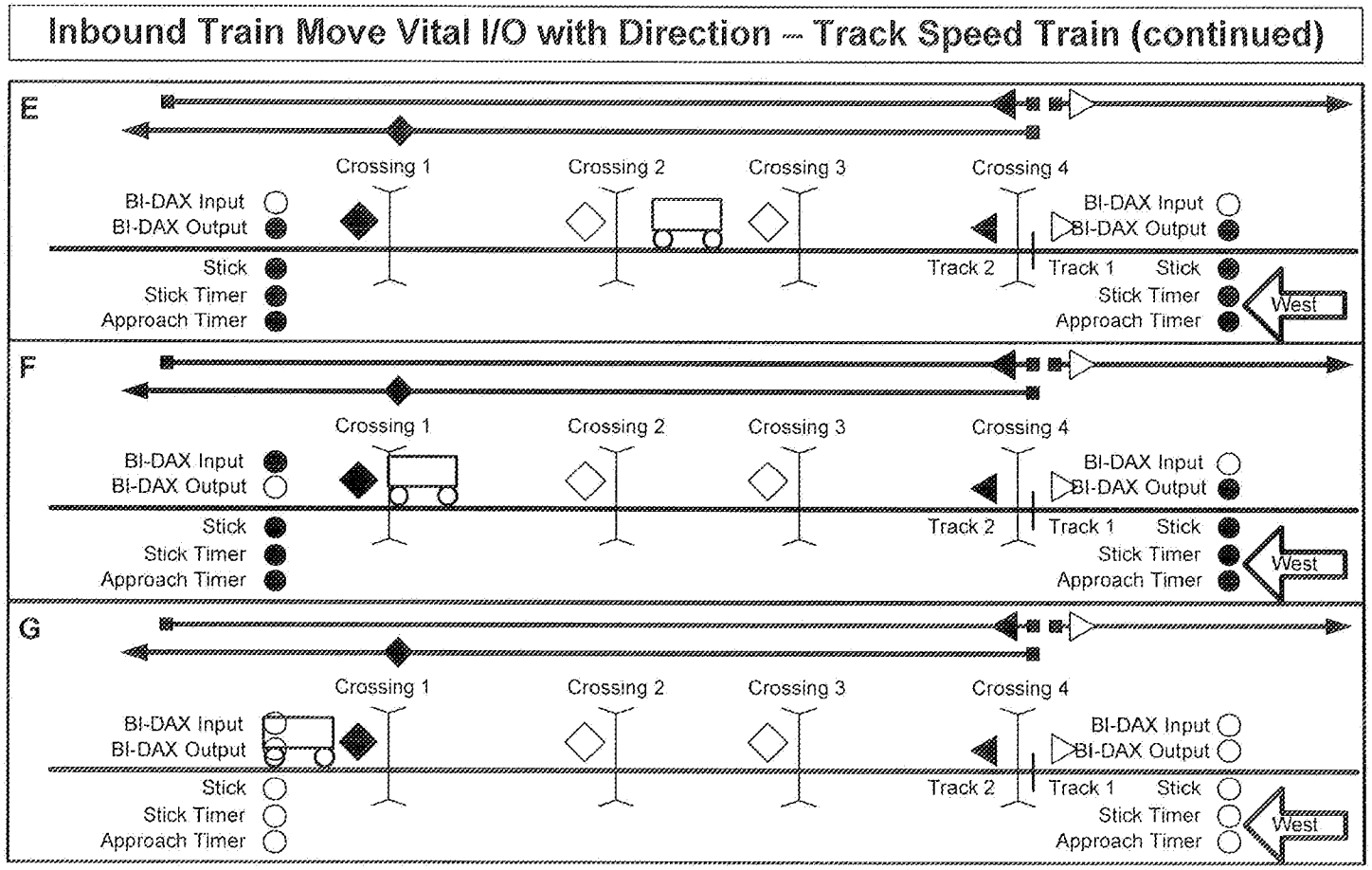
Figure 31:
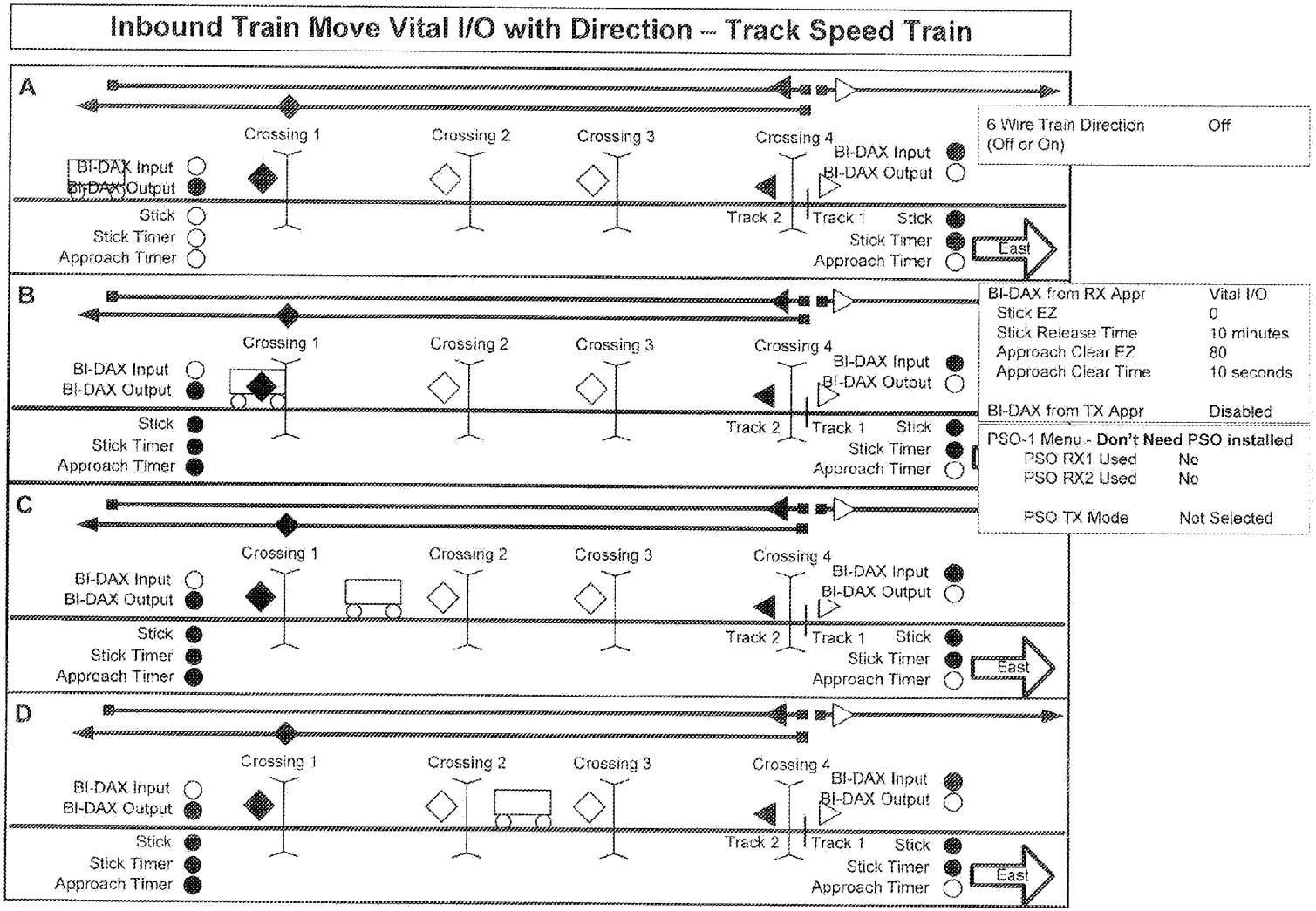
Figure 31:
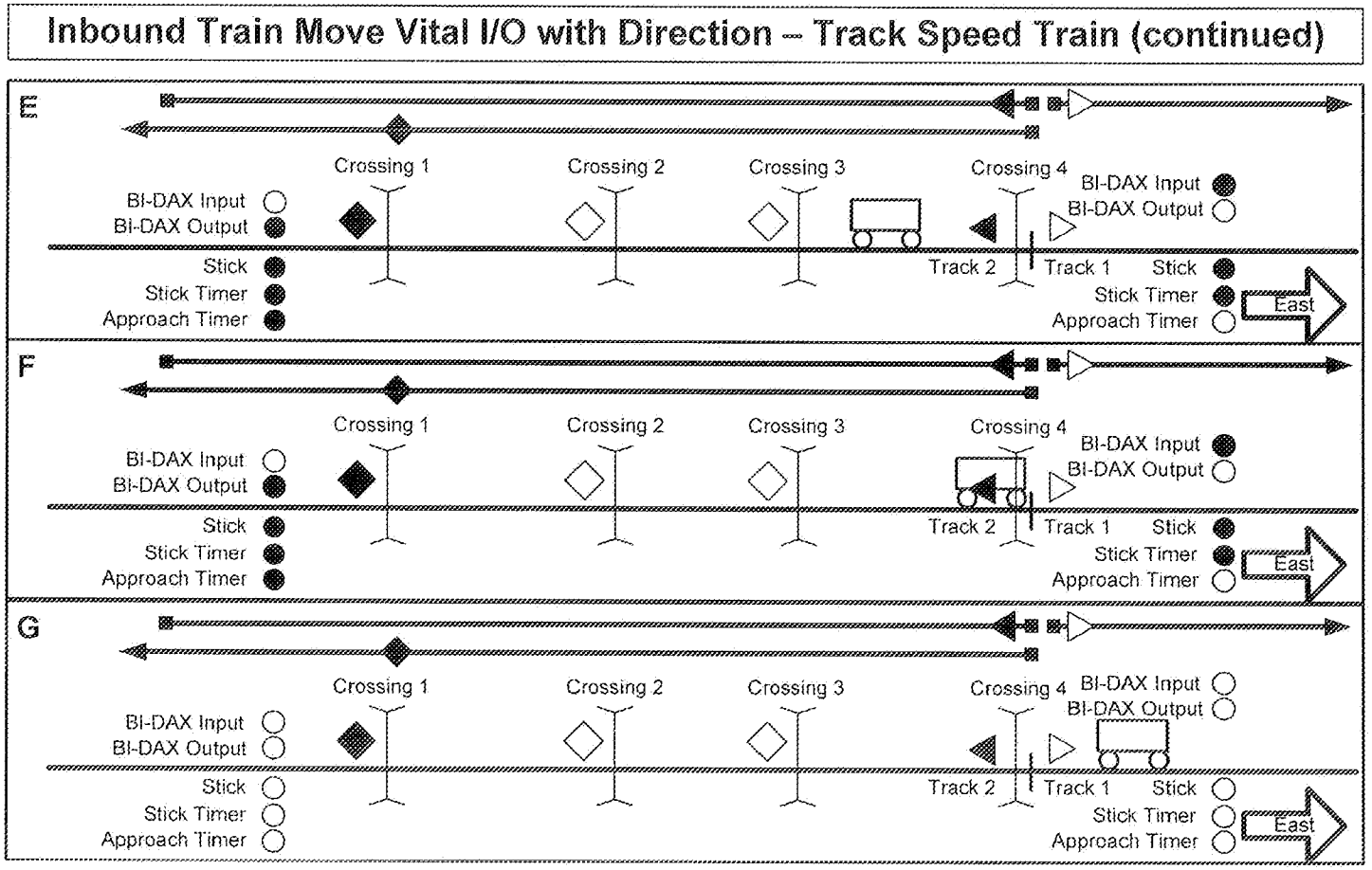
Figure 32:
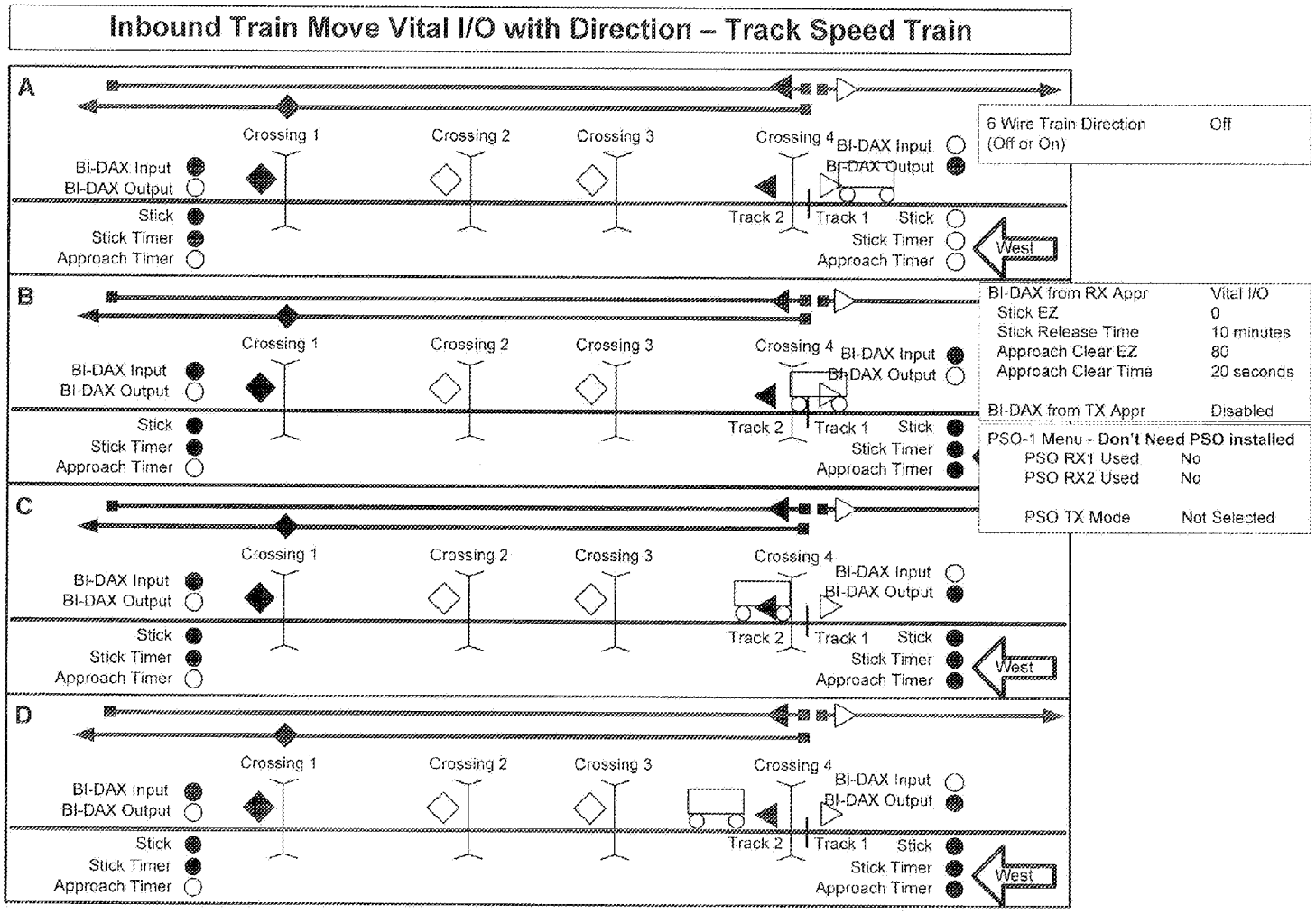
Figure 32:
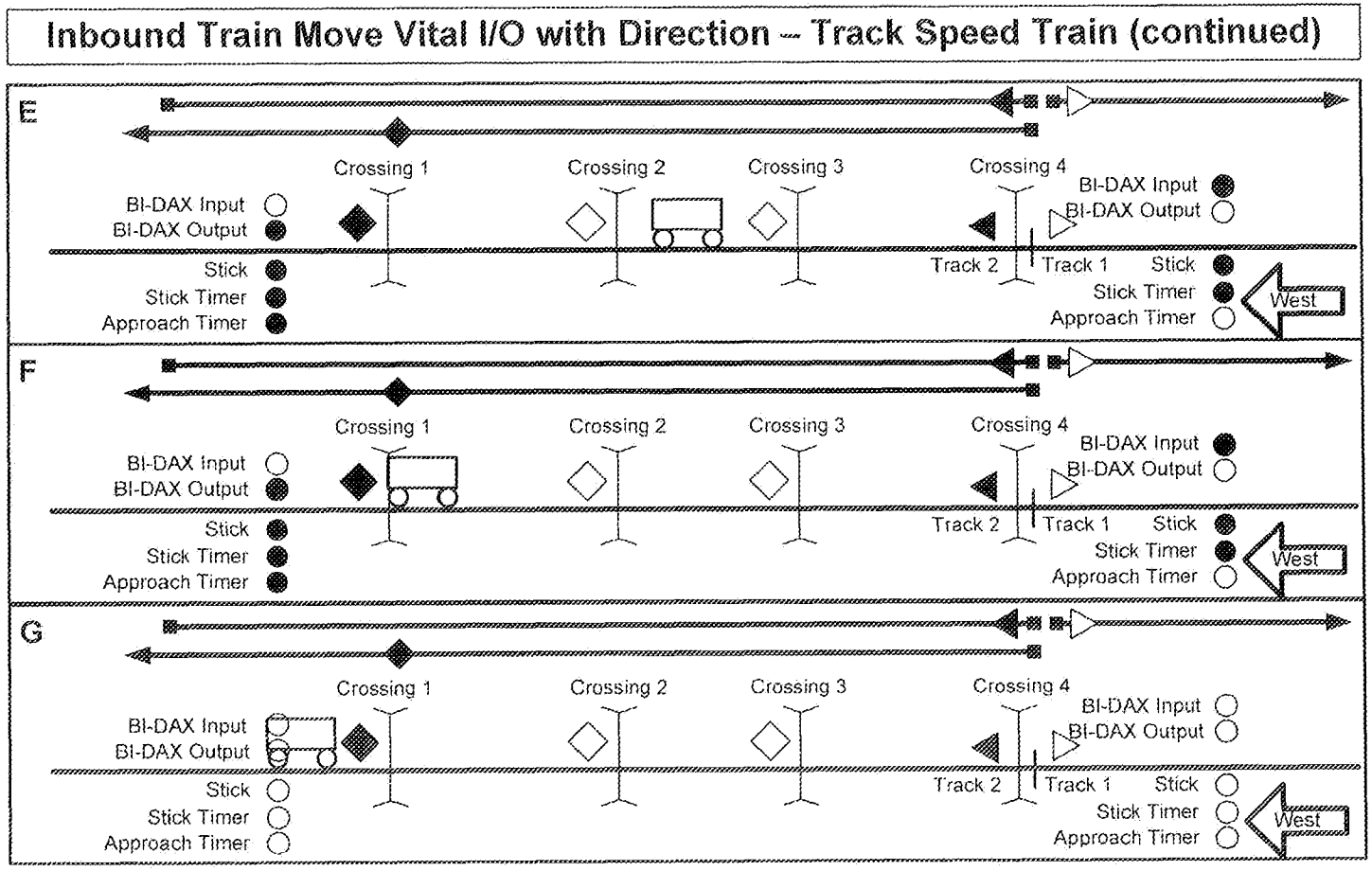
Figure 33:
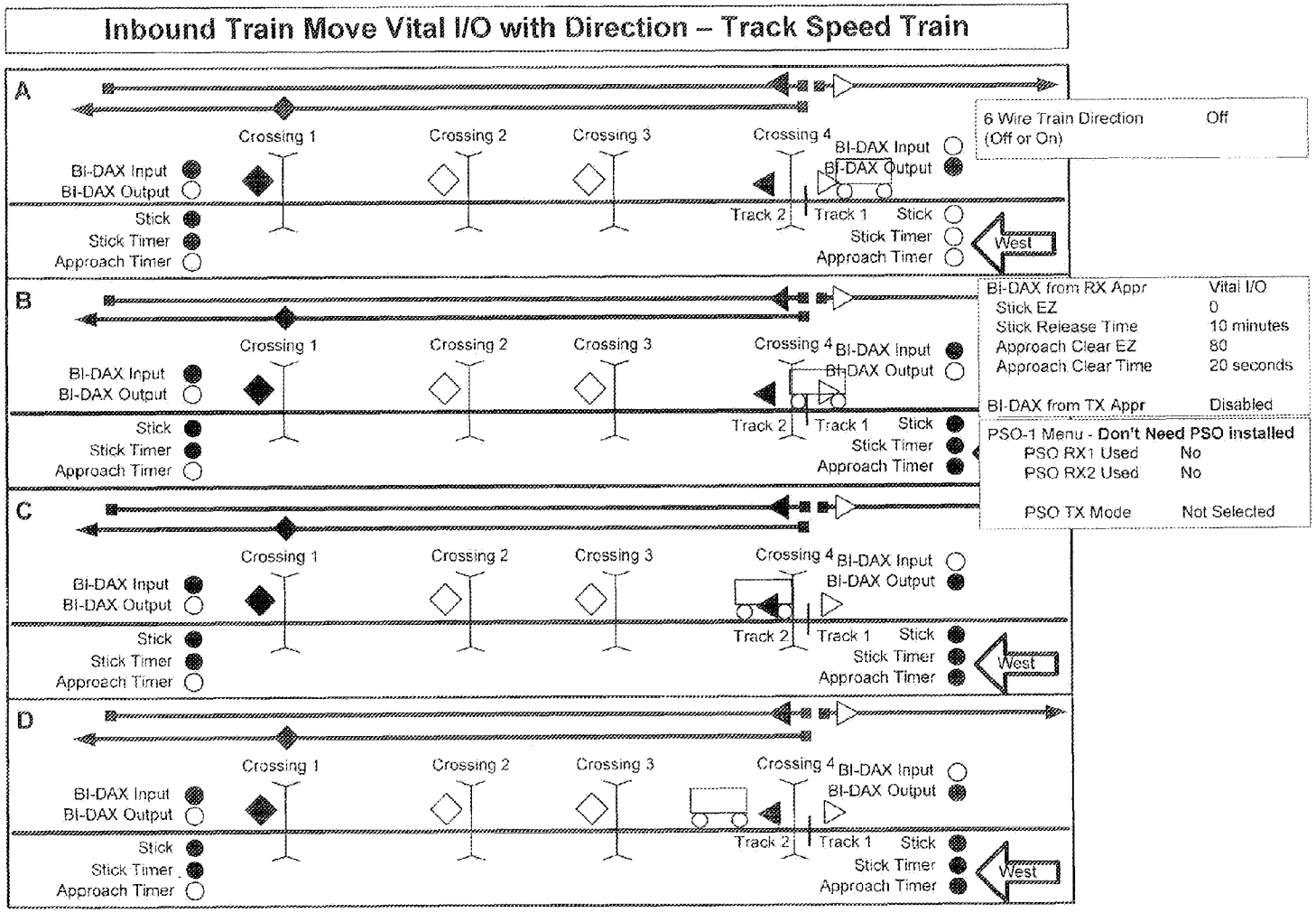
Figure 33:
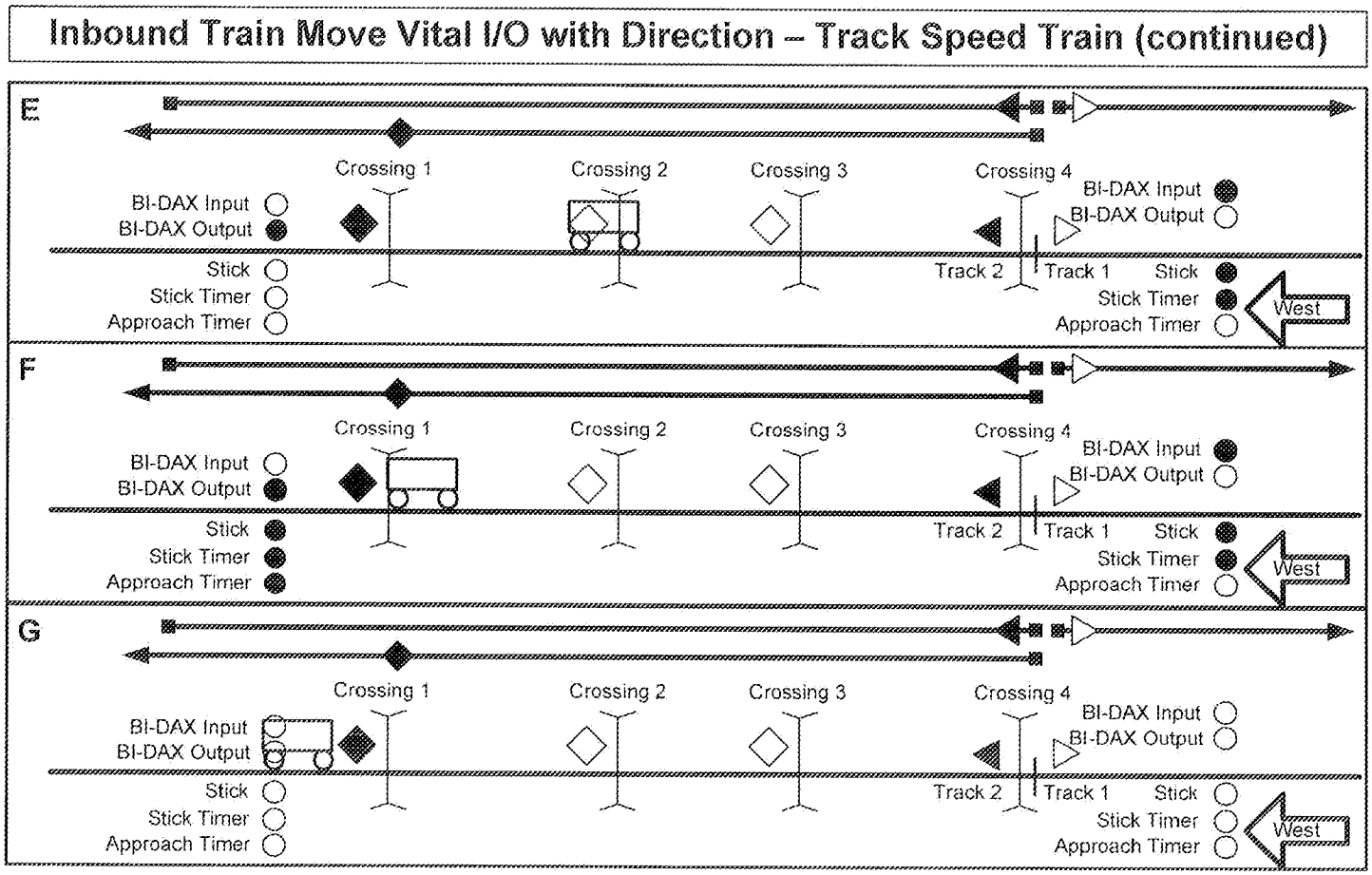
Figure 34:
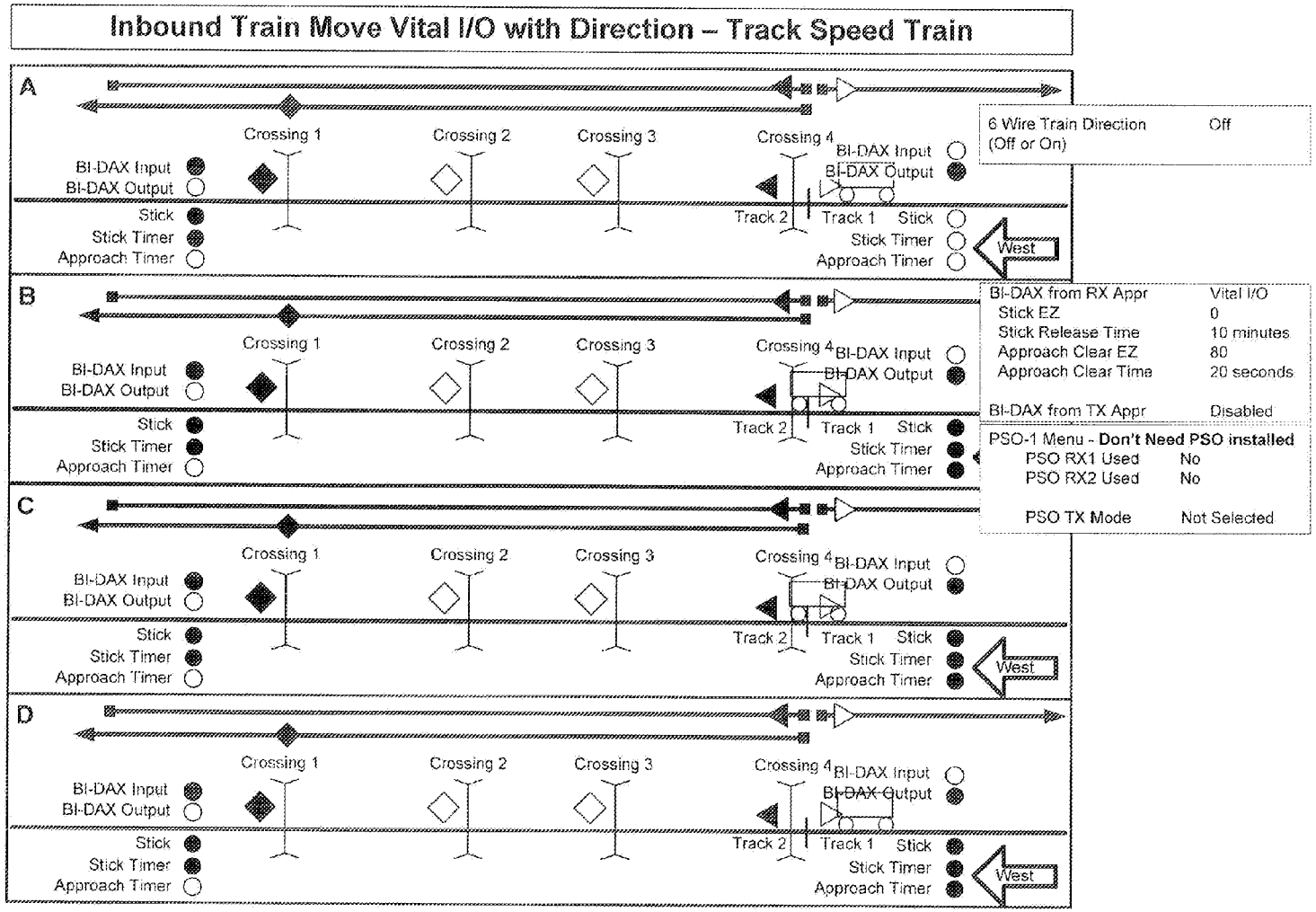
Figure 35:
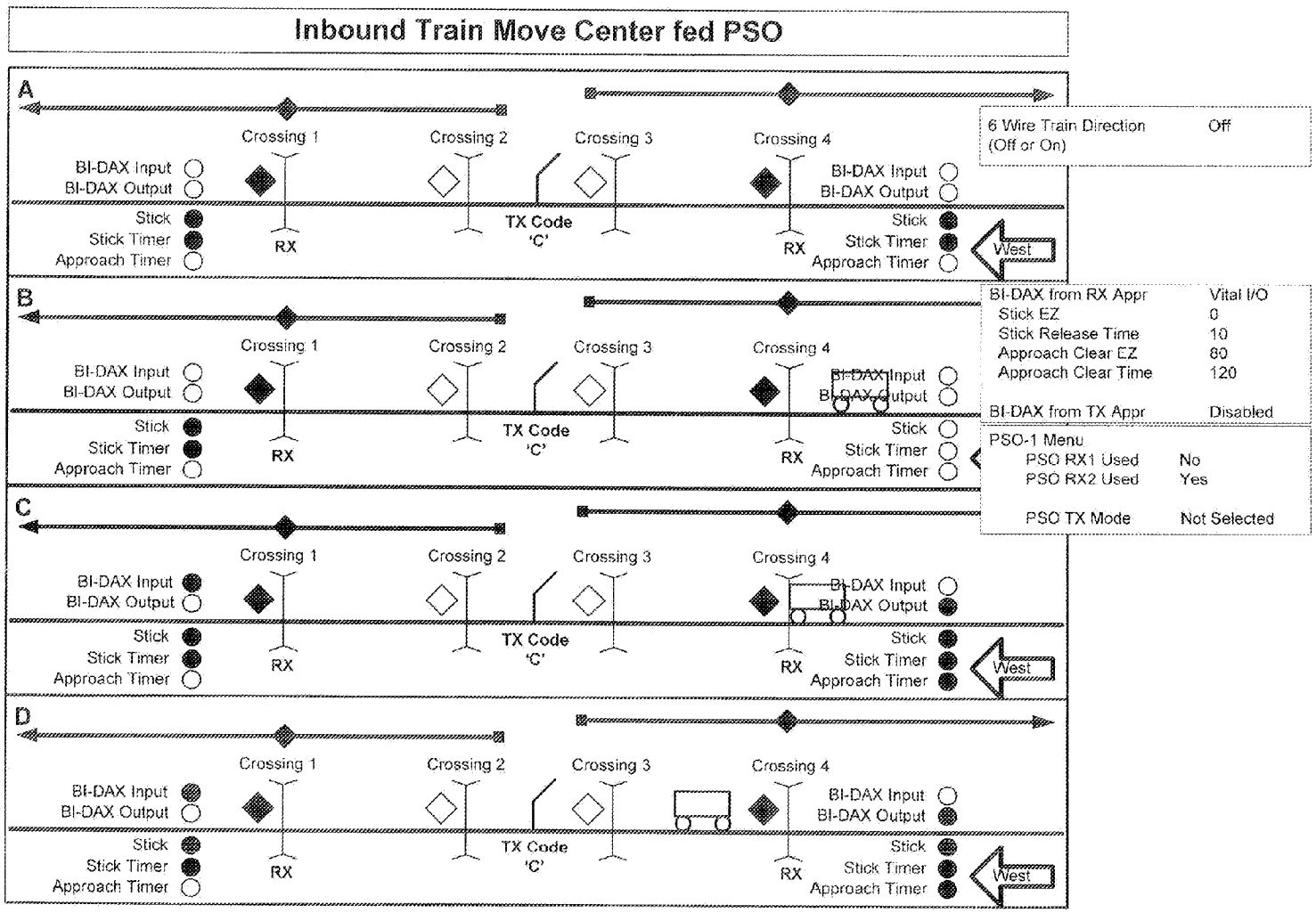
Figure 35:
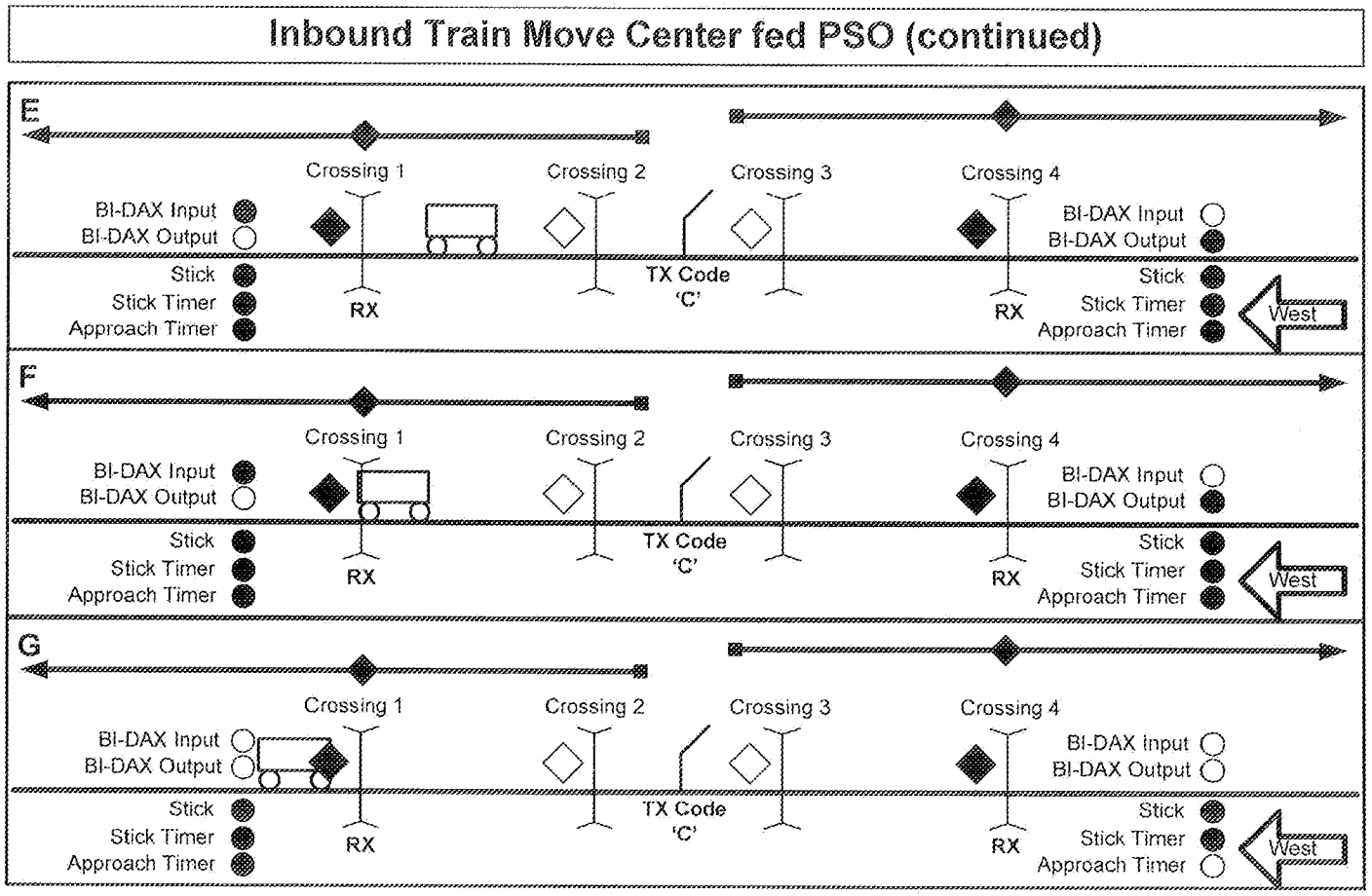
Figure 36:
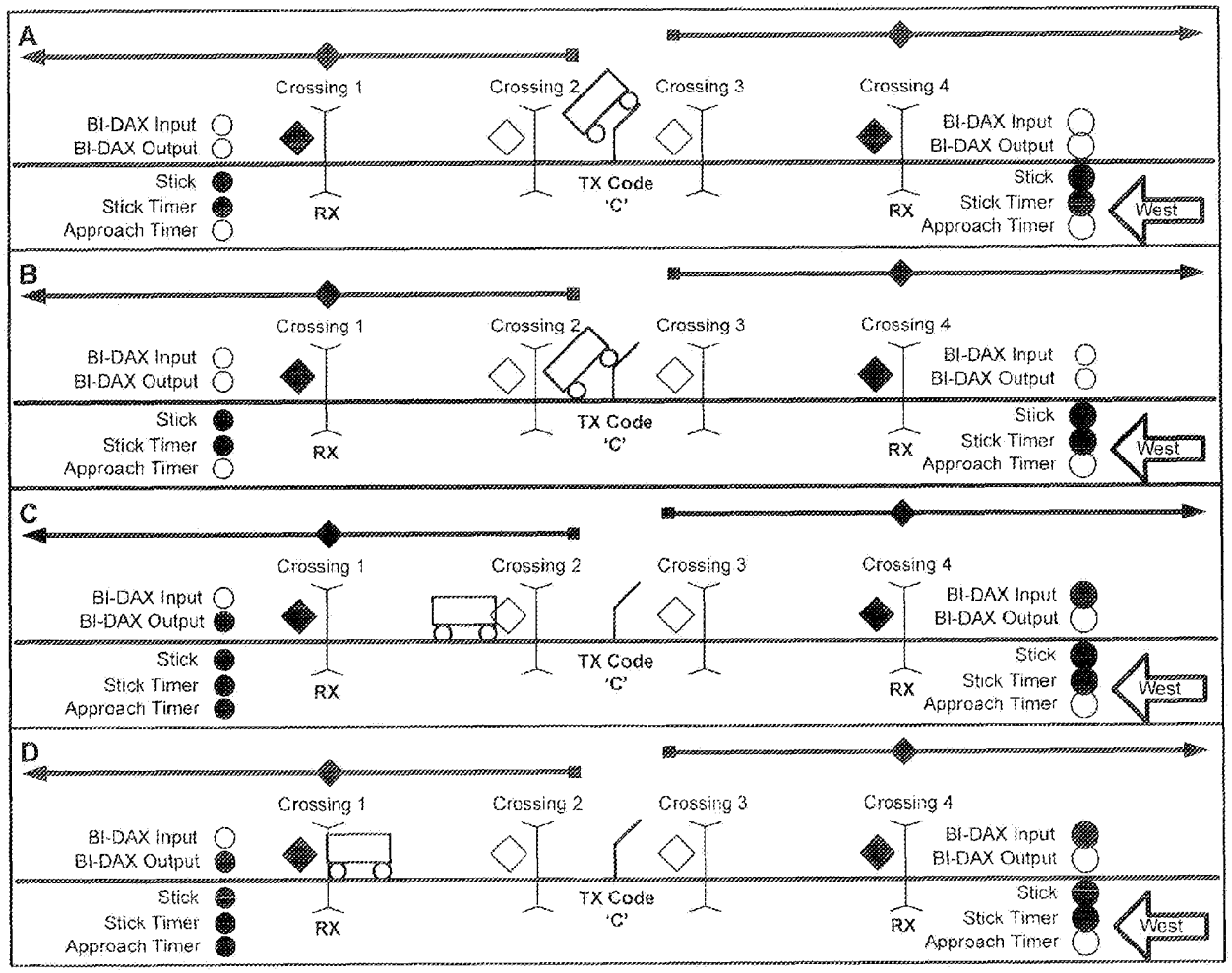
Figure 36:
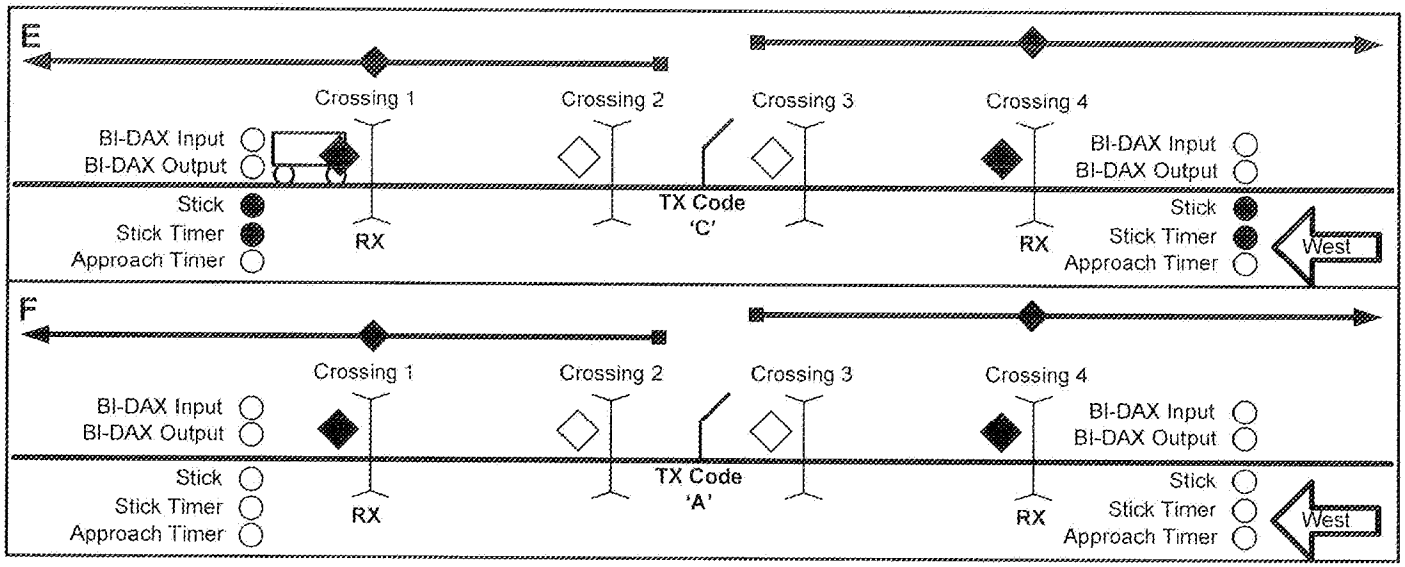
Figure 37:
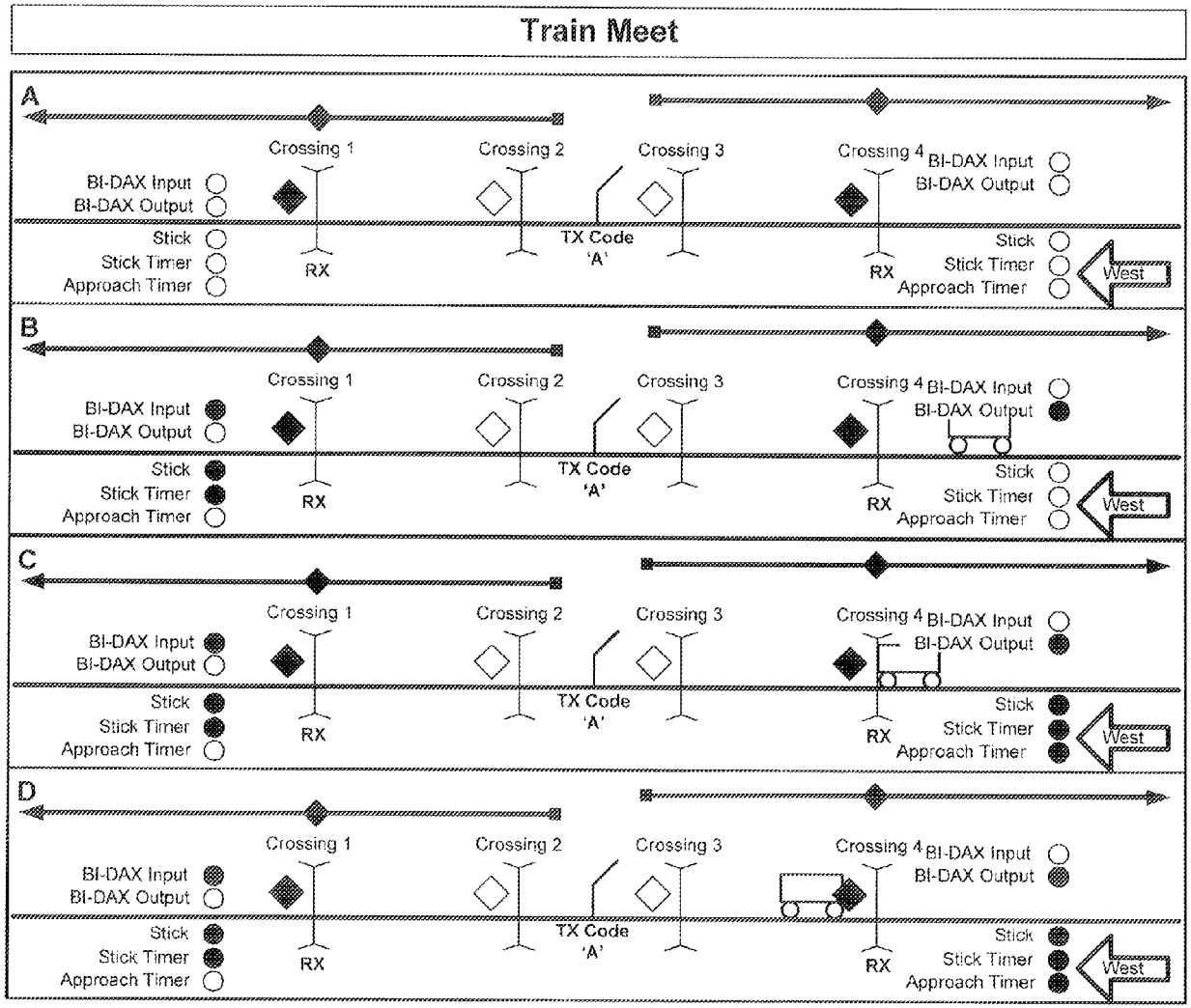
Figure 37:
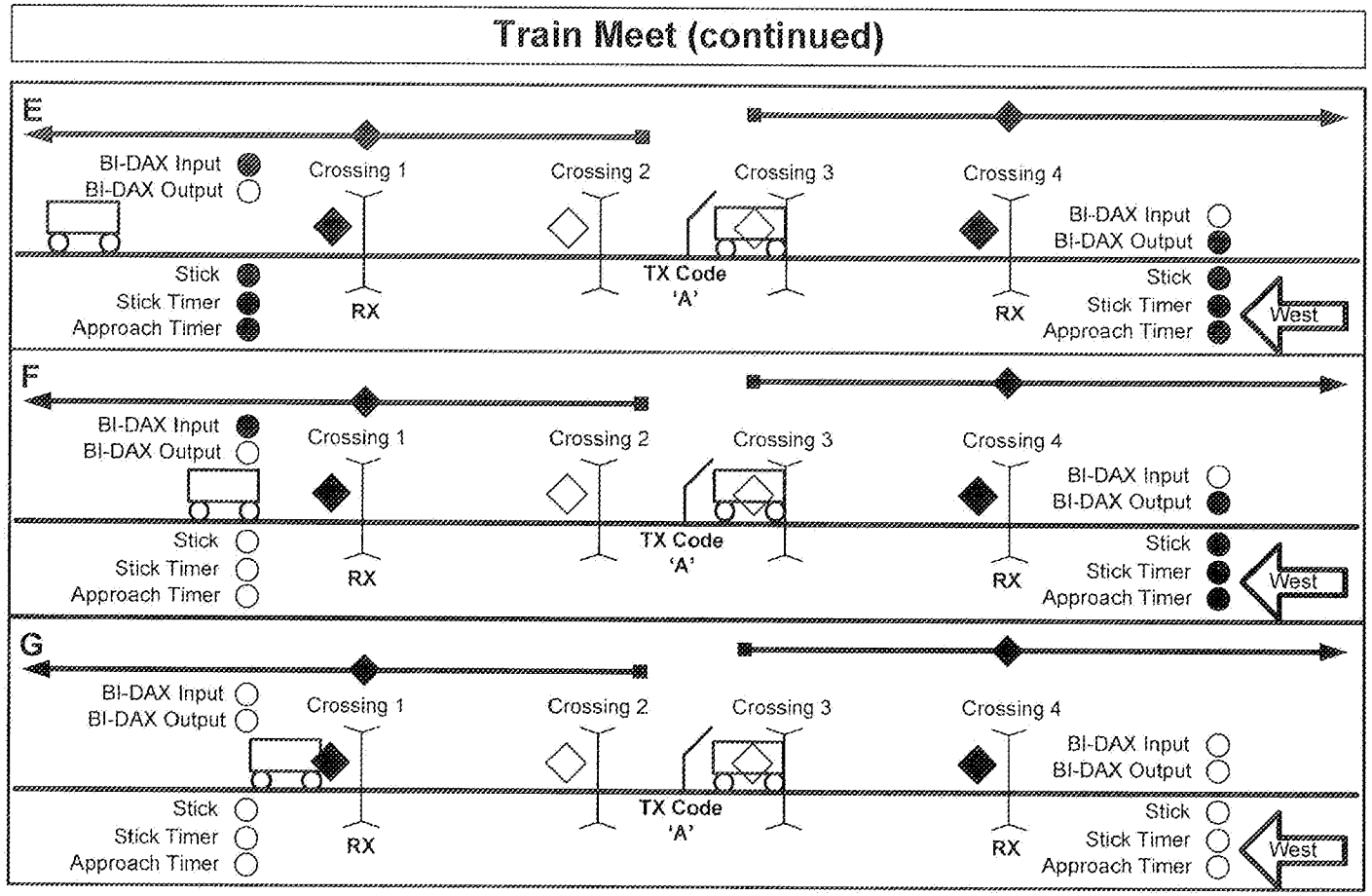
Figure 37:
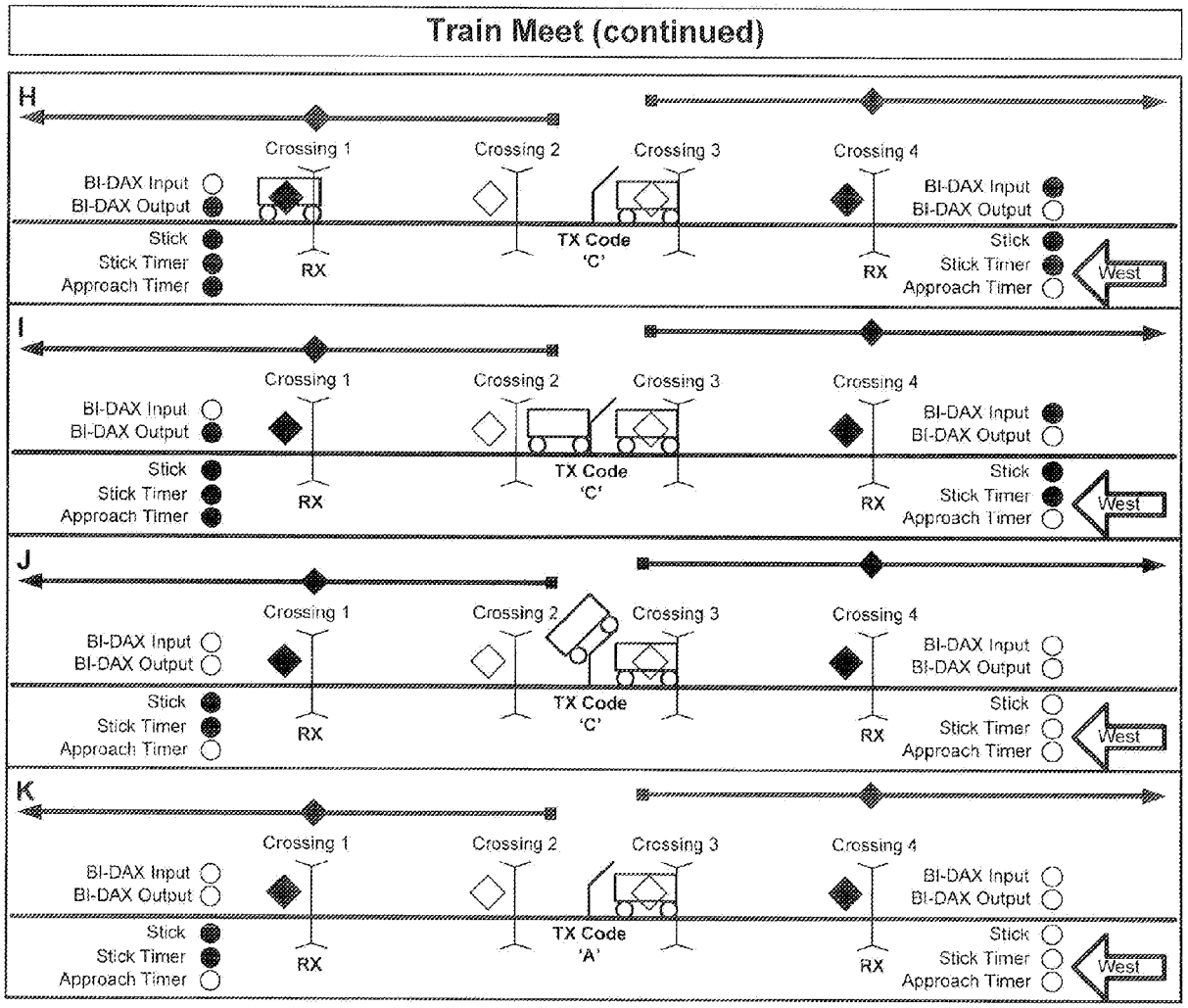
Figure 37:
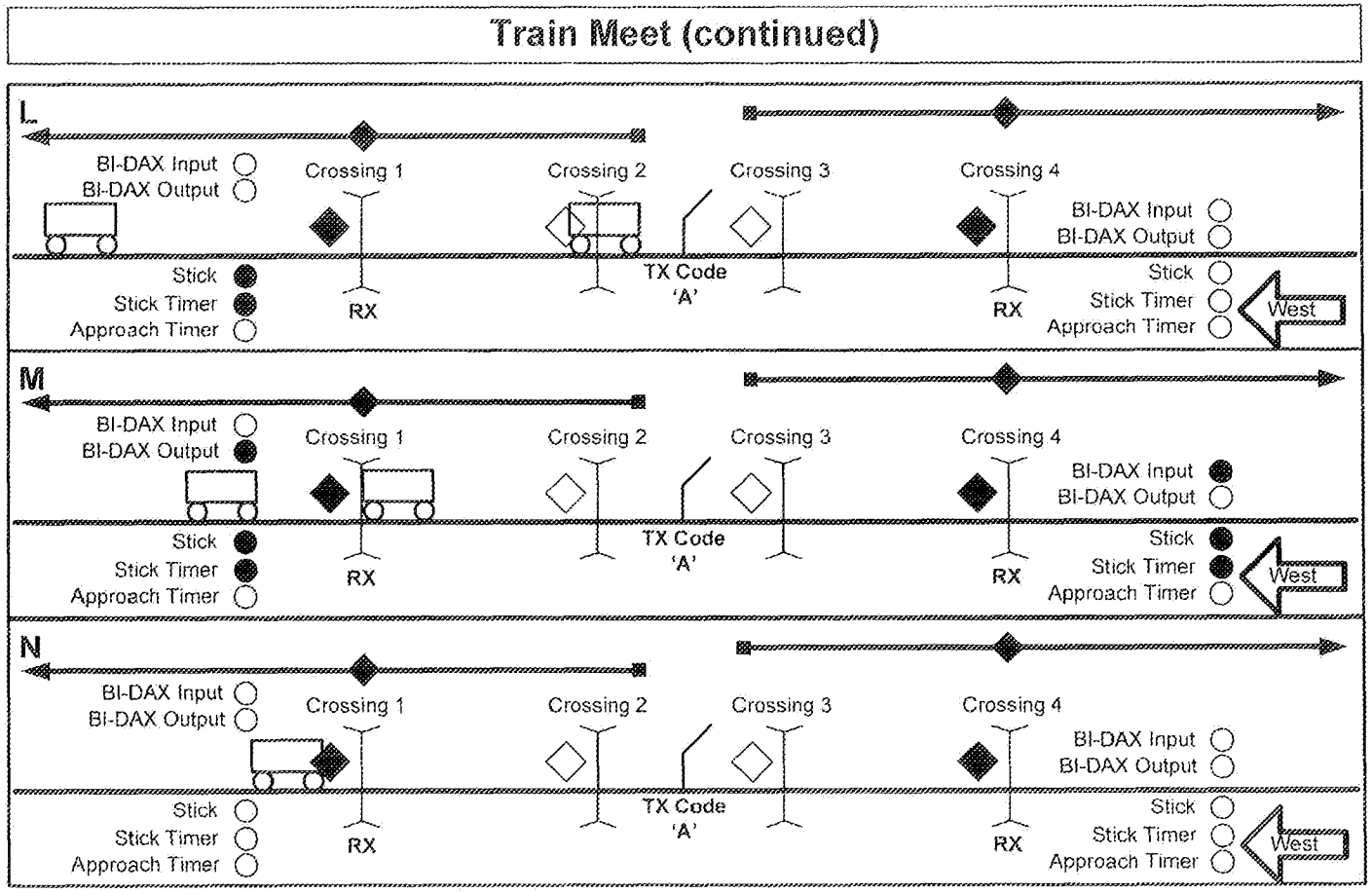

This scenario is similar to FIG. 22 (discussed below) in that while there is no motion and the PSO circuit is de-energized the timers will run. Once the timers expire the sticks will clear. The exception with the internal PSO setup is that while the train is on the PSO circuit after the timers expire the sticks will never be set again due to the inability to receive a code C at the adjacent crossing.

Internal PSO with Approaches at Island (FIGS. 15*a-g*)

Referring now to FIGS. 15*a-g*, initially all sticks are clear and both crossings are transmitting code A. Train travels inbound towards crossing 4. Train starts crossing but has not crossed the Stick EZ point so code A is still transmitted (on the PSO circuit for crossing 4). Next, the following events occur (with capital letters referring to the corresponding portions of the figures):

A—Train crossed Stick EZ point in approach (coincides with termination shunt of crossing 1) and transmits code C due to crossing ringing and EZ<Stick EZ.

A—Crossing 1 sets Stick and Stick timer due to receiving a code C.

B—Crossing 4 island de-energizes.

B—Crossing 4 sets stick, stick release timer, and approach timer.

B—Crossing 4 will transition from transmitting a code C to a code A when the PSO circuit de-energizes (Crossing 4 stops receiving a code A from crossing 1).

B—Crossing 1 keeps stick set due PSO circuit de-energizing and the transition being Code C to no code (PSO Circuit de-energized).

C, D, & E—State remains same while train traverses inner circuit.

C, D, & E—Timers do not run due to inbound or outbound motion.

C, D, & E—Crossing 1 will set Approach clear timer when EZ<Approach Clear EZ.

F—Crossing 1 island de-energizes.

F—States remain unchanged.

G—Crossing 1 & 4 both see PSO circuit up. Both crossings see code A. Crossing 1 island is still down.

G—Crossing 1 receives code A from crossing 4. Crossing 1 is ringing and will transmit a code C while the island is down. Crossing 4 will receive the code C and set its stick.

G—Crossing 1 island energizes. Crossing 1 is receiving a code A from Crossing 4. Crossing 1 transitions to sending a code A to crossing 4. Both crossings clear their sticks.

Internal PSO with Approaches at Island (FIGS. 16*a-g*)

Referring now to FIGS. 16*a-g*, initially all sticks are clear and both crossings are transmitting code A. Train travels inbound towards crossing 4. Train starts crossing but has not crossed the Stick EZ point so code A is still transmitted. Next, the following events occur (with capital letters referring to the corresponding portions of the figures):

A—Train crossed Stick EZ point in approach (coincides with termination shunt of crossing 1) and transmits code C due to crossing ringing and EZ<Stick EZ.

A—Crossing 1 sets Stick and Stick timer due to receiving a code C.

B—Crossing 4 island de-energizes.

B—Crossing 4 sets stick, stick release timer, and approach timer.

B—Crossing 4 will transition from transmitting a code C to a code A when the PSO circuit de-energizes (Crossing 4 stops receiving a code A from crossing 1).

B—Crossing 1 keeps stick set due PSO circuit de-energizing and the transition being Code C to no code (PSO Circuit de-energized).

C, D & E—State remains same while train traverses inner circuit.

C, D & E—Timers do not run due to inbound or outbound motion. Once train leaves crossing 4 approach timers will begin to run even though PSO circuit de-energized.

C, D & E—Crossing 1 will set Approach clear timer when EZ<Approach Clear EZ.

F—Crossing 1 island de-energizes.

F—States remain unchanged.

G—Crossing 1 & 4 both see PSO circuit up. Both crossings see code A. Crossing 1 island is still down.

G—Crossing 1 receives code A from crossing 4. Crossing 1 is ringing and will transmit a code C while the island is down. Crossing 4 will receive the code C and set its stick.

G—Crossing 1 island energizes. Crossing 1 is receiving a code A from Crossing 4. Crossing 1 transitions to sending a code A to crossing 4. Both crossings clear their sticks.

Internal PSO with Joints

Track Speed Train

Westbound Enter from Joints (FIGS. 17*a-g*)

Referring now to FIGS. 17*a-g*, this scenario is the same as the track speed train scenario described above in connection with FIGS. 14*a-g*. The change in setup would be for the calculation of the Approach Clear EZ for crossing 4. Since EZ will go above 80 at crossing 4 when the end of the train crosses the joints, the Approach Clear time should be set for the amount of time it will take for the last axle to travel from the joints to crossing 4 for the maximum speed train.

Eastbound Toward Joints (FIGS. 18*a-g*)

This scenario is basically the same as the track speed train scenario described above in connection with FIGS. 14*a-g*. The difference is the uni-directional unit at crossing 4 where track 2 is not configured for bi-directional DAX. Track 1 is configured for bi-directional DAX.

Slow Speed

Westbound Enter from Joints (FIGS. 19*a-g*)

Referring now to FIGS. 19*a-g*, this scenario is the same as the slow speed train scenario discussed above in connection with FIGS. 14*a-g*. The change in setup would be for the calculation of the Approach Clear EZ for crossing 4. Since EZ will go above 80 at crossing 4 when the end of the train crosses the joints the Approach Clear time should be set for the amount of time it will take for the last axle to travel from the joints to crossing 4 for the maximum speed train.

Train Stops on Inner Approach

This scenario is similar to the scenario discussed below in connection with FIGS. 22*a-g* in that while there is no motion and the PSO circuit is de-energized the timers will run. Once the timers expire the sticks will clear. The exception with the internal PSO setup is that while the train is on the PSO circuit after the timers expire the sticks will never be set again due to the inability to receive a code C at the adjacent crossing.

Vital I/O with Approaches Extending Through Islands

Track Speed Train (FIGS. 20*a-g*)

Referring now to FIGS. 20*a-g*. Approach Clear EZ will be set as the location just outside the paired crossing. Crossing 4 Approach Clear EZ will be just left of Crossing 1 Island. Actual location will be approximately 20 feet left of crossing 1 track wires. Initially all sticks are clear and all Bi-DAX I/O are de-energized. Train travels inbound towards crossing 4. Train starts crossing but has not crossed the Stick EZ point so the Bi-DAX output is not energized. Next, the following events occur (with capital letters referring to the corresponding portions of the figures):

A—Train crossed Stick EZ point in approach (coincides with termination shunt of crossing 1) and energizes Bi-DAX output due to crossing ringing and EZ<Stick EZ.

A—Crossing 1 sets Stick and Stick timer due to Bi-DAX input energizing.

B—Crossing 4 island de-energizes.

B—Crossing 4 sets stick, stick release timer, and approach timer.

B—Crossing 4 keeps Bi-DAX output energized due to stick being set.

B—Crossing 1 keeps stick set due to Bi-DAX input being energized.

C, D & E—State remains same while train traverses inner circuit.

C, D & E—Timers do not run due to inbound or outbound motion.

C, D & E—Crossing 1 does not energize Bi-DAX output due to input being energized C, D & E—Crossing 1 will set Approach clear timer when EZ<Approach Clear EZ.

F—Crossing 1 island de-energizes.

F—States remain unchanged.

G—Crossing 1 island clears.

G—Crossing 4 Approach Clear Timer starts running due to EZ>Approach Clear EZ.

G—Crossing 4 Approach Clear Timer expires.

G—Crossing 4 clears stick due to approach clear timer expiring.

G—Crossing 4 de-energizes Bi-DAX output.

G—Crossing 1 sees Bi-DAX input de-energize.

G—Crossing 1 clears all sticks due to Bi-DAX input de-energizing.

Slow Speed Train (FIGS. 21*a-g*)

Referring now to FIGS. 21*a-g*, the slow speed train scenario will be the same as the track speed scenario. Since the Timers do not run while motion is seen the sticks will remain set while the train moves from one crossing to the other regardless of the speed. The overlapping approaches guarantee that the train is seen from one crossing to the other. The following scenario shows a very slow train inbound on the approach. Next, the following events occur (with capital letters refererring to the corresponding portions of the figures):

A—Initially all sticks are clear and all Bi-DAX I/O are de-energized.

A—Train travels inbound towards crossing 4.

A—Train starts crossing but has not crossed the Stick EZ point so the Bi-DAX output is not energized.

A—Train crossed Stick EZ point in approach (coincides with termination shunt of crossing 1) and DOES NOT energizes Bi-DAX output due to crossing NOT ringing even though EZ<Stick EZ.

B—Train eventually starts crossing 4 and then crossing 4 energizes its Bi-DAX output due to crossing ringing and EZ<Stick EZ.

B—Crossing 1 sets Stick and Stick timer due to Bi-DAX input energizing. Refer to items B through G in connection with the scenario of FIGS. 20*a-g* for remaining steps.

Train Stops Inner Approach (FIGS. 22*a-g*)

Referring now to FIGS. 22*a-g*, the initial state is same as track speed train from the scenario discussed above in connection with FIGS. 20*a-g*. The following events occur (with capital letters referring to the corresponding portions of the figures):

A—Train stops resulting in crossing 4 Stick Release Timer running.

A—Train remains stopped for longer than crossing 4 Stick Release timer setting resulting in timer expiring, stick clearing, and Bi-DAX output de-energizing.

A—Crossing 1 Bi-DAX input de-energizes resulting in stick clearing.

B—Train resumes motion towards crossing 1.

C—Crossing 1 starts and EZ is less than Stick EZ resulting in crossing 1 energizing its Bi-DAX output.

C—Crossing 4 Bi-DAX input energizes resulting in crossing 4 setting stick and stick timer.

D & E—State unchanged as train moves toward crossing 1.

F—Crossing 1 island de-energizes.

F—Crossing 1 sets stick, stick release timer, and approach timer.

F—Crossing 1 keeps Bi-DAX output energized due to stick being set.

F—Crossing 4 keeps stick set due to Bi-DAX input being energized.

G—Crossing 1 island clears.

G—Crossing 1 clears stick due to train move to outer approach.

G—Crossing 1 de-energizes Bi-DAX output.

G—Crossing 4 clears all sticks due to Bi-DAX input.

Train Stops Outer Approach (FIGS. 23*a-b*)

Referring now to FIGS. 23*a-b*, this scenario, a train stopping in the outer approach, applies to all the different setups. The difference being the Stick EZ setting. If the Stick EZ is closer to the island then the train can get closer to the island before crossing 4 (or crossing 1 depending on direction) energizes the Bi-DAX output. Initially all sticks are clear and all Bi-DAX I/O are de-energized. Train travels inbound towards crossing 4. Train starts crossing but has not crossed the Stick EZ point so the Bi-DAX output is not energized. Next, the following events occur (with capital letters referring to the corresponding portions of the figures):

A—Train crossed Stick EZ point in approach (coincides with termination shunt of crossing 1) and energizes Bi-DAX output due to crossing ringing and EZ<Stick EZ.

A—Crossing 1 sets Stick and Stick timer due to Bi-DAX input energizing.

B—Train slows to stop short of crossing island.

B—Crossing 4 clears with train stopped at an EZ less than Stick EZ.

B—Crossing 4 de-energizes its Bi-DAX output due to Crossing not ringing and stick not set B—Crossing 1 Bi-DAX input de-energizes resulting in stick clearing. At this point if the train started back inbound then the scenario outline for FIGS. 21*a-g* discussed above would apply. If the train backed back off the approach then nothing would change from the current states shown in FIG. 23*b*.

Train Stops on Island and Reverses

Scenario #1 (FIGS. 24*a-d*)

Referring now to FIGS. 24*a-d*, a train moves inbound on outer approach and stops spanning the island. Train then reverses direction exiting the island from the same direction that the train entered the island. Initially all sticks are clear and all Bi-DAX I/O are de-energized. Train travels inbound towards crossing 4. Train starts crossing but has not crossed the Stick EZ point so the Bi-DAX output is not energized. Next, the following events occur (with capital letters referring to the corresponding portions of the figures):

A—Train crossed Stick EZ point in approach (coincides with termination shunt of crossing 1) and energizes Bi-DAX output due to crossing ringing and EZ<Stick EZ.

A—Crossing 1 sets Stick and Stick timer due to Bi-DAX input energizing.

B—Crossing 4 island de-energizes.

B—Crossing 4 sets stick, stick release timer, and approach timer.

B—Crossing 4 keeps Bi-DAX output energized due to stick being set.

B—Crossing 1 keeps stick set due to Bi-DAX input being energized.

C—Train stops on island.

C—Crossing 4 Stick Release Timer running due to no inbound or outbound motion C—Crossing 4 Stick Release Timer could run to expiration and then reset to max or be continually reset to max depending on implementation due to island down to set timer and no inbound or outbound motion to run timer. In either implementation the stick will remain set while the island is down.

C—Crossing 1 keeps stick set due to Bi-DAX input being energized.

D—Crossing 4 island clears.

D—Crossing 4 clears stick due to train move to outer approach.

D—Crossing 4 de-energizes Bi-DAX output.

D—Crossing 1 clears all sticks due to Bi-DAX input.

Scenario #2 (FIGS. 24*e-h*)

Referring now to FIGS. 24*e-h*, this scenario follows the scenario discussed above for FIGS. 20*a-d*. Next:

E—State remains same while train traverses inner circuit.

F—Crossing 1 island de-energizes.

F—States remain unchanged as train slows to stop on crossing 1 island.

F—Train is stopped on Crossing 1 island.

F—Crossing 4 Approach Release Timer is not running due to EZ<Approach Clear EZ.

F—Crossing 4 Stick Release Timer is running due to no inbound or outbound motion.

G—Crossing 4 Stick Release Timer expires resulting in the sticks clearing and the Bi-DAX output de-energizing.

G—Crossing 1 Bi-DAX input de-energizes but crossing 1 is ringing so crossing 1 energizes its Bi-DAX output and keeps stick set.

G—Crossing 4 Bi-DAX input energizes resulting in stick, stick timer, and approach timer being set.

G—Crossing 1 Stick Release Timer could run to expiration and then reset to max or be continually reset to max depending on implementation due to island down to set timer and no inbound or outbound motion to run timer. In either implementation the stick will remain set while the island is down.

H—Train moves off island towards inner approach keeping the stick set at crossing 1 due to the train direction being towards the inner approach.

Vital I/O with Approaches at Island

Track Speed Train (FIGS. 25*a-a*)

Referring now to FIGS. 25*a-g*, this scenario is the same as that discussed above in connection with FIGS. 20*a-g*, with the exception of the Stick EZ location and the point at which the Approach Clear Timer will start running. Due to the location of the termination shunts the Stick EZ is located closer to the crossing island and therefore the Bi-DAX output is energized later (train is closer to the crossing island). The termination shunts are located on the inner side of the island which results in the approach clear timer starting to run at crossing 4 while the train is moving through crossing 1 island. Since the approach clear timer is not allowed to run while inbound or outbound motion is seen the timer will not start until the last axle leaves the approach. As the track is laid out in the figure the last axle would leave crossing 4 approach only to enter crossing 1 island. An Approach Clear Timer programmed value of around 15 seconds would work in this scenario. A larger value would keep the stick set at both crossings until the timer expired while the train moved outbound on crossing 1 approach.

Slow Train

The slow speed train scenario will be the same as the track speed scenario. Since the Stick Release Timer and the Approach Release Timer do not run while motion is seen the sticks will remain set while the train moves outbound from one crossing to the other regardless of the speed. The approach extends from one island to the other guaranteeing that the train is seen between the crossings.

Stopped Train

The stopped train scenario is the same as for FIGS. 22*a-g*. Since the approaches terminate at each island, the train is seen by both crossings. This is no different than the scenario for the approaches extending through the islands.

Vital I/O with Approaches Short of Island

Track Speed (FIGS. 26*a-g*)

For a track speed train with the timers programmed properly this scenario will operate per the previous track speed train scenarios.

Track Speed #2 (FIGS. 27*a-g*)

For a track speed train with the timers programmed properly this scenario will operate per the previous track speed train scenarios.

Slow Speed Train (FIGS. 28*a-g*)

This scenario will follow the scenario discussed above in connection with FIGS. 20*a-d*. The difference starts at FIG. E once the train leaves Crossing 4 approach but is still within the inner circuit.

Scenario #1

E—Crossing 1 starts and Bi-DAX input is still de-energized.
E—Train leaves Crossing 4 Approach.
E—Crossing 4 Approach Clear Timer starts due to EZ>Approach Clear EZ and no motion on Crossing 4 Approach.
E—Crossing 4 Approach Clear Timer expires E—Crossing 4 clears Stick Release Timer.
E—Crossing 4 clears Stick.
E—Crossing 4 de-energizes Bi-DAX output.
E—Crossing 1 Bi-DAX input de-energizes but stick remain set due to Crossing 1 ringing.
E—Crossing 1 energizes its Bi-DAX output due to stick set.
E—Crossing 4 sets stick due to Bi-DAX input energized.
F—Crossing 1 island de-energizes.
F—States remain unchanged.
G—Crossing 1 island clears.
G—Crossing 1 clears stick due to train move to outer approach.
G—Crossing 1 de-energizes Bi-DAX output.
G—Crossing 4 clears all sticks due to Bi-DAX input de-energizing.

Scenario #2 (FIGS. 29*a-g*)

E—Crossing 1 has not started and Bi-DAX input is still de-energized.
E—Train leaves Crossing 4 Approach.
E—Crossing 4 Approach Clear Timer starts due to EZ>Approach Clear EZ and no motion on Crossing 4 Approach.
E—Crossing 4 Approach Clear Timer expires.
E—Crossing 4 clears Stick Release Timer.
E—Crossing 4 clears Stick.
E—Crossing 4 de-energizes Bi-DAX output E—Crossing 1 Bi-DAX input de-energizes and clears sticks (crossing 1 is not ringing).
E—Crossing 1 starts and EZ<Stick EZ resulting in energizing its Bi-DAX output.
E—Crossing 4 sets stick due to Bi-DAX input energized.
F—Crossing 1 island de-energizes.
F—Crossing 1 sets stick, stick timer and approach clear timer.
G—Crossing 1 island clears.
G—Crossing 1 clears stick due to train move to outer approach.
G—Crossing 1 de-energizes Bi-DAX output.
G—Crossing 4 clears all sticks due to Bi-DAX input de-energizing.

Vital I/O with Joints

Track Speed

Westbound Enter from Joints (FIGS. 30*a-g*)

Referring now to FIGS. 30*a-g*, this scenario is the same as the scenario discussed above in connection with FIGS. 20*a-g*. The change in setup would be for the calculation of the Approach Clear EZ for crossing 4. Since EZ will go above 80 at crossing 4 when the end of the train crosses the joints, the Approach Clear time should be set for the amount of time it will take for the last axle to reach crossing 4 for the maximum speed train. This will allow the bi-directional DAX system to cover slower speed trains since crossing 1 will take over stick control if its Bi-DAX input de-energizes and crossing 1 is de-energized.

Eastbound Exit Via Joints (FIGS. 31*a-g*)

Referring now to FIGS. 31*a-g*, initially all sticks are clear and all Bi-DAX I/O are de-energized. Train travels inbound towards crossing 1. Train starts crossing 1 but has not crossed the Stick EZ point so the Bi-DAX output is not energized. Next:

A—Train crossed Stick EZ point in approach and energizes Bi-DAX output due to crossing ringing and EZ<Stick EZ.
A—Crossing 4 sets Stick and Stick timer due to Bi-DAX input energizing.
B—Crossing 1 island de-energizes.
B—Crossing 1 sets stick, stick release timer, and approach timer.
B—Crossing 1 keeps Bi-DAX output energized due to stick being set.
B—Crossing 4 keeps stick set due to Bi-DAX input being energized.
C, 4, & 5—State remains same while train traverses inner circuit.
C, 4, & 5—Timers do not run due to inbound or outbound motion.
C, 4, & 5—Crossing 4 does not energize Bi-DAX output due to input being energized
C, 4, & 5—Crossing 4 will set Approach clear timer when EZ<Approach Clear EZ.
F—Crossing 4 island de-energizes but the EZ is still 100 as the train has not crossed the joints. Island is back fed from track 2.
F—States remain unchanged.
G—Crossing 4 island clears.
G—Crossing 1 Approach Clear Timer starts running due to EZ>Approach Clear EZ.
G—Crossing 1 Approach Clear Timer expires.
G—Crossing 1 clears stick due to approach clear timer expiring.
G—Crossing 1 de-energizes Bi-DAX output.
G—Crossing 4 sees Bi-DAX input de-energize.
G—Crossing 4 clears all sticks due to Bi-DAX input de-energizing.

Slow Speed

Scenario #1 (FIGS. 32*a-g*)

Referring now to FIGS. 32*a-g*, this scenario will follow the scenario for FIGS. 20*a* through 20*d*. The difference starts at E once the Approach Clear Timer clears at Crossing 4. Crossing 1 was started prior to Crossing 4 Approach Clear Timer expiring. Next:

E—Crossing 1 starts and Bi-DAX input is still de-energized.
E—Crossing 4 Approach Clear Timer expires.
E—Crossing 4 clears Stick Release Timer.
E—Crossing 4 clears Stick.

E—Crossing 4 de-energizes Bi-DAX output.
E—Crossing 1 Bi-DAX input de-energizes but stick remain set due to Crossing 1 ringing.
E—Crossing 1 energizes its Bi-DAX output due to stick set.
E—Crossing 4 sets stick due to Bi-DAX input energized.
F—Crossing 1 island de-energizes.
F—States remain unchanged.
G—Crossing 1 island clears.
G—Crossing 1 clears stick due to train move to outer approach.
G—Crossing 1 de-energizes Bi-DAX output.
G—Crossing 4 clears all sticks due to Bi-DAX input de-energizing.

Scenario #2 (FIGS. 33*a-g*)

Referring now to FIGS. 33*a-g*, this scenario will follow the scenario for FIGS. 20*a* through 20*d*. The difference starts at E once the Approach Clear Timer clears at Crossing 4. Crossing 1 has not started prior to Crossing 4 Approach Clear Timer expiring. The following occurs next:

E—Crossing 1 has not started and Bi-DAX input is still de-energized.
E—Crossing 4 Approach Clear Timer expires.
E—Crossing 4 clears Stick Release Timer.
E—Crossing 4 clears Stick.
E—Crossing 4 de-energizes Bi-DAX output.
E—Crossing 1 Bi-DAX input de-energizes and clears sticks (crossing 1 is not ringing).
E—Crossing 1 starts and EZ<Stick EZ resulting in its Bi-DAX output energizing.
E—Crossing 4 sets stick due to Bi-DAX input energized.
F—Crossing 1 island de-energizes.
F—Crossing 1 sets stick, stick timer and approach clear timer.
G—Crossing 1 island clears.
G—Crossing 1 clears stick due to train move to outer approach.
G—Crossing 1 de-energizes Bi-DAX output.
G—Crossing 4 clears all sticks due to Bi-DAX input de-energizing.

Train Stops on Island and Reverses (FIGS. 34*a-g*)

Referring now to FIGS. 34*a-g*, the train moves inbound on outer approach and stops spanning the island. Train then reverses direction exiting the island from the same direction that the train entered the island. Initially all sticks are clear and all Bi-DAX I/O are de-energized. Train travels inbound towards crossing 4. Train starts crossing but has not crossed the Stick EZ point so the Bi-DAX output is not energized. Then:

A—Train crossed Stick EZ point in approach and energizes Bi-DAX output due to crossing ringing and EZ<Stick EZ.
A—Crossing 1 sets Stick and Stick timer due to Bi-DAX input energizing.
B—Crossing 4 island de-energizes.
B—Crossing 4 sets stick, stick release timer, and approach timer.
B—Crossing 4 keeps Bi-DAX output energized due to stick being set.
B—Crossing 1 keeps stick set due to Bi-DAX input being energized.
C—Train stops on island.
C—Crossing 4 Stick Release Timer running due to no inbound or outbound motion.
C—Crossing 4 Stick Release Timer could run to expiration and then reset to max or be continually reset to max depending on implementation due to island down to set timer and no inbound or outbound motion to run timer. In either implementation the stick will remain set while the island is down.
C—Crossing 1 keeps stick set due to Bi-DAX input being energized.
D—Crossing 4 island clears.
D—Crossing 4 clears stick due to train move to outer approach.
D—Crossing 4 de-energizes Bi-DAX output.
D—Crossing 1 clears all sticks due to Bi-DAX input.

Center Fed Through Move Over Reverse Switch (FIGS. 35*a-g*)

Referring now to FIGS. 35*a-g*, the initial state is Bi-DAX outputs de-energized and switch set for mainline move, transmitting code A.

A—Switch is thrown for a diverging move resulting in a code C being transmitted from the switch to both Crossing 1 and Crossing 4.
A—Crossing 1 and 4 set stick and stick release timer due to receiving code C on RX2.
A—Bi-DAX outputs stay de-energized.
B—Train inbound on crossing 4 approach which starts crossing. EZ is less than Approach EZ.
B—Crossing 4 clears stick due to crossing start and receiving a code C on RX2.
B—Crossing 4 does not energizes its Bi-DAX output due to receiving a code C on RX2. Stick is already set at crossing 1 due to switch position.
C—Crossing 4 island de-energizes.
C—Crossing 4 sets stick, stick release timer, and approach timer.
C—Crossing 4 will energize its Bi-DAX output once the train shunts the PSO circuit resulting in no Code C on RX2.
C—Crossing 1 keeps stick set due to Bi-DAX input being energized and receiving a code C on RX2
D, & 5—State remains same while train traverses inner circuit.
D, & 5—Timers do not run due to inbound or outbound motion.
D, & 5—Crossing 1 does not energize Bi-DAX output due to input being energized.
D, & 5—Crossing 1 will set Approach clear timer when EZ<Approach Clear EZ.
E—When the train shunts the PSO circuit for crossing 1 resulting in no code C for RX2 the sticks will remain set due to the Bi-DAX input being energized.
E—Crossing 4 Approach Clear Timer starts running due to EZ>Approach Clear EZ.
F—Crossing 1 island de-energizes.
F—States remain unchanged.
G—Crossing 1 island clears.
G—Crossing 4 Approach Clear Timer expires.
G—Crossing 4 de-energizes Bi-DAX output due to approach clear timer expiring but keeps stick set due to receiving code C on RX2.
G—Crossing 1 sees Bi-DAX input de-energize.
G—Crossing 1 would clear all sticks due to Bi-DAX input de-energizing but they remain set due to code C being received on RX2.

Center Fed Train Enters from Siding (FIGS. 36*a-f*)

Referring now to FIGS. 36*a-f*, the initial state is Bi-DAX outputs de-energized and switch set for mainline move, transmitting code A. The following occurs next:

A—Switch is thrown for a diverging move resulting in a code C being transmitted from the switch to both Crossing 1 and Crossing 4.
A—Crossing 1 and 4 set stick and stick release timer due to receiving code C on RX2.
A—Bi-DAX outputs stay de-energized.

B—Train enters approach shunting crossing 1 PSO Circuit resulting in crossing 1 not seeing a code C on RX2.

B—Crossing 1 stick remains set due to seeing code C then no code.

B—Crossing 4 may or may not see the code C still depending on the PSO connections at the switch. Either way the stick will remain set either due to seeing a code C or for Stick Release time.

C—Train is inbound to crossing 1 resulting in crossing 1 starting.

C—Crossing 1 Bi-DAX output energizes.

C—Crossing 4 Bi-DAX input energizes.

D—Crossing 1 island de-energizes—stick states remain the same.

E—Crossing 1 island energizes.

E—Crossing 1 de-energizes Bi-DAX output due to train leaving island to outer approach.

E—Crossing 4 Bi-DAX input de-energizes.

E—Crossing 1 and 4 sticks remain set due to seeing Code C on RX2.

F—Train is off approaches.

F—Sticks will still be set due to code C on RX2.

F—Switch is thrown for mainline resulting in Code A received on RX2.

F—Crossing 1 and 4 both clear their sticks due to receiving Code A on RX2.

Center Fed Train Meet

Scenario #1 (FIGS. 37*a-h*)

A—Initially all sticks are clear and all Bi-DAX I/O are de-energized. Switch is set normal and PSO is transmitting Code A.

B—Train travels inbound towards crossing 4. B—Train starts crossing but has not crossed the Stick EZ point so the Bi-DAX output is not energized.

B—Train crossed Stick EZ point in approach and energizes Bi-DAX output due to crossing ringing and EZ<Stick EZ.

B—Crossing 1 sets Stick and Stick timer due to Bi-DAX input energizing.

C—Crossing 4 island de-energizes.

C—Crossing 4 sets stick, stick release timer, and approach timer.

C—Crossing 4 keeps Bi-DAX output energized due to stick being set.

C—Crossing 1 keeps stick set due to Bi-DAX input being energized.

D—State remains same while train traverses inner circuit.

D—Timers do not run due to inbound or outbound motion.

D—Crossing 1 does not energize Bi-DAX output due to input being energized.

E—Train stops at switch and at a point where crossing 4 EZ is greater than approach EZ.

E—Crossing 4 Approach Clear timer starts running.

E—Second train inbound towards crossing 1.

E—crossing 1 starts due to second train.

E—crossing 1 stick will remain set due to Bi-DAX input being energized and receiving code A on RX2 (switch not thrown).

F—Switch is thrown for a diverging move resulting in the PSO at the switch transmitting a code C.

F—Crossing 1 is ringing and receiving a code C on RX2 resulting in the sticks being cleared (overrides the Bi-DAX input).

G—Crossing 4 timers expire. Could be Approach Clear or Stick Release. Bi-DAX output de-energizes and stick clear.

G—Crossing 1 still overriding sticks due to crossing ringing and receiving code C on RX2.

H—Crossing 1 island de-energizes.

H—Crossing 1 sets stick, stick release timer, and approach timer.

H—Crossing 1 will energize its Bi-DAX output once the train shunts the PSO circuit resulting in no Code C on RX2.

H—Crossing 1 sets stick due to Bi-DAX input being energized

I—Second train moves towards switch. States remain the same.

I—Second train leaves approach via switch (last axle still on Crossing 1 approach and shunting PSO circuit). State remains the same.

J—Second train leaves approach resulting in crossing 1 PSO Circuit energizing.

J—Crossing 1 receives Code C on RX2. This clears the Bi-DAX output and keeps the sticks set.

J—Crossing 1 Approach Clear Timer expires.

J—Crossing 4 Bi-DAX input de-energizes resulting in sticks being cleared.

K—Crossing 1 stick remains set for Approach Clear time due to seeing transition from code C to code A.

L—Crossing 1 stick set due to Approach clear time being frozen due to inbound motion and EZ<Approach EZ.

M—Crossing 1 island de-energizes.

M—Crossing 1 sets stick, stick timer and approach clear timer.

N—Crossing 1 island clears.

N—Crossing 1 clears stick due to train move to outer approach.

N—Crossing 1 de-energizes Bi-DAX output.

N—Crossing 4 clears all sticks due to Bi-DAX input de-energizing.

It will be apparent to those of skill in the art that numerous other variations in addition to those discussed above are also possible. Therefore, while the invention has been described with respect to certain specific embodiments, it will be appreciated that many modifications and changes may be made by those skilled in the art without departing from the spirit of the invention. It is intended therefore, by the appended claims to cover all such modifications and changes as fall within the true spirit and scope of the invention.

Furthermore, the purpose of the Abstract is to enable the patent office and the public generally, and especially the scientists, engineers and practitioners in the art who are not familiar with patent or legal terms or phraseology, to determine quickly from a cursory inspection the nature and essence of the technical disclosure of the application. The Abstract is not intended to be limiting as to the scope of the present inventions in any way.

What is claimed is:

1. A first crossing predictor for operation at a first crossing, comprising:

a control unit;

a first port connected to the control unit, the first port being operable to receive a first signal from a second crossing predictor, the first signal indicating whether the second crossing predictor has detected a train in an approach of the second crossing predictor;

a second port connected to the control unit, the second port being operable to transmit a constant warning time signal to a device located at a second crossing;

a transmitter connected to and under control of the control unit and being operable to transmit a second signal over the rails of a train rack;

a receiver connected to and under control of the control unit and being operable to receive the second signal;

wherein the control unit is adapted to detect the presence of a train based on a characteristic of the second signal and determine whether to transmit the constant warning time signal via the second port based at least in part on the first signal.

2. The first crossing predictor of claim 1, wherein the control unit transmits the constant warning time signal via the second port if the first signal indicates that the second crossing predictor had not detected a train prior to detection of the train by the control unit.

3. The first crossing predictor of claim 1, wherein the control unit further comprises a third port, and wherein the control unit is further operable to transmit a third signal via the third port to the second crossing predictor to indicate that the first crossing predictor has detected the presence of a train.

4. The first crossing predictor of claim 1, wherein the first port is a wireless communications port.

5. The first crossing predictor of claim 1, wherein the first port is configured for rail based communications.

6. The first crossing predictor of claim 5, wherein the first port comprises a phase shift overlay (PSO) receiver.

7. The first crossing predictor of claim 1, wherein the second port is configured for rail based communications.

8. The first crossing predictor of claim 7, wherein the second port comprises a PSO transmitter.

9. The first crossing predictor of claim 1, wherein the control unit is further operable to suppress the transmission of the constant warning time signals via the second port if the first signal indicates that the second crossing predictor had detected the train prior to detection of the train by the control unit.

10. The first crossing predictor of claim 9, wherein the control unit causes the second port to transmit a constant warning time signal via the second port if the first signal indicates that the second predictor had not detected the train prior to detection of the train by the control circuit.

11. The first crossing predictor of claim 10, wherein the second port is connectable to the second crossing predictor.

12. The first crossing predictor of claim 10, wherein the second port is connectable to a third crossing predictor.

13. The first crossing predictor of claim 7, wherein the second port is configured for wireless communication.

* * * * *